US006612691B1

(12) United States Patent
Koitabashi et al.

(10) Patent No.: US 6,612,691 B1
(45) **Date of Patent: *Sep. 2, 2003**

(54) INK JET RECORDING METHOD

(75) Inventors: Noribumi Koitabashi, Yokohama (JP); Hitoshi Tsuboi, Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/131,736

(22) Filed: Aug. 10, 1998

(30) Foreign Application Priority Data

Aug. 8, 1997 (JP) ..... 9-215033

(51) Int. Cl.[7] ..... B41J 2/01
(52) U.S. Cl. ..... 347/105; 347/106; 428/32.1
(58) Field of Search ..... 347/105, 106, 347/101

(56) References Cited

U.S. PATENT DOCUMENTS 5,591,514 A 1/1997 Hirose et al. ..... 428/211
5,608,438 A 3/1997 Koike et al. ..... 347/100
5,955,515 A * 9/1999 Kimura et al. ..... 523/161

FOREIGN PATENT DOCUMENTS

EP 0 382 023 A1 8/1990
EP 0 633 136 A2 1/1995
EP 0 767 224 A2 4/1997
JP 05-016341 * 1/1993 ..... B41J/2/01

* cited by examiner

*Primary Examiner*—Bruce H. Hess
*Assistant Examiner*—Michael E. Grendzynski
(74) *Attorney, Agent, or Firm*—Fitzpatrick, Cella, Harper & Scinto

(57) ABSTRACT

An ink jet recording method using a recording device including a recording head provided with an ejection outlet for ejecting ink and heating means for heating at least a part of a recording material; the method includes a recording step of recording by ejecting ink to a predetermined region on a recording material, using a recording head; a heating step of heating said region by heating means; and wherein the ink has an ink absorption coefficient Ka ($ml.m^{-2}.msec^{-1/2}$) relative to a plain paper, defined by Bristow method, is 1.0–5.0 and satisfies $0<ts\leqq 200$ msec where ts is a rapid expansion start point.

27 Claims, 42 Drawing Sheets

(a)

| Vd | r | R | S | h | AF |
|---|---|---|---|---|---|
| 5 | 10.6 | 21.2 | 1412 | 3.5 | 28.4 |
| 8.5 | 12.7 | 25.4 | 2027 | 4.2 | 40.8 |
| 10 | 13.4 | 26.8 | 2256 | 4.4 | 45.4 |
| 15 | 15.3 | 30.6 | 2942 | 5.1 | 59.2 |
| 20 | 16.8 | 33.6 | 3547 | 5.6 | 71.4 |
| 25 | 18.1 | 36.2 | 4117 | 6.1 | 82.8 |
| 30 | 19.3 | 38.6 | 4681 | 6.4 | 94.2 |
| 35 | 20.3 | 40.6 | 5178 | 6.8 | 104.2 |
| 40 | 21.2 | 42.4 | 5648 | 7.1 | 113.6 |

INK JET RECORDING METHOD

FIELD OF THE INVENTION AND RELATED ART

The present invention relates to an ink jet recording method.

An ink jet recording method is known wherein ink ejected from a nozzle of recording head is deposited on a recording material. In such an ink jet recording method, various method is used to improve the printing quality. As one method, ink having an adjusted penetration property are used. For example, in order to improve print density of characters or line images or to form sharp images, the use is made with ink having a low penetration speed into the recording material or sheet, thus providing a large amount of ink on the surface of the recording material, and in another example, the use is made with ink having a high penetration speed to increase the fixing speed.

The ink exhibiting a low penetration speed is called "topping type ink" or "non-penetrative ink", since a large amount of the ink remains on the surface of the recording paper. The ink exhibiting a high penetration speed is called "ultra-penetrative ink".

When a droplet 51 of such an ultra-penetrative ink is dropped on the recording material, the amount of the ink remaining on the surface of the recording material 52 is small since it penetrates into the recording material immediately after contacted to the recording material 52. The penetration speed is high, and the ink may reach the neighborhood of the back side of the recording material 52, depending on the material of the sheet 52.

When the non-penetrative ink having less penetration property (topping type ink) is used, as shown in FIG. 46, (b), the component of the ink such as the solvent or the like tends to evaporate, and therefore, a relatively small part of the ink droplet 53 on the recording material 52 penetrates in the direction of the thickness of the recording material 52.

When the ultra-penetrative ink is used, the ink contacted to the surface of the recording paper quickly penetrates, with the result of less mixture with another ink, and therefore, less spread at the boundary portion with different color ink, However, the ink penetrates deep into the recording material, and is scattered in a long range, with the result that coloring matter component such as pigment or dye is dispersed, and that light incident on the recording material is reflected at a relatively deep position, and therefore, the density of the printed image seems low. In the plane of the recording material, the ink is scattered wide around the ink droplet 51 with the result of too large size of the recording dot and/or of spread in the form of whiskers around the dot((feathering) and therefore unsharp image.

When the on-penetrative ink is used, the amount of the ink remaining on the surface is relatively large, and therefore, the recording density is high, and when one dot is considered, the amount of the ink scattered in the recording material is very small as compared with the ultra-penetrative ink, so that sharp images can be formed. However, the penetration speed into the recording paper is low with the result that longer time is required to fix the ink, and therefore, whom another ink is deposited adjacent thereto, the inks flow to between them, with the result of spread occurring at the boundary portion therebetween and therefore of the deterioration of the image quality. When the surface of the recording sheet is rubbed with another recording paper or pen or the like, the ink fixed on the surface of the recording paper may be removed, or when the printed portion is overwritten by a line marker or the like, the ink is dissolved with the result of spread on the surface of the recording paper(poor wear resistance).

In view of such respective natures, it is usual to use black ink having a low penetration property and the other color inks having high penetration property. Since black color is frequently used when letter or line image which is desired to be looked sharp is printed, the non-penetrative ink is used for black color, since then a high density and a sharp edge is provided. In the case of chromatic printing wherein fine lines or dots are less frequently printed, and different color dots are printed adjacent to each other frequently, the ultra-penetrative ink is used for chromatic color since then the spread is less at the boundary between different colors.

Even if this is done, however, when the black dot 54 and the color dot 55 are adjacent to each other, the inks flow into between the dots with the result of deteriorated recording quality. The ink droplet of the black ink remaindering on the surface of the recording material discharges out into the color ink across the boundary portion 56, and correspondingly, the density of the boundary portion 56 of the black ink decreased, with the result that edge of the black ink dot becomes unsharp. In the color ink side, the black ink is mixed into the boundary portion 56 with the result of unsharp edge, too. When the different penetrative inks are adjacent to each other, the occurrence of the breeding at the 56 resulting in the poor recording quality has not been avoidable.

By leaving the-recording sheet for a long term after black ink ejection, the low penetrative ink can be fixed without breeding. This requires long time between the ejection of the black ink and the ejection of the color ink, and therefore, the throughput decreases. It is known that in order to raise the fixing speed, the recording material is heated by the heater. For example, a heater is provided at a position corresponding to a recording position of the recording head behind the recording surface of the recording material, by which the water content of the ink droplet deposited on the surface of the recording paper is evaporated, thus increasing the fixing speed. However, with such a method, water vapor is produced, and it may dew an the inside of the recording device and may adversely affect the recording material, a control circuit or a voltage source circuit of the recording device. It would be considered that water vapor is discharged to the outside of the apparatus by exhausting means, but then, the cost will rise, and the capacity of the voltage source of the apparatus has to be increased. When the recording material is heated by a heater at a high temperature, safety should be taken into consideration.

In order to ease the problem relating to the penetration property, use of recording material having been subjected to a special treatment would be considered. However, use of plain paper is desirable from the standpoint of cost or convenience of the user.

As described above, when the use is made with a so-called ultra-penetrative ink having a high penetration property, the spread at the boundary can be reduced, but the recording density decreases (unsharp image). When the use is made with so-called topping type ink having low penetration property, it is possible to record a sharp image with high recording density, but the time required for the fixing is long, and the problems of the bleeding and low wear resistance arise. When the topping type ink is used, and for the color image, ultra-penetrative ink is used, the bleeding occurs between the black ink dot and another color ink dot when they are adjacent.

SUMMARY OF THE INVENTION

Accordingly, it is a principal object of the present invention to provide an ink jet recording method by which improved fixing property, improved recording density, reduction of the spread at the boundary between the different color ink droplets, and the improved wear resistance of the image, are accomplished simultaneously.

According to an aspect of the present invention, there is provided an ink jet recording method using a recording device including a recording head provided with an ejection outlet for ejecting ink and heating means for heating at least a part of a recording material; comprising: a recording step of recording by ejecting ink to a predetermined region on a recording material, using a recording head; a heating step of heating said region by heating means; and wherein the ink has an ink absorption coefficient Ka ($ml.m^{-2}.msec^{-1/2}$) relative to a plain paper, defined by Bristow method, is 1.0–5.0, and satisfies $0<ts\leqq 200$ msec where ts is a rapid expansion start point. According to this aspect, the spread at the boundary can be suppressed.

According to another aspect of the present invention, there is provided an ink jet recording method using a recording device including a recording head provided with an ejection outlet for ejecting ink and heating means for heating at least a part of a recording material; comprising: a first recording step of recording by ejecting ink to a predetermined region on a recording material; a heating step of heating said region by heating means; and a second recording step of recording by ejecting ink to said region after said heating step.

According to this aspect, the fixing device which heats the recording material at a relatively low temperature, and the improved recording density, the reduction of the spread at the boundary between the different color ink droplets and the improved wear resistance, are accomplished.

According to a further aspect of the present invention, there is provided an ink jet recording method using a recording device including a recording head provided with an ejection outlet for ejecting ink and heating means for heating at least a part of a recording material; comprising: a recording step of recording by ejecting ink to a predetermined region on a recording material, using a recording head; a heating step of heating said region by heating means; and wherein the ink satisfies $0<ts\leqq 200$ msec where ts is a rapid expansion start point. According to this aspect, the penetration of the penetrative ink is confined at a position inside the recording paper and adjacent the recording surface, and the ink is fixed, by which the improved recording density, the reduction of the spread at the boundary of the ink droplet, are accomplished, and since the ink droplet is penetrated into the recording paper, the resultant image has high wear resistance.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings. First, the chain of technical thoughts and principles will be described in detail, itemizing the subjects.

(1) Penetrativeness Control by Heater

Figure 1:
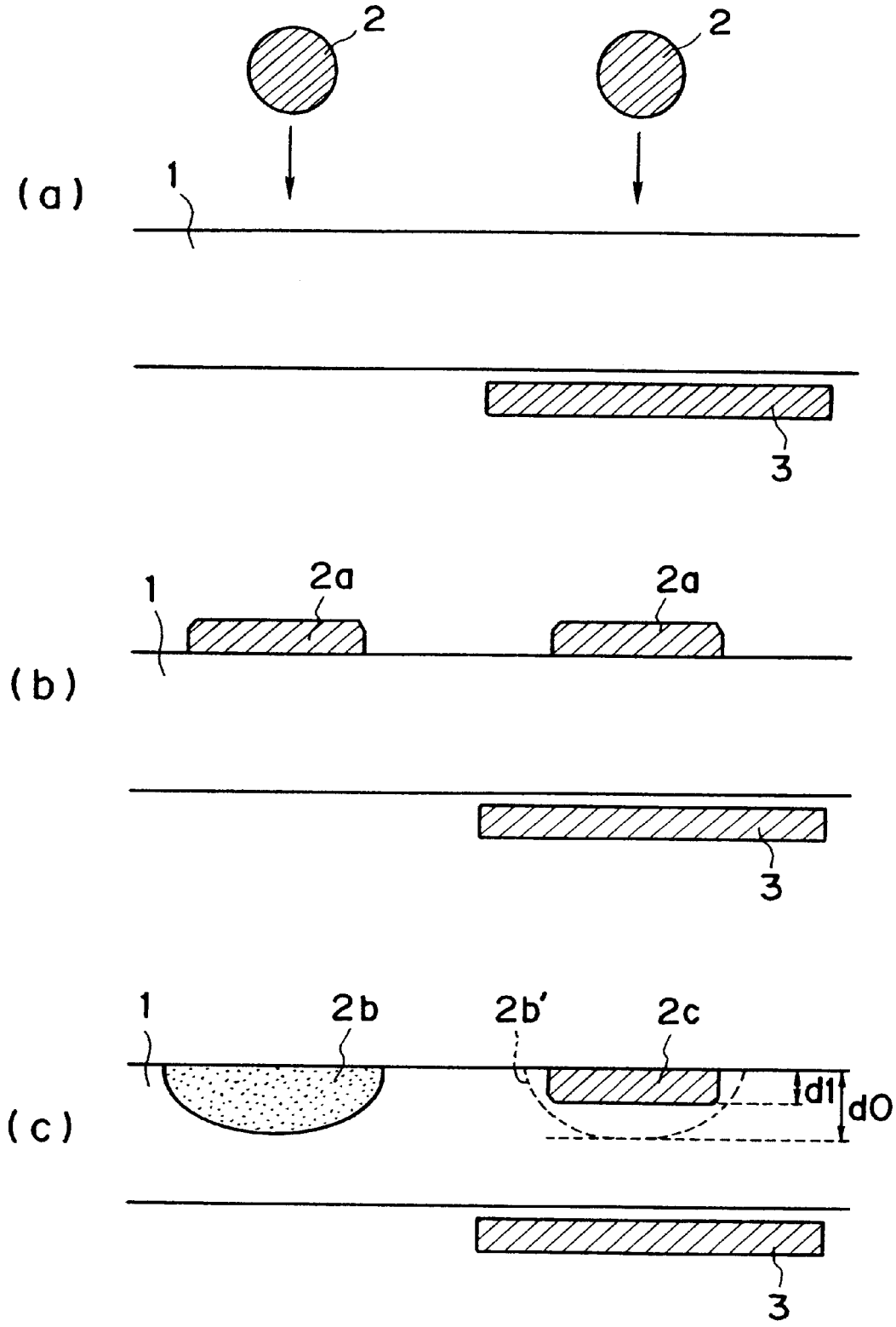
FIGS. 1A–C show deposition of ink on a recording sheet.

FIG. 1 is a drawing made for showing the difference in penetrativeness of an ink droplet caused by the presence or absence of a heater 3 at the time of dot formation, by the ejection of a droplet 2 of penetrative ink, an a sheet of recording paper 1 as the recording medium. In this case, the penetrativeness of the ink will be described with reference to ordinary paper which is widely used as recording medium.

FIG. 1, (a) shows a state in which the ink droplet 2 has been just ejected toward the recording sheet 1. In this drawing, the left and right ink droplets are the same in volume and penetrativeness. After being ejected toward the recording sheet 1, the ink droplet 2 collides with the surface of the recording sheet 1, and adheres to the recording sheet 1, spreading to a certain size. FIG. 1, (b) is a schematic drawing made to show the appearance of the ink droplet 2*a* which has just adhered to the surface of the recording sheet 1. The is droplet 2*a* having adhered to the surface of the recording sheet 1 immediately begins to penetrate into the recording sheet 1. FIG. 1, (c) is a drawing made to show a state in which the ink droplet 2 has penetrated into the recording sheet 1. In the drawing, a referential code 2*b* designates the ink droplet 2 which has penetrated into the recording sheet 1 without help from a heater 3, and a referential code 2*c* designates the ink droplet 2 which has penetrated into the recording sheet 1 when the heater 3 is in use. The dotted line 2*b*' which surrounds the ink droplet 2*c* indicates the boundary to which the ink droplet 2 could have penetrated if the ink droplet 2 were left unheated.

It should be noted here that FIG. 1 shows a case in which the ink droplet 2 is composed of a type of ink, the penetrativeness of which is high enough to prevent the ink from remaining above the surface of the recording sheet 1. Referring to FIG. 1, (c), when recordings were made without using the heater 3, the ink droplet 2*b* could have penetrated into the recording sheet 1 to a depth of $d_0$. However, the liquid components in the ink such as solvent were evaporated as the recording sheet 1 was heated by the heater 3, and as a result, the penetration of the ink droplet 2*c* in the thickness direction of the recording sheet 1 was restricted to a depth of $d_1$. As is evident from FIG. 1, (c), one of the reasons why the depth of the ink droplet penetration could be restricted by the heating by the heater 3 is that ink viscosity was increased as the liquid component of ink was evaporated by the heat. However, it is possible to think that there is an overriding reason, that is, the depth of the ink droplet penetration was restricted by the heating because the ink was caused to adhere to the portion closer to the surface portion of the recording sheet by the heating by the heater 3.

As will be evident from the above description, the penetration of the ink droplet was controlled by providing heat with the use of the heater 3; the penetration of the ink droplet in the thickness direction of the recording sheet 1 was stopped at the depth of $d_1$.

The present invention is characterized in that the quality of an image recorded with the use of semi-penetrative ink is improved by applying heat while a recording is made. The discussion given below, although it is still rough in composition, will give a detailed description of the mechanism of a phenomenon which occurs when semi-penetrative ink is used. The description will be made with reference to FIG. 50, which is a sectional view of a recording sheet in terms of the depth direction.

Figure 50:
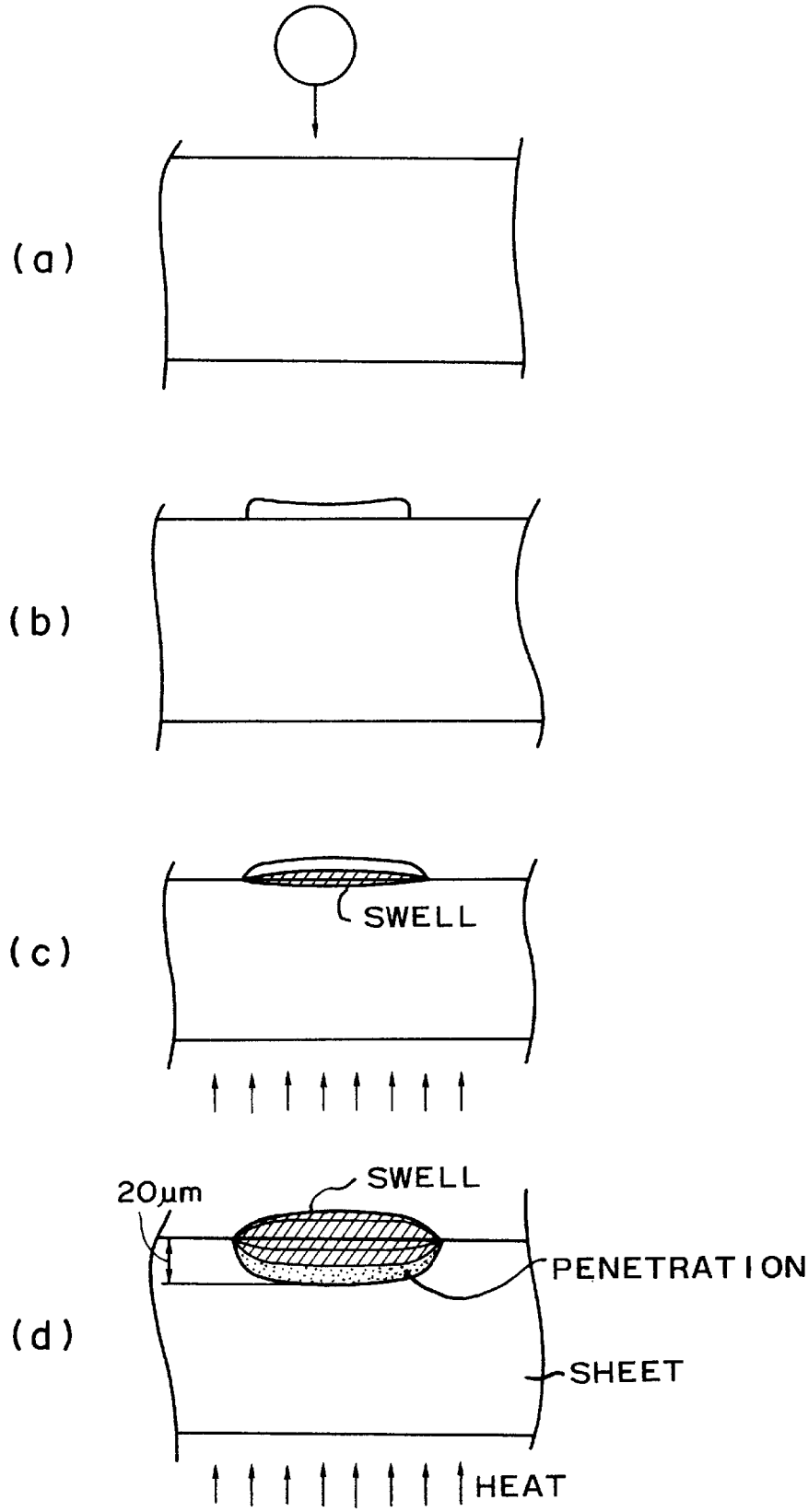
FIGS. 50A–D are illustrations of a developing mechanism when semi-penetrative ink is used.

FIG. 50, (a) depicts a state in which a spherical ink droplet is flying toward a sheet. FIG. 50, (b), depicts a state in which the spherical ink droplet has landed on the sheet, turning into a column of ink having a diameter twice the diameter of the spherical ink droplet, due to the impact of the collision. FIG. 50, (c), shows a state in which the ink is adhering to the fiber of the recording sheet, causing it to swell, at a relatively last speed, because the penetrativeness of the ink is relatively high at the surface portion of the recording sheet. In this state, the speed at which the ink adhere to the fiber of the recording sheet is increased by the heat applied from behind the recording sheet, and also, the speed at which the liquid components of the ink evaporate is increased by the heat. FIG. 50, (d), shows a state in which the ink has penetrated into the interior of the recording sheet. In this state, the liquid components of the ink have evaporated, and therefore, the penetration of the ink into the recording sheet, that is, the capillary action of the ink, caused by the interaction between the liquid components of the ink and the fiber in the recording sheet, is not likely to progress any farther; it becomes difficult for the ink to penetrate into the recording sheet in the thickness direction of the sheet. Further, as the penetration of the ink is suppressed, feathering, for which the capillary action of the ink caused by the interaction between the liquid components of the liquid and the recording sheet is responsible, is not likely to occur. Thus, as the ink droplet penetrates the recording sheet, the major portion of the coloring agent in the ink droplet is trapped in the portion of the recording sheet, close to the surface, that is, no deeper than 20 $\mu$m. Therefore, the OD (reflective optical density) value of the semi-penetrative ink becomes as high as that of the non-penetrative or topping type ink.

When a heater is used, it is desirable that conditions such as the temperature of the heater 3 or the heating time should be set so that a large amount of water vapor is not generated.

Next, the relationship among the ink composition, the ink penetrativeness, and the ink penetration speed will be described. The following table shows the composition of one of the inks used in this embodiment.

| | | |
|---|---|---|
| 1. | Y (yellow) | |
| | C.I. direct yellow 86 | 3 parts |
| | Glycerin | 5 parts |
| | Thio diglycol | 5 parts |
| | Urea | 5 parts |
| | Acetylenol EH (Kawakan Chemical) | 1 part |
| | Water | Remainder |
| 2. | M (magenta) | |
| | C.I. acid red 289 | 3 parts |
| | Glycerin | 5 parts |
| | Thio diglycol | 5 parts |
| | Urea | 5 parts |
| | Acetylenol EH (Kawaken Chemical) | 1 part |
| | Water | Remainder |
| 3. | C (cyan) | |
| | C.I. acid blue 199 | 3 parts |
| | Glycerin | 5 parts |
| | Thio diglycol | 5 parts |
| | Urea | 5 parts |
| | Acetylenol EH (Kawaken Chemical) | 1 part |
| | Water | Remainder |
| 4. | Bk (black) | |
| | C.I. direct black | 3 parts |
| | Glycerin | 5 parts |
| | Thio diglycol | 5 parts |
| | Urea | 5 parts |
| | Acetylenol EH (Kawaken Chemical) | (will be described hereinafter) |
| | Water | Remainder |

Regarding the ratio of Acetylenol in the inks listed above, in the case of the black ink, the ratio of Acetylenol was varied during the tests, whereas in the cages of other color inks C, M and Y, Acetylenol was added 1% to improve the penetrativeness.

As is evident from the above table, the inks in this embodiments are mixtures of dye or pigment, water, glycerin as solvent, thio diglycol, urea and Acetylenol as non-ionic surfactant (Acetylenol is a commercial name of a product of Kawaken Fine Chemical, which is a mixture of acetylglycol and ethylene oxide, that is, ethylene oxide-2, 4,7,9-tetramethyl-5-decyne-4,7-diol). Hereinafter, this non-ionic surfactant will be referred to as Acetylenol.

It is known that the penetrativeness of ink can be expressed as the volume of ink which penetrates into a test piece of material per unit of time; it can be expressed by the following formula, Bristow's formula, in which character t stands for the length of the elapsed time, and V stands for the volume (unit of measurement is $m1/m^2=\mu m$) of ink, respectively.

$$V=Vr+Ka(t-tw)^{1/2}-t>tw$$

Immediately after an ink droplet hits the surface of the recording sheet, the ink in the ink droplet mostly fills the indentations present at the surface of the recording sheet, and does not yet penetrate the recording sheet, except for by a very small amounts in other words, the ink simply wets the surface of the recording sheet. The length of this period, that is, the ties it takes for the ink droplet to wet the surface of the recording sheet is "tw" in the above formula, and the amount of the ink which fill the indentations of the recording sheet surface is "Vr" in the formula. If the elapsed time t after the collision of the ink droplet and the recording sheet surface exceeds tw, the penetrativeness V of ink increases in proportion to the difference between the elapsed time t and tw (t−tw) to the one-half power. A character Ka stands for the factor at proportionality.

Figure 3:
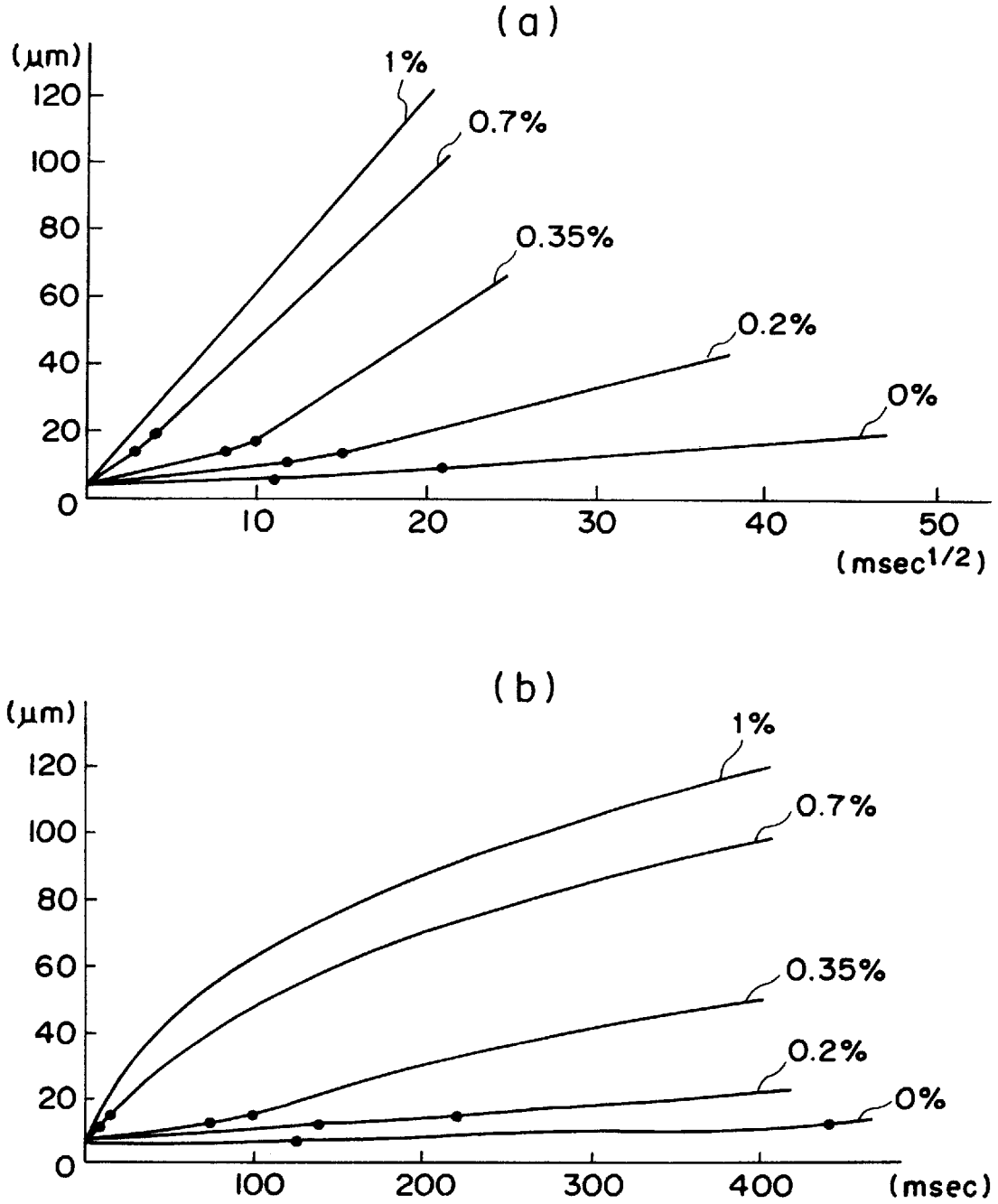
FIGS. 3(*a*)–3(*b*) are illustrations of penetration speed of ink.

FIG. 3, (a) shows the relationship between the elapsed time t (msec) to the one-half power and the amount V of ink penetration, when the ratio of the Acetylenol content was 0%, 0.2%, 0.35%. 0.7% and 1%. FIG. 3, (b) shows the relationship between the elapsed time t and the amount V of ink penetration. As is evident from FIGS. 3, (a) and (b), the greater the ratio of the Acetylenol content, the greater the amount of the ink penetration relative to the elapsed time, that is, the higher the penetrativeness of the ink. In the test which gave the results shown in FIG. 4, recording sheets having a weight of 64 $g/m^2$, a thickness of approximately 80 $\mu m$, and a void ratio of approximately 50% were used. As for the wetting time, the greater the ratio of the Acetylenol content, the shorter the wetting time, that is, the higher the penetrativeness of ink, as shown in FIG. 3 in which the wetting time is represented by the distance from the zero point to the point directly below the black circle, on the left, at which the inclination of the line changes. In the case of the ink which does not contain Acetylenol (ratio of Acetylenol content is 0%, the penetrativeness of ink is low; in other words, the ink displays properties similar to those of the aforementioned non-penetrative ink. In the case of the ink which contains Acetylenol by 1%, the ink penetrates into the recording sheet 1 in a short time; in other words, the ink displays properties similar to those of the aforementioned ultra-penetrative ink.

Figure 48:
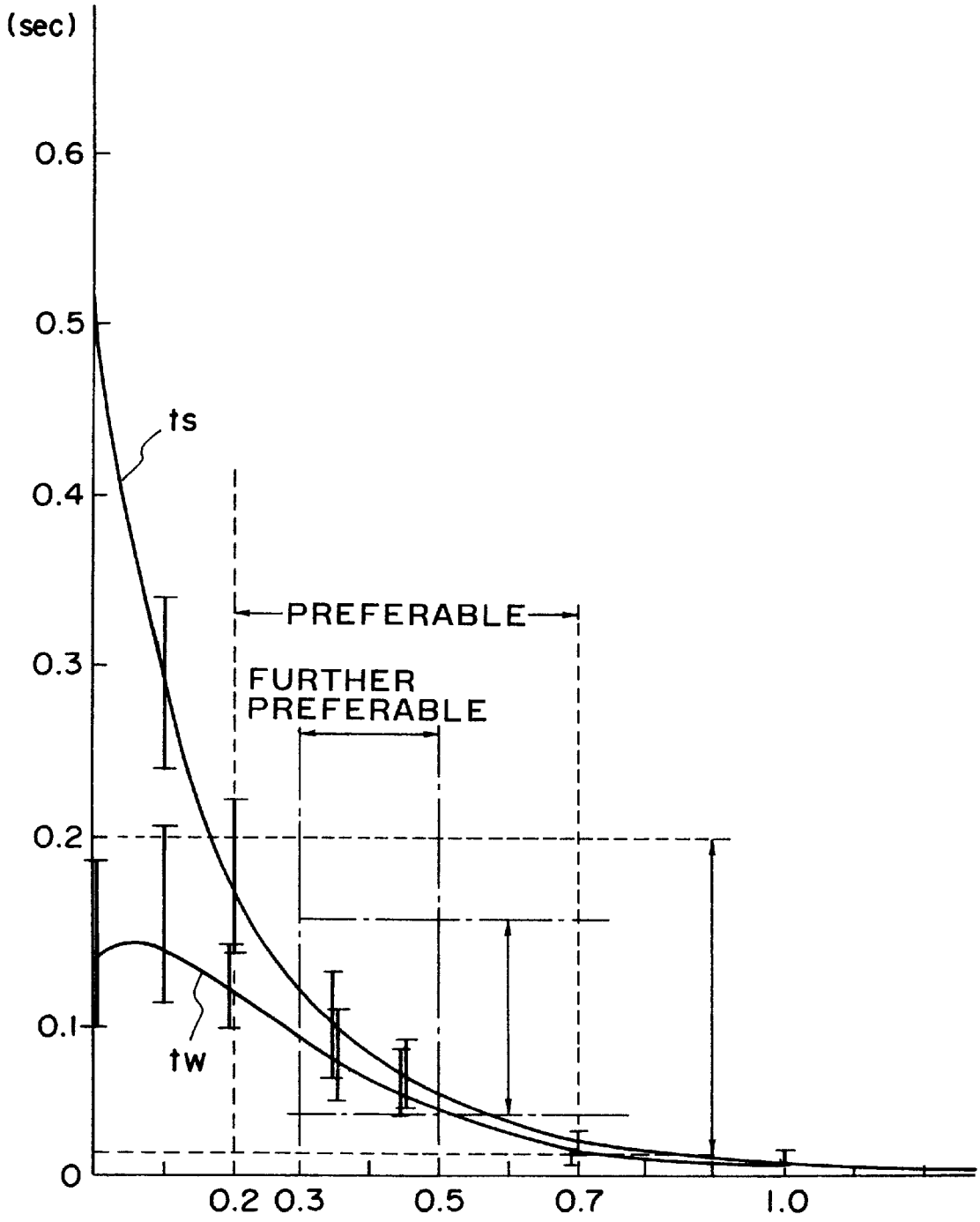
FIG. 48 shows a content of acetylenol in ink vs. tw and O ts.

Next, the above discussed subjects will be described in more detail with reference to FIGS. 3 and 48.

First, the case in which no heat is applied will be described. As an ink droplet lands, the ink adheres to the fiber of the recording sheet in an extremely short period after the landing. Then, the ink begins to penetrate into the recording sheet, that is, the capillary action begins. An ordinary recording sheet used with business machines such as copying machines contains sizing agent for preventing feathering, and therefore, the penetration of the ink does not begin for a substantial length of time; in other words, there exists a substantial length of wetting time tw, which is the length of elapsed time correspondent to the point on the horizontal axis, correspondent to the black circle on the right side on the same line. Further, even after the ink penetration begins, the speed at which the recording sheet is wetted does not drastically increase because of the presence of the aforementioned sizing agent. The so-called topping type or non-penetrative ink penetrates relatively slowly to a certain point in time, and at this point in time, it suddenly begins to quickly adhere to the fiber itself of the recording sheet. The time it takes for the non-penetrative ink to begin to quickly adhere to the fiber of the recording sheet is approximately 400–500 msec, and this length of time is referred to as ts (swelling time). In FIG. 3, the black circle on the right side an the same line corresponds to the elapsed time ts. If surfactant such as Acetylenol is added to the ingredients of an ink, the adhesion of the ink to the recording sheet improves, and as a result, the wetting time of the ink is reduced, which in turn reduces the time necessary for the ink to adhere to the fiber of the recording sheet. Then, the speed at which the ink penetrates increases, and as the ink penetrates into the recording sheet, it quickly adheres to the fiber of the recording sheet. Further, as the ratio of the Acetylenol content in an ink increases, tw and ts become shorter. When the ratio of the Acetylenol is 1%, tw and ts are approximately zero. Where the ratio of Acetylenol is in a range above 0.2–0.3%, the values of tw and ts become closer to each other as the ratio of the Acetylenol increases. FIG. 48 graphically shows the above discussed relationship is among the ratio of acetylenol, tw and ts. The aforementioned factor Ka of proportionality applies only to the penetrativeness of ink after ts, or the end of swelling. In the case of a semi-penetrative ink, the difference between tw and ts of which is small, the penetrating speed of the ink is faster than that of a non-penetrative ink, and yet, it remains relatively slow up to the point ts in time. Therefore, if heat is applied to the ink and a recording sheet during this period in which the ink relatively slowly penetrates into the recording sheet, the length of time necessary for the ink to adhere to the fiber of the recording sheet is reduced, and as a result, the penetrating speed, or the capillary action, of the ink is reduced. If the overall amount of the ink has been reduced in the above situation, the penetration of ink is further suppressed, assuring that the coloring agents which enter the recording sheet remain adjacent to the surface of the recording sheet. The amount at the heat to be applied to the ink and a recording sheet has only to be enough to evaporate the major portion of the liquid contents of the ink during the swelling period, to such a level that makes it difficult for the ink to penetrate into the recording sheet.

Figure 2:
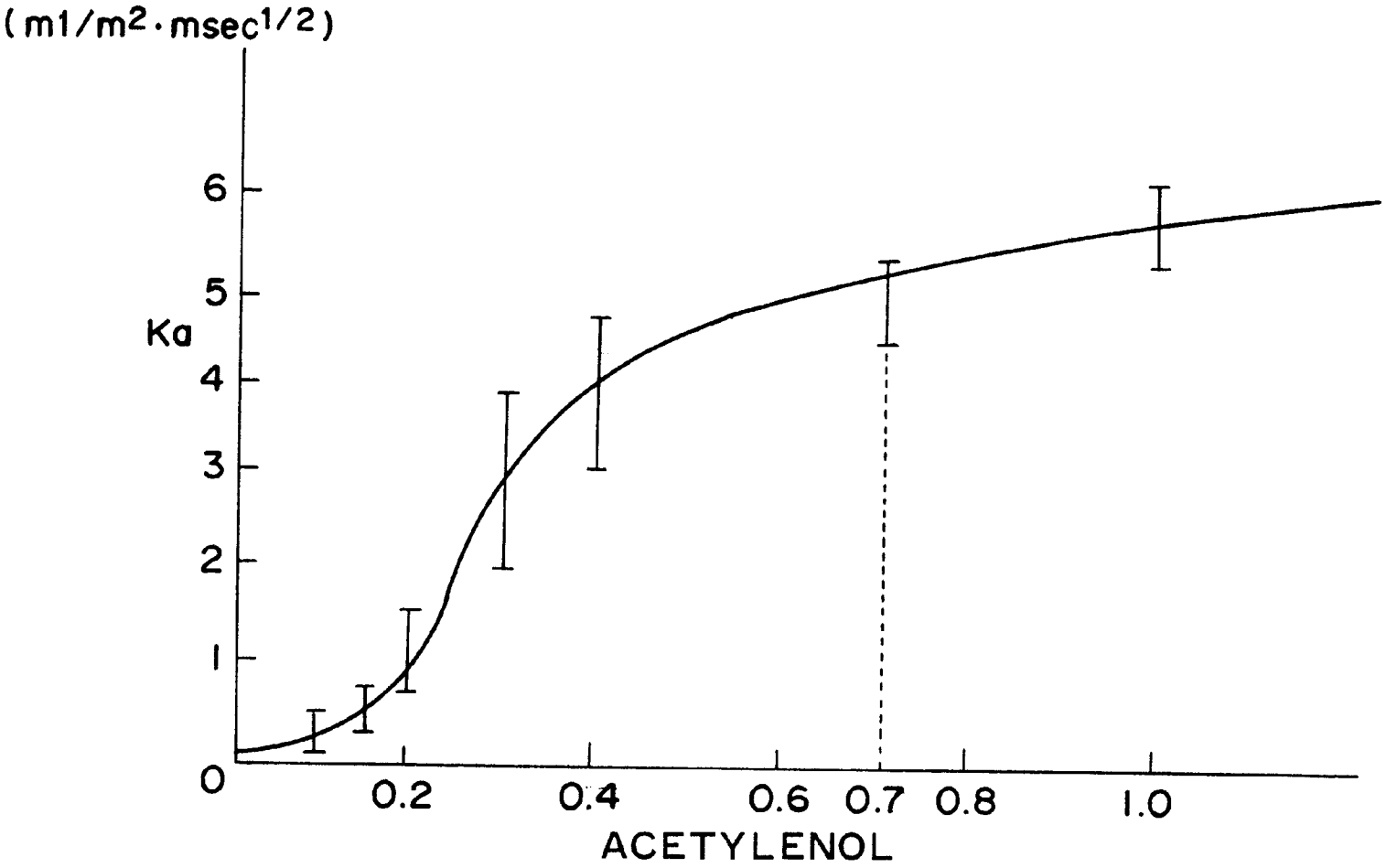
FIG. 2 shows a content of acetylenol in ink vs. Coefficient Ka in the present invention.

FIG. 2 is a graph of the factor of proportionality Ka for the penetrating speed of ink, relative to the ratio of the Acetylenol content in the ink. The value of Ka was measured using the Bristow method and a dynamic penetrativeness test apparatus S (product by Toyo Seiki, Co.). The recording sheets used in this test were PB sheets by Canon, which are such recording sheets that are compatible with both copying machines or laser beam printers based on an electrophotographic principle, and printers based on an ink jet recording principle. Further, substantially the same results were obtained when a test was carried out using PPC sheets by Canon, which were recording sheets dedicated for electrophotographic recording.

As is evident from FIG. 2, the factor of proportionality Ka varies depending on the ratio of the Acetylenol content, and therefore, the speed at which ink penetrates is practically determined by the ratio of the Acetylenol content in the ink.

Figure 4:
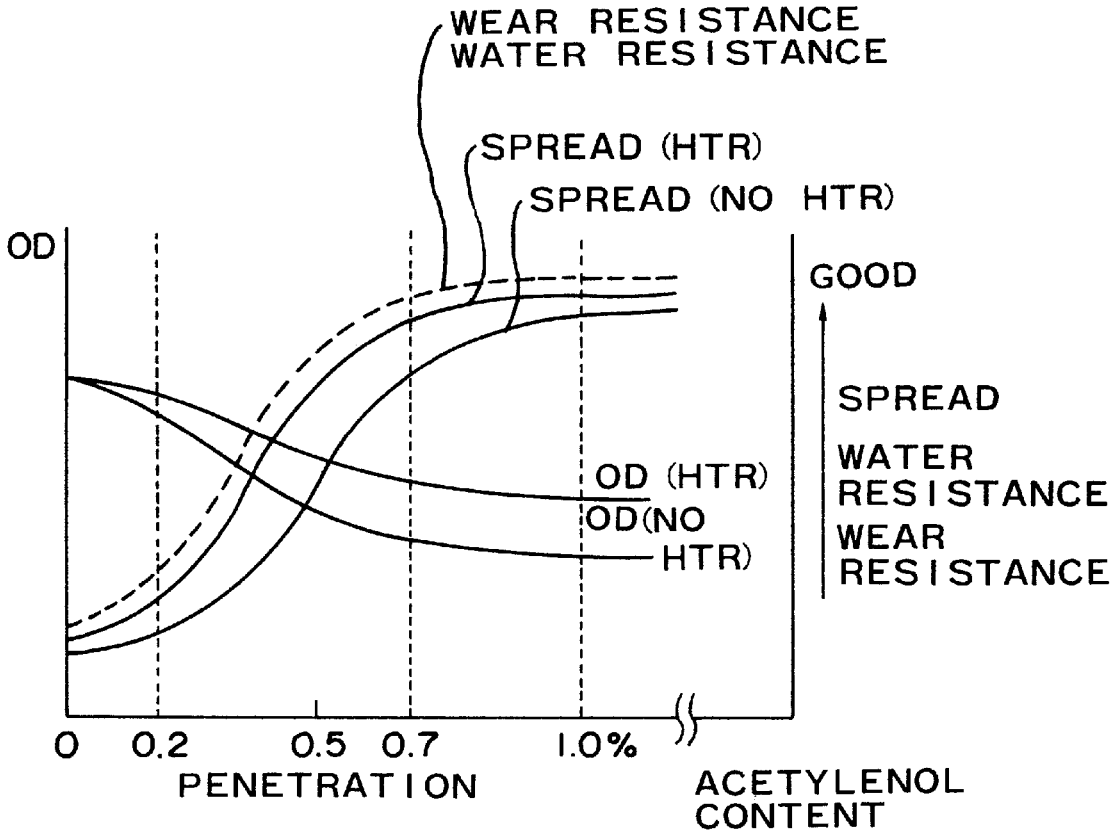
FIG. 4 shows a penetration property(content of acetylenol) of ink vs. various printing properties.

FIG. 4 shows the results of the single pass printing, comparing the results when there was a heater which heated recording sheet in the manner depicted in FIG. 1, and when there was no heater. The penetrativeness of ink was adjusted by adjusting the ratio of the Acetylenol content in the ink.

In FIG. 4, the vertical axis represents image density (OD), desirability in terms of spreading at the borderline between the areas of different color, scratch resistance, or instant water resistance of pigment ink, and the horizontal axis represents the ratio of the Acetylenol content. The "spreading at the borderline between the areas of different color" means the state of such spreading that occurs when dots of different color are recorded right next to each other. For example, the spreading at the borderline between a solid black area and an area of a color other than black is evaluated with the naked eye; the smaller the amount of spreading, the better the evaluation. "Scratch resistance" means how well a printed image remains undisturbed when the printed image comes in contact with, or is scratched by, the other recording sheets or the like, and the "instant water resistance" means the water resistance immediately after recording.

As is evident from FIG. 4, regardless of the presence or absence of a heater, the higher the penetrativeness of ink, the lower the image density (OD), and the better the desirability of an image in terms of spreading, scratch resistance, and instant water resistance. This is the manifestation of the aforementioned difference in one of the properties of ink, that is, the difference in the penetrativeness of ink. Noting the difference in the quality of the recorded image between when there was a heater and when not, it is clear that the desirability of the recorded image in terms of the image density, and the spreading at the borderline between the areas of different color, are both improved by a heater. In particular, studying the image density reveals that as the ratio of the Acetylenol content increases, the difference in image density created by the presence and absence of a heater also increased. Further, the desirability of the spreading at the borderline between the areas of different color was also greatly affected, in particular, when the ratio of the Acetylenol content was approximately 0.4%, by whether or not a heater was in use.

The above effects occur for the following reason. That is, when ink with relatively high penetrativeness is used, the ink begins to penetrate the recording sheet as soon as it adheres to the recording sheet, but the penetration of the ink within the recording sheet is suppressed by the heat applied by a heater. As a result, the ink is fixed adjacent to the surface of the recording sheet, as soon as the ink penetrates into the recording sheet.

Therefore, this embodiment provides a higher speed in terms of penetrativeness. The embodiment also provides higher image density because the ink is fixed, in the portion of the recording sheet adjacent to the surface of the recording sheet. Further, the ink penetrates into the recording sheet, and therefore, the amount of the ink which remains on the surface of the recording sheet, and forms microscopic bulges on the surface, is extremely small, which improves the scratch resistance, and the instant water resistance. Therefore, even if a marker pen or the like is used to write across the recording image, it is unlikely that the ink will bleed and deteriorate the recorded image.

It is also evident from FIG. 4 that when an image is formed by a single pass recording method, an image which is desirable in terms of both image density and borderline spreading can be formed by adjusting the ratio of the Acetylenol content to approximately 0.2%–0%, preferably, approximately 0.35%–0.50%. Regarding the desirable range for the ratio of the Acetylenol content given above, if emphasis is to be placed on increasing the image density, a desirable image can be recorded by using such an ink, in which the ratio of the Acetylenol is relatively small, whereas when emphasis is to be placed upon improvement in the desirability of the borderline spreading, a desirable image can be recorded by using such an ink, in which the ratio of the Acetylenol content is relatively high. For example, in order for black ink, which is used to record black images which require higher image density, to be effective to form a desirable image, the ratio of the Acetylenol content should be on the relatively low side of the desirable Acetylenol range given above, whereas in order for color inks, which are more likely to be used in combination than black color ink, to be effective to form desirable images, the ratio of the Acetylenol content should be on the relatively high side of the desirable Acetylenol range given above.

The table given below shows the inks used in this embodiment, along with the ink properties pertinent to this embodiment, and the criteria, that is, the penetrativeness of the ink relative to the recording medium.

TABLE 1

| | Ka value ($ml/m^2 \cdot msec^{1/2}$) | Acetylenol content (%) | Surface tension (dyn/cm) |
|---|---|---|---|
| Topping type (non-penetrative) ink | –1.0 | 0.0–0.2 | 40– |
| Semi-penetrative ink | 1.0–5.0 | 0.2–0.7 | 35–40 |
| High-penetrative ink | 5.0– | 0.7– | –35 |

The table gives the Ka value, the Acetylenol content (%), and the surface tension (dyn/cm) for "non-penetrative ink", "Semi-penetrative ink", and "high penetrative ink".

The ink defined in this table as "semi-penetrative ink" is such an ink that contains Acetylenol by a ratio in the aforementioned range (0.2 wt. %–0.7 wt. %) for obtaining desirable results with the use of a heater.

It is known that when surfactant is mixed into liquid, the critical micelle concentration (c.m.c.) of the surfactant is one of the essential factors. Since the Acetylenol contained in the inks listed above is also a type of surfactant, it also has the critical micelle concentration (c.m.c.) which varies depending upon the liquid into which it is mixed.

Figure 47:
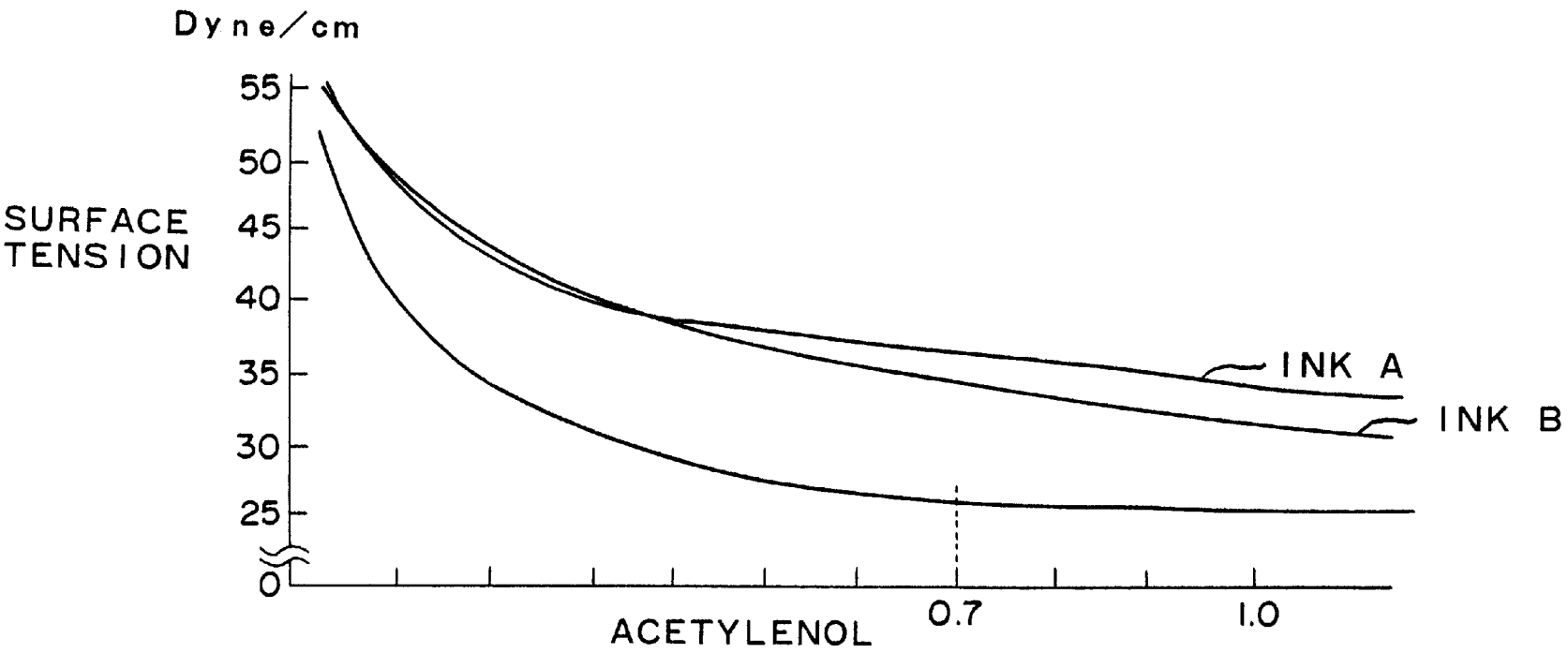
FIG. 47 shows a content of acetylenol in ink and surface tension.

FIG. 47 is a graph which shows the values of the surface tension of the inks, which were obtained by adjusting the ratio of the Acetylenol content relative to water content. It is evident from this graph that the critical micelle concentration (c.m.c.) of the Acetylenol relative to water is approximately 0.7%. Combining this fact with the table given above reveals that the "semi-penetrative ink" described in this embodiment of the present invention is such ink that contains Acetylenol by a ratio lower than the critical micelle concentration (c.m.c.) of Acetylenol relative to water.

The gist of the present invention is in the following. That is, in recording images, the semi-penetrative ink listed in the above list is used, and heat is applied to the ink and recording medium during recording, by an amount which can control the penetration of the ink into the recording medium in such a manner that the ink remains close to the surface of the recording medium after it penetrates the surface of the recording medium. As a result, not only is image density increased, but also, the desirability of the ink spreading at the borderline between the areas of different color is improved. Further, according to the present invention, when a recording is made by overlaying, with a predetermined interval in time, an image formed by one kind of ink, upon another image formed by another kind of ink, a larger number of ink droplets can be fixed to the recording medium, close to the surface of the recording medium, by using the semi-penetrative ink, and the recording process is controlled by applying heat with the use of a heater. Further, regarding the ink spreading which occurs at the borderline between the areas of different color, and causes problems when a recording is made by ejecting a large number of ink droplets, desirable results can be obtained Next, the effects of the heat applied by a heater to control the recording process will be described with reference to each of the various recording systems.

(2) Ink Penetration Control Most Suitable for Specific Recording System

In the preceding description of the embodiment of the present invention, the arrangement for controlling the penetration of ink into a recording sheet by heating the recording sheet with the use of a heater to improve the recording density and the desirability of the ink spreading at the borderline between the image areas of different color was discussed. In this section, the effects of the present invention will be described regarding the cases in which a plurality of ink droplets are ejected to record images while both the ink and the recording medium are heated by a heater. The effects will be described with reference to various recording methods.

(Split Ejection Printing System)

This is a recording system which adheres a predetermined amount of ink to a recording medium by ejecting a small amount of ink a plural number of times.

Figure 5:
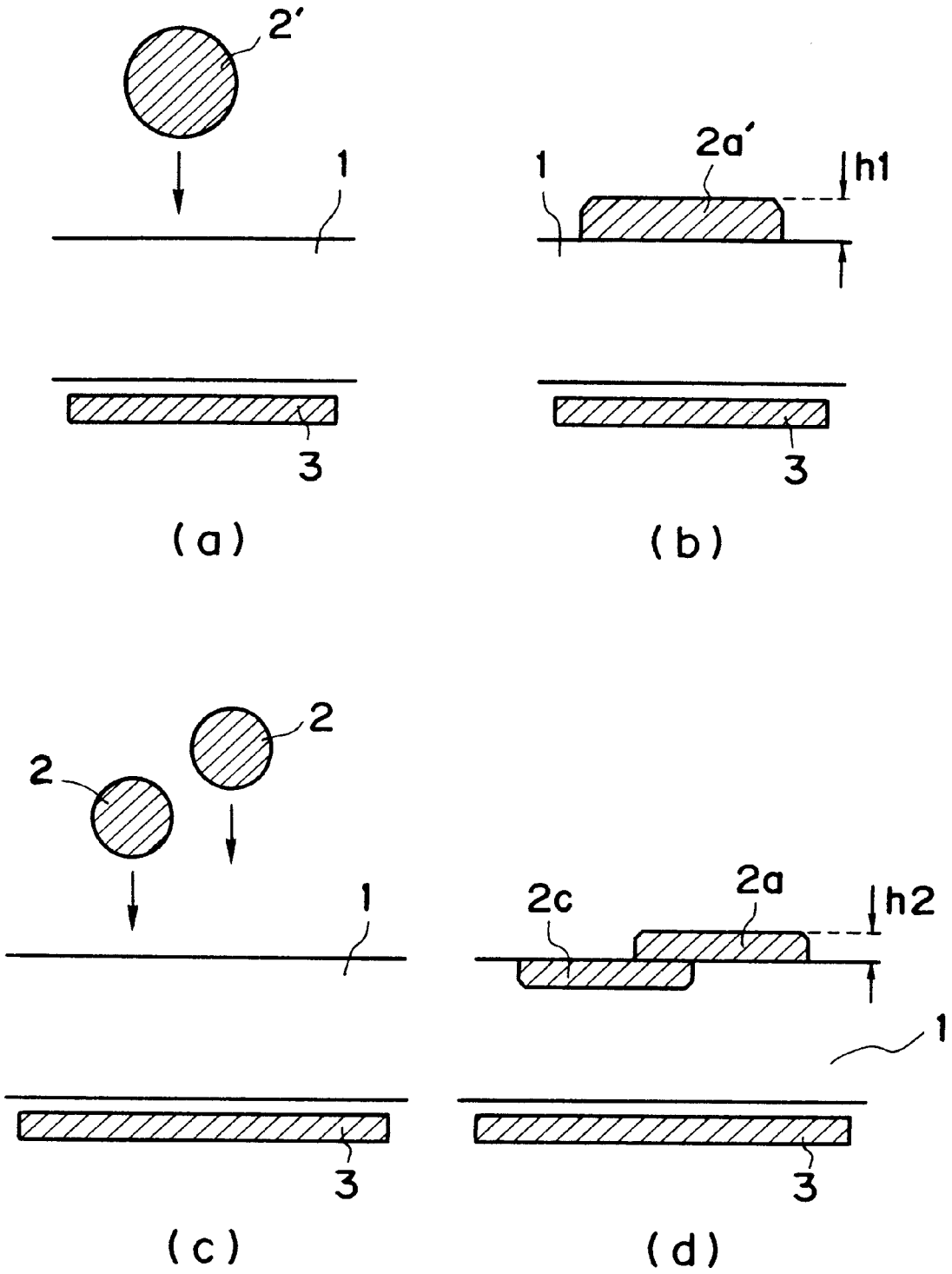
FIGS. 5A–D illustrations of ink droplet formation state in a divided printing type of an ink jet recording method.

FIG. 5, (a) and (b) schematically illustrate a state in which a single ink droplet with an approximate volume of 40 pl has been ejected and is flying toward a recording sheet 1, and a state in which the ink droplet has landed on the surface of the recording sheet 1 and has adhered to the surface, respectively. FIG. 5, (c) and (d) schematically illustrated a state in which two ink droplets with an approximate volume of 20 pl are ejected in succession, and are flying toward the recording sheet 1, and a state in which they have landed on the surface of the recording sheet 1, and have adhered to the surface. FIG. 5, (c) shows that the two ink droplets have been ejected in succession with a relatively short interval in time. For example, in this embodiment, the two ink droplets are ejected in succession with an approximate interval of 50 msec. The ink used in this embodiment is such an ink, in which the ratio of the Acetylenol content has been adjusted to approximately 0.2%–0.7%, preferably, approximately 0.35%–0.5%. Whether the ink is ejected in a single droplet or two smaller droplets, the penetration of the ink into the recording sheet 1 in the thickness direction of the recording sheet is controlled by heating the recording sheet 1 while the ink is ejected.

Referring to FIG. 5, (d), even when the interval between the times at which the two ink droplets are ejected is very short, the ink droplet which first lands on the surface of the recording sheet begins to penetrate into the recording sheet as shown by the ink droplet 2*c* in the drawing. As becomes evident from the comparison between FIG. 5, (b) and (d), the height of the column of the ink which has collided with the surface of the recording sheet and has adhered to the surface becomes different (h1, h2) depending on whether the ink is ejected in the single droplet with the approximate volume of 40 pl, or in the two droplets with the approximate volume of 20 pl. The higher the column of the ink immediately after the ink adheres to the surface of the recording sheet, the deeper the ink penetrates into the recording sheet. In order to improve the density of a recorded image, it is desirable to reduce the depth to which the ink penetrates into the recording sheet. It is evident from the comparison between the FIG. 5, (b) and (d) that when images are formed of a redetermined amount of ink, the penetration depth of ink into the recording sheet can be reduced by ejecting the ink in a plurality of ink droplets.

Next, the reason why there is the aforementioned relationship between the amount of the ink ejected per ejection, and the height of the column of the ink immediately after the adhesion of the ink to the surface of the recording sheet will be described in detail.

Figure 6:
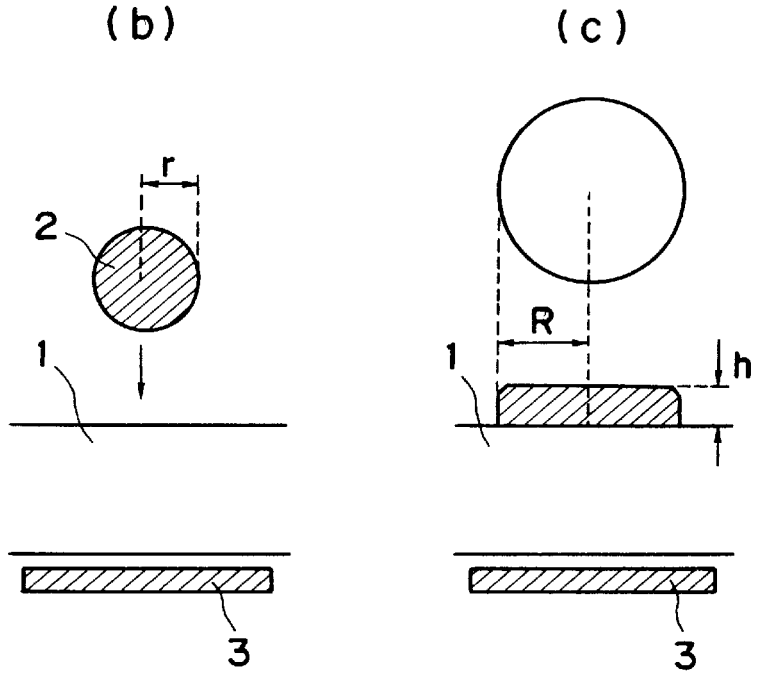
FIGS. 6A–C show an ink droplet configuration in the divided printing type.

FIG. 6, (a) is a table for demonstrating the relationship between the amount Vd (pl) of the elected ink, and the height of an ink droplet immediately after the collision of the ink droplet with the surface of the recording sheet, or the adhesion of the ink droplet to the surface of the recording sheet. FIG. 6, (b) and (c) are illustrations for giving the definitions of the factors listed in the table. FIG. 6, (b) shows a state in which an ink droplet 2 with a volume of Vd has been ejected and is traveling toward the recording sheet 1, and in which a character r stands for the radius of the substantially spherical ink droplet ($Vd=4\pi r^3/3$). FIG. 6, (c) shows a state in which the ink droplet has just adhered to the surface of the recording sheet, and in which a character R represents the radius of the ink droplet immediately after the adhesion of the ink to the surface of the recording sheet. The units of measurement for r and R are "$\mu$m" and R is assumed to be substantially twice r (R=2r) as it is in the case of a conventional ink jet recording system. A character S stands for the area size of the horizontal cross section of the ink droplet, the shape of which has just become columnar as it has collided with the recording sheet, and has adhered to the surface of the recording sheet ($S=\pi R^2$). A character h stands for the height of the column of the ink droplet (h=Vd/S).

In FIG. 6, (a), a referential code AF stands for the ratio of the area which a single ink droplet covers on the recording sheet, relative to the size of a single dot when a recording In made at a resolution of 360 dpi (dots per inches). When a recording is made at a resolution of 360 dpi, the length of the edge of each picture element is approximately 70.5 $\mu$m, and therefore, the size of the area of each picture element is approximately 4970.25 $\mu m^2$. Thus, AF=S×100/4970.25.

According to FIG. 6, (a), when 40 pl of ink is ejected in a single droplet, the height of the ink droplet immediately after its adhesion to the surface of the recording sheet is approximately 7.1 $\mu$m, whereas when 40 pl of ink is ejected in two droplets, the height of the ink droplet immediately after their adhesion to the surface of the recording sheet is 5.6 $\mu$m. The penetration of ink into the recording sheet is affected by the height of the ink droplet immediately after its adhesion to the surface of the recording sheet, and this height of ink substantially equals the depth to which the ink penetrates into the recording sheet. Therefore, the depth of ink penetration is lesser when 40 pl of ink is ejected in two droplets with a volume of 20 pl than when 40 pl of ink is ejected in a single droplet. The closer to the surface the fixation of ink, the higher the recording density, as described previously. Thus, in recording images with a predetermined amount of ink, a split ejection method, that is, a method in which ink is ejected, for example, in two droplets with a volume of 20 pl can make recording density higher than ejecting ink in a single droplet with a volume of 40 pl.

In other words, when a predetermined amount of ink is used to form an image by ejecting the ink while heating a recording sheet with the use of a heater, recording density can be increased by splitting a single ejection with a predetermined amount of ink, into a plurality of elections with a smaller amount of ink.

(Overlay Printing System)

Figure 7:
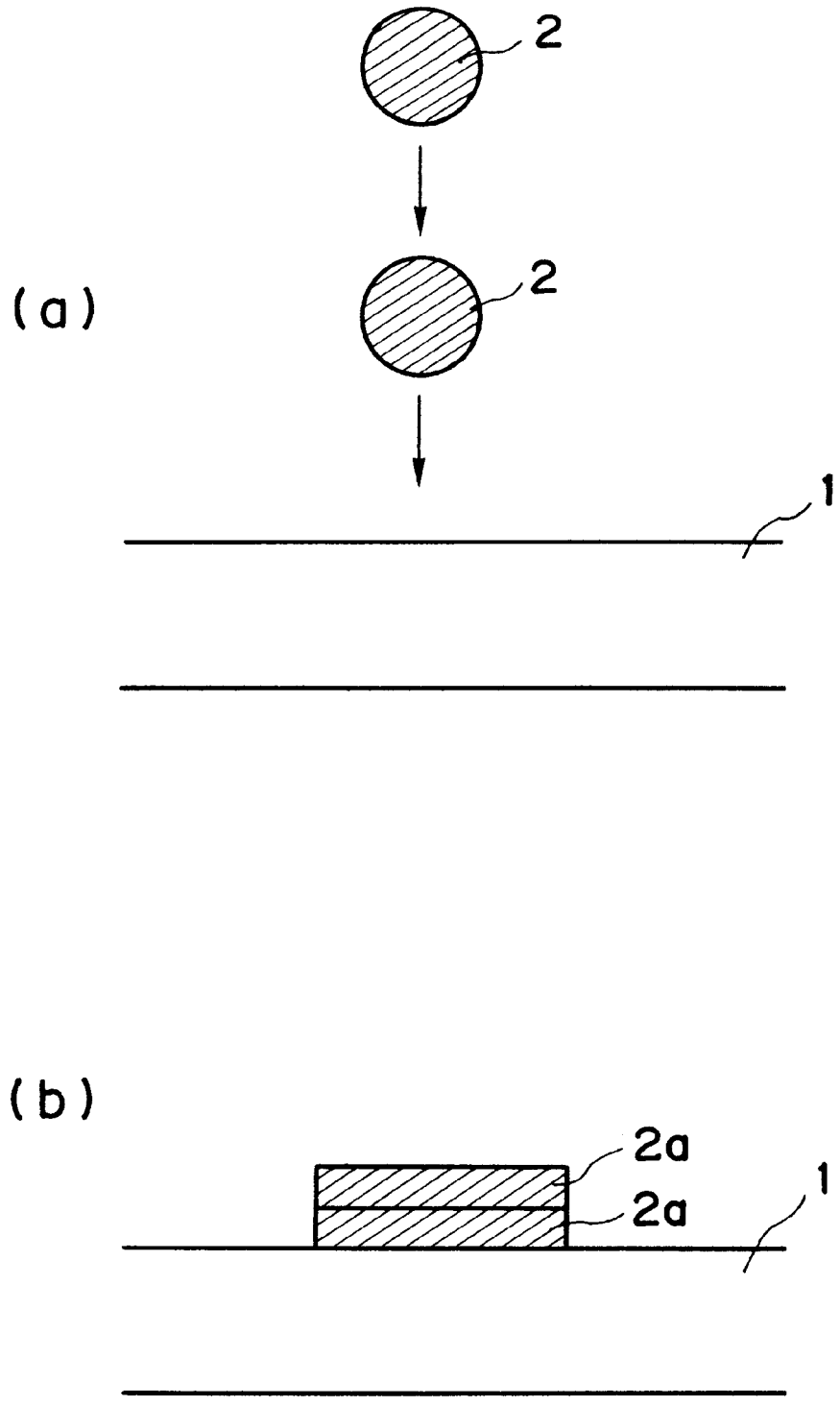
FIGS. 7A and 7B illustrations of an ink droplet formation state in an overlaying printing type of an ink jet recording method.

The above described effects of the split ejection printing system are obtained when images are recorded by ejecting a plurality of ink droplets onto the same spot, and these effects will be described with reference to FIGS. 7 and 8. FIG. 7 depicts a case in which a plurality of ink droplets are ejected in succession virtually without intervals in time. FIG. 7, (a) illustrates a state In which two ink droplets have been ejected, and are traveling toward a recording sheet, and FIG. 7, (b) schematically illustrates a state in which the two ink droplets have adhered to the surface of the recording sheet 1.

When two ink droplets are ejected in succession with an extremely short interval in time (for example, 10 msec, the ink droplet ejected second reaches the surface of the recording sheet 1 before the ink droplet ejected first begins to penetrate into the recording sheet 1. Immediately after the two ink droplets have landed on the surface of the recording sheet 1, they adhere in layer to the surface of the recording sheet 1 as shown in FIG. 7, (b). Thus, the combined height of the two ink droplets immediately after they adhere to the surface of the recording sheet becomes relatively high, and as a result, the depth to which the ink penetrates into the recording sheet becomes greater.

Figure 8:
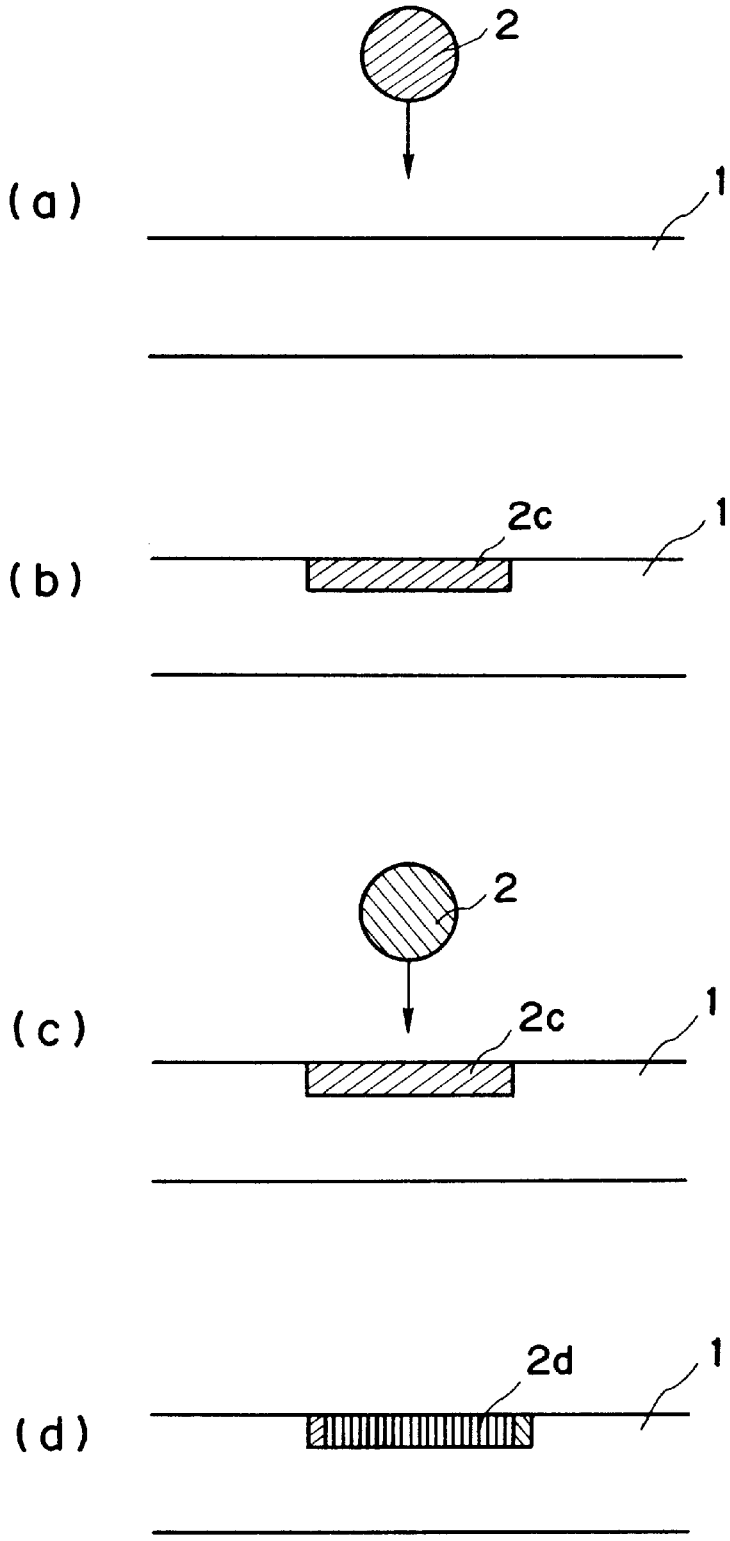
FIGS. 8(*a*)–8(*d*) are illustrations of an ink droplet formation state in a preferable overlaying printing type of an ink jet recording method.

On the other hand, FIG. 8 depicts a case in which two ink droplets are ejected onto the same spot with the provision of a sufficient interval in time (for example, approximately one second). FIG. 8, (a) illustrates a state in which the first ink droplet has been ejected, and is flying toward a recording sheet 1. The ink droplet ejected first penetrates into the recording sheet 1, as shown in FIG. 8, (b) before the second ink droplet is ejected. Then, the second ink droplet is ejected as shown in FIG. 8. (c), that is, as the first ink droplet is in the state illustrated in FIG. 8, (b). In this case, the ink does not penetrates any deeper into the recording sheet 1, as shown in FIG. 8, (d), than the depth to which the ink in the first ink droplet reaches. In other words, the penetration of the ink from the two ink droplets into the recording sheet 1 can be restricted to the portion close to the surface of the recording sheet.

As is evident from the above description, when an image is recorded by ejecting a plurality of ink droplets onto the same spot, the penetration of ink into the recording sheet can be restricted to the portion close to the surface of the recording sheet by providing a sufficient interval in time between the successive two ejections.

The above described effects obtained by ejecting a plurality of ink droplets onto the same spot with a sufficient interval in time between successive ejections can be obtained without the provision of a heater. However, when the penetration of ink into the recording sheet in the thickness direction of the recording sheet is controlled by the provision of a heater, recording density can be increased even if highly penetrative ink is used. Thus, when the penetration of ink into the recording sheet in controlled by the provision of a heater, the speed at which an ink droplet penetrates into the recording sheet can be increased, and therefore, even if the interval in time between successive ink ejections is shortened, satisfactory recording density can be obtained.

(Simultaneous Split Ejection Recording System)

This is a recording system which ejects a plurality of smaller ink droplets, the total volume of which equals the volume of a single large ink drop, and the area factor of which exceeds 100%. This enhances the effects of the aforementioned split ejection recording system.

In the case of the split ejection printing system described before, a certain interval in time is provided between the successive ink ejections to obtain the desirable effect, or desirable recording density, with the use of a heater, whereas in this simultaneous split ejection recording system, a recording is made by ejecting a plurality of small ink droplets substantially at the same time while applying heat to the recording sheet with the use of a heater to obtain the same effect: desirable recording density.

Figure 9:
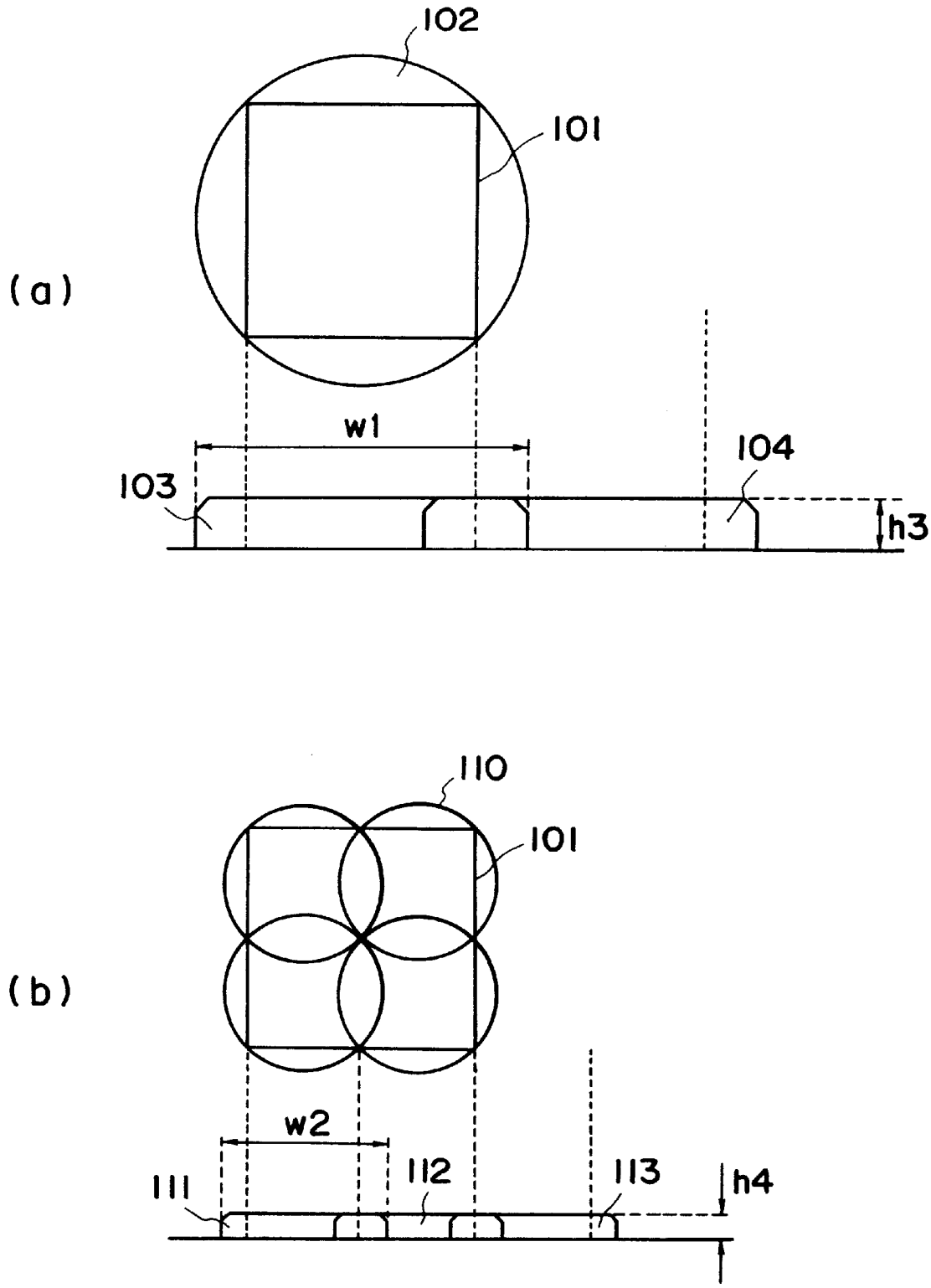
FIGS. 9(*a*)–9(*b*) are illustrations of an ink droplet formation state of a small droplet printing type of ink jet recording method.

FIG. 9, (a) is a schematic drawing which depicts a case in which 100 pl of ink is ejected in a single droplet. A referential Figure 101 designates one of the squares of a picture element grid. In this case, the area factor of the single ink droplet With a volume of 100 pl is greater than 100%. A referential Figure 102 designates the dot formed by the ink droplet. Referential Figures 103 and 104 designate the states of two ink droplets with the same volume of 100 pl immediately after they have adhered to the surface of a recording sheet, as seen from the direction perpendicular to the vertical section of the recording sheet.

FIG. 9, (b) is a schematic drawing which depicts a case in which 100 pl of ink is ejected in four ink droplets of a volume of 25 pl. A referential Figure 101 designates a square with the same size as the square in FIG. 9, (a), and a referential Figure 110 designates the dot formed by the single ink droplet with the volume of 25 pl. Referential Figures 111 and 112 designate the states of three ink droplets with the volume of 25 pl immediately after they have adhered to the surface of a recording sheet.

According to the table in FIG. 6, (a), when the volume of an ink droplet is 100 pl, the dot diameter w1 (R×2) becomes approximately 115.2 $\mu$m, and the height of the ink droplet immediately after its adhesion to the surface of the recording sheet becomes approximately 9.6 $\mu$m, whereas when the volume of an ink droplet is 25 pl, the dot diameter w2 becomes approximately 72.4 $\mu$m, and the height of the ink droplet immediately after its adhesion to the surface of the recording sheet becomes approximately 6.1 $\mu$m.

As is evident from the above description, according to this simultaneous split ejection recording system, a predetermined amount of ink is ejected in a plurality of ink droplets of equal volume, onto a single picture element area which can be covered 100% by a single ink droplet of the predetermined amount, making the area factor of the predetermined amount of ink greater than 100%. As a result, the height of an ink droplet immediately after its adhesion to the surface of the recording sheet is reduced. In addition, the recording sheet is heated by a heater. Therefore, the penetration of the ink into the recording sheet becomes shallow, which increases recording density, and also improves the state of ink spreading at the borderline between the areas of different color.

(Differed Timing Split Ejection Recording System)

Next, a description will be given as to a recording system, according to which an image is recorded by ejecting a predetermined amount of ink in groups of small ink droplets, at different points in time.

Figure 10:
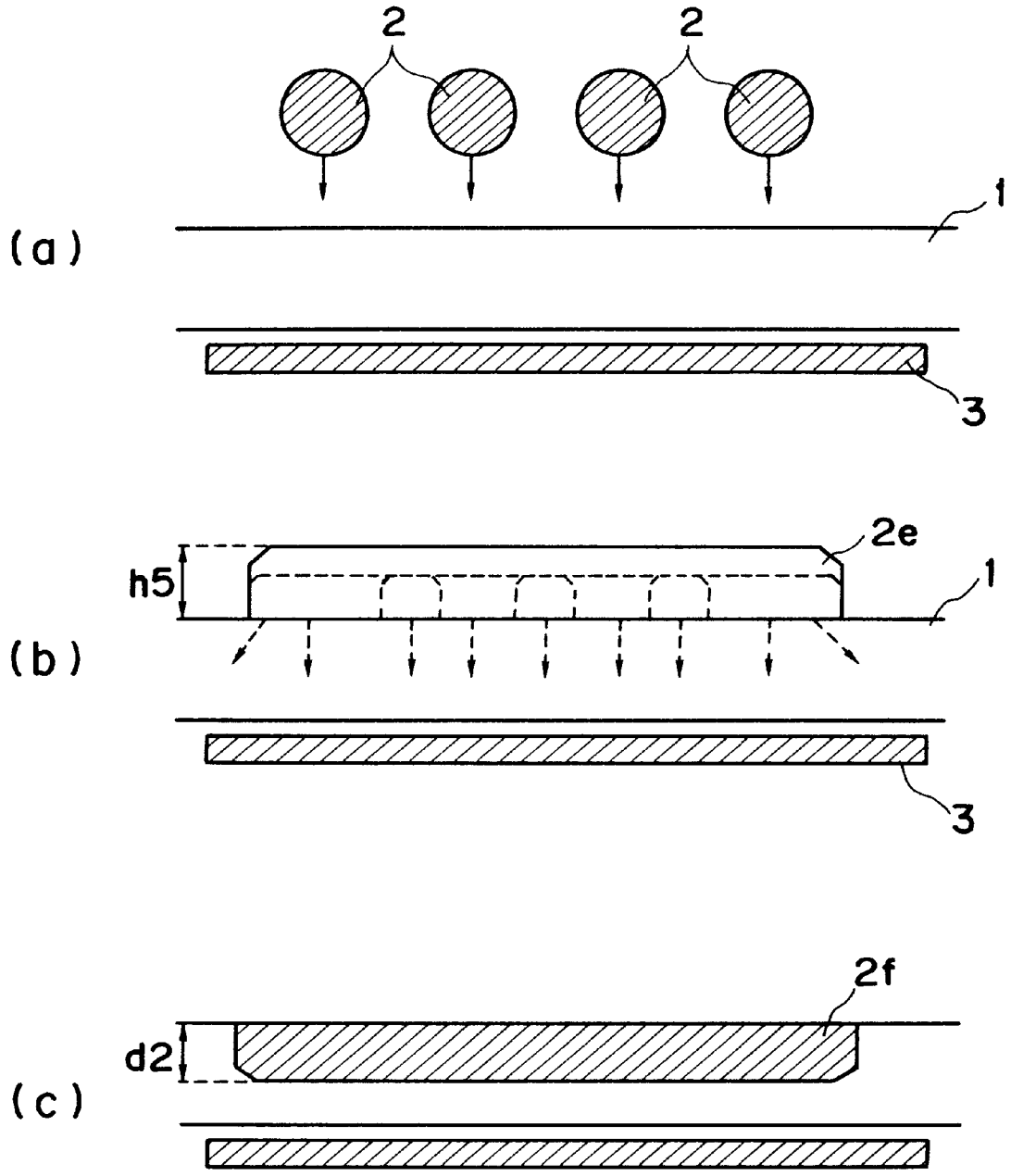
FIGS. 10(*a*)–10(*c*) are illustrations of an ink droplet formation state in a plural recording printing type of an ink jet recording method.

FIG. 10 is a schematic drawing which depicts a case in which a portion of an image, the size of which is equivalent to a single picture element of the image, is formed by ejecting all at once a plurality of small ink droplets, the combined volume of which is equivalent to an area factor of 100%. FIG. 10, (a) shows a state in which a plurality of ink droplets 2 have been ejected, and are traveling toward a recording sheet 1, while heat is applied by a heater 3. FIG. 10, (b) shows a state in which the erected plurality of ink droplets have just adhered to the surface of the recording sheet 1. In this state, the ink droplets have been united into a single layer of ink 2*e* with a height of $h_5$, being still on the surface of the recording sheet 1, and ready to begin to penetrate into the recording sheet 1 in the direction indicated by arrow marks. FIG. 10, (c) shows a state in which the ink 2*e* has completely penetrated into the recording sheet 1, and has become fixed. In this case, the ink has completely penetrated as far as a depth of $d_2$ into the recording sheet even though the ink penetration has been controlled with the use of a heater. A reference character 2*f* designates the ink 2*e* which has become fixed in the recording sheet 1.

Figure 11:
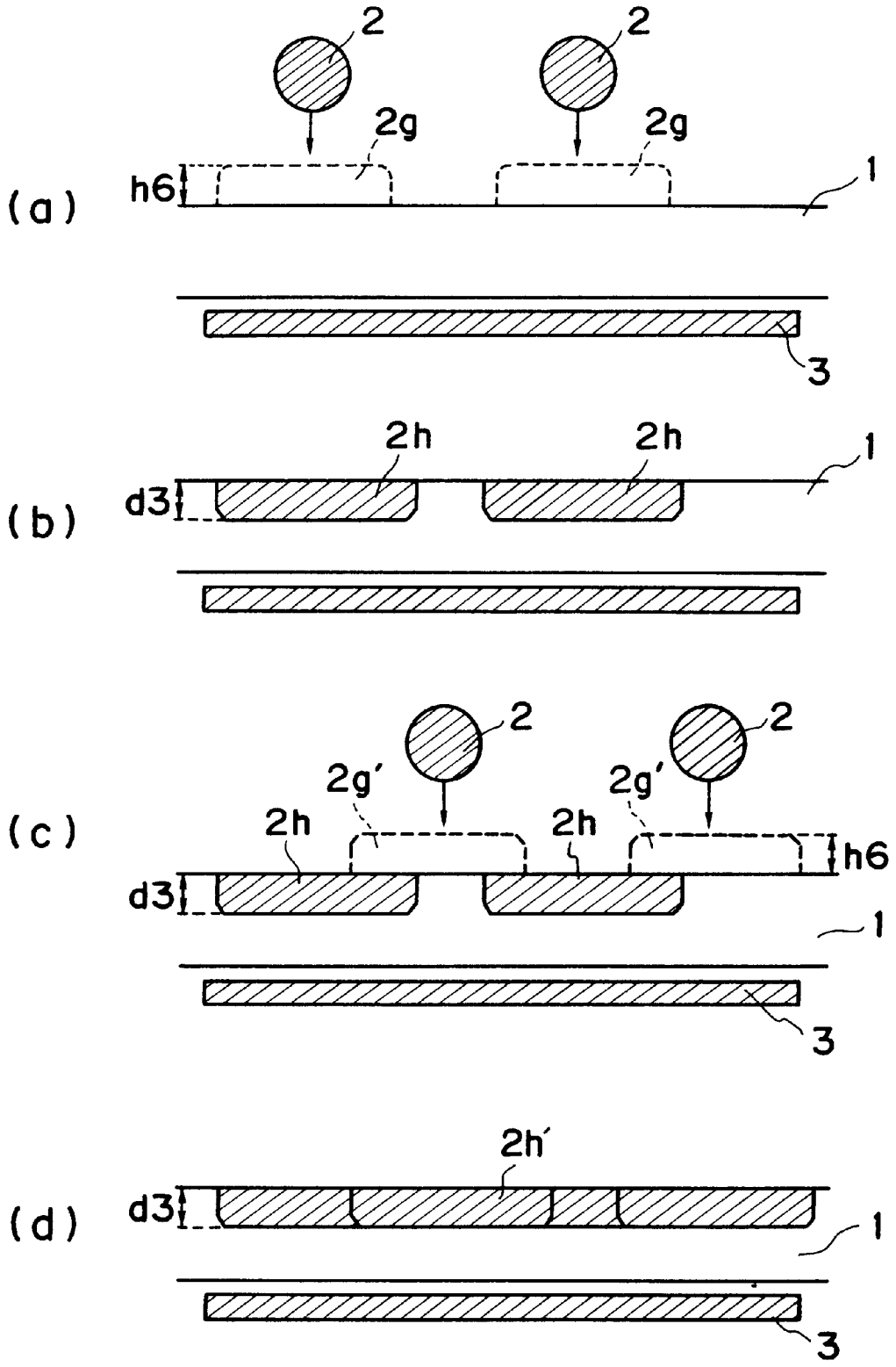
FIGS. 11(*a*)–11(*d*) are illustrations of an ink droplet formation state in a preferable plural recording printing type of ink jet recording method.

FIG. 11 is a schematic drawing which depicts a case in which a portion of an image, the size of which is equivalent to a single picture element of the image, is form by ejecting a predetermined volume of ink, which gives an area factor of 100%, in two groups of small ink droplets at different points in time. FIG. 11, (a) shows a state in which a first group of a plurality of ink droplets 2, the number of which is a half of those in FIG. 10, (a), and the positions of which are equivalent to the alternate positions of those in FIG. 10, (a), have been ejected, and are traveling toward a recording sheet 1, while heat is applied by a heater 3. The ejected plurality of ink droplets adhere to the surface of the recording sheet 1, as illustrated by dotted lines 2*g* in FIG. 11, (a), before they begin to penetrate into a recording sheet 1. The height of each ink droplet in this state, that is, immediately after its adhesion to the recording sheet 1, is $h_6$. FIG. 11, (b) shows a state in which the ink droplets ejected in the manner illustrated in FIG. 11, (a), and have completely penetrated into the recording sheet 1 as far as a depth of $d_3$ (ink droplets 2*f*) while their penetration has been controlled with the use of a heater 3. FIG. 11, (c) shows a state in which a second group of a plurality of small ink droplets, the positions of which are equivalent to the rest of the alternate positions of those in FIG. 10, (a), have been ejected a predetermined length of time after the first group of the ink droplets. Also in this drawing, only the ink droplets, the positions of which are equivalent to the alternate positions of those in FIG. 10, (a) have been ejected. The ejected ink droplets 2 adhere to the surface of the recording sheet 1 as outlined by dotted lines 2*g*', in the same manner as illustrated in FIG. 11, (a), before they begin to penetrate into the recording sheet 1. The height of each ink droplet immediately after it adhesion to the surface of the recording sheet 1 is $h_6$, which is the same as the height of the ink droplet 2 in FIG. 11, (a).

FIG. 11, (d) shows a state in which two groups of small ink droplets ejected at different points in time as illustrated in FIGS. 11, (a) and (c), have completely penetrated as far as a depth of $d_3$ into the recording sheet 1, turning into ink droplets 2*h*', while their penetration was controlled with the use of a heater 3. As is evident from the comparison between FIG. 10 and FIG. 11, there is a difference in the depth ($d_2$ or $d_3$) to which ink penetrates into the recording sheet, between when a recording is made by ejecting a predetermined volume of ink in a plurality of small ink droplets all at once as shown in FIG. 10 and when a recording is made by ejecting the predetermined volume of ink in a plurality of groups of a plurality of small ink droplets at different points in time as shown in FIG. 11. This is due to the following reason. That is, when a predetermined volume of ink is ejected all at once in a plurality of small droplets as shown in FIG. 10, each ink droplet overlaps with the immediately adjacent ink droplets, causing the height of the ink droplet from the surface of the recording sheet to be higher across the overlapping portion, which in turn causes the ink to penetrate deeper into the recording sheet 1. On the other hand, when an arrangement is made to eject a predetermined volume of ink in a plurality of groups of a plurality of small ink droplet at different points in time, the ink droplets do not overlap with the immediately adjacent ink droplets, and therefore, the heights of the ink droplets immediately after their adhesion to the surface of the recording sheet remain low, and as a result, the depth to which the ink penetrates into the recording sheet is reduced, and therefore, recording density is increase.

(3) Recording with Pigment Ink

The present invention is compatible not only with dye based ink but al so with pigment based ink. When pigment is used, the present invention is more effective than when dye ink is used, because of the unique phenomenon which occurs only when pigment ink is used, and which is different from the above described phenomenon which occurs when dye ink is used. Thus, next, the effects of the present invention, which are obtained when pigment is used while applying heat by a heater, will be described.

Figure 12:
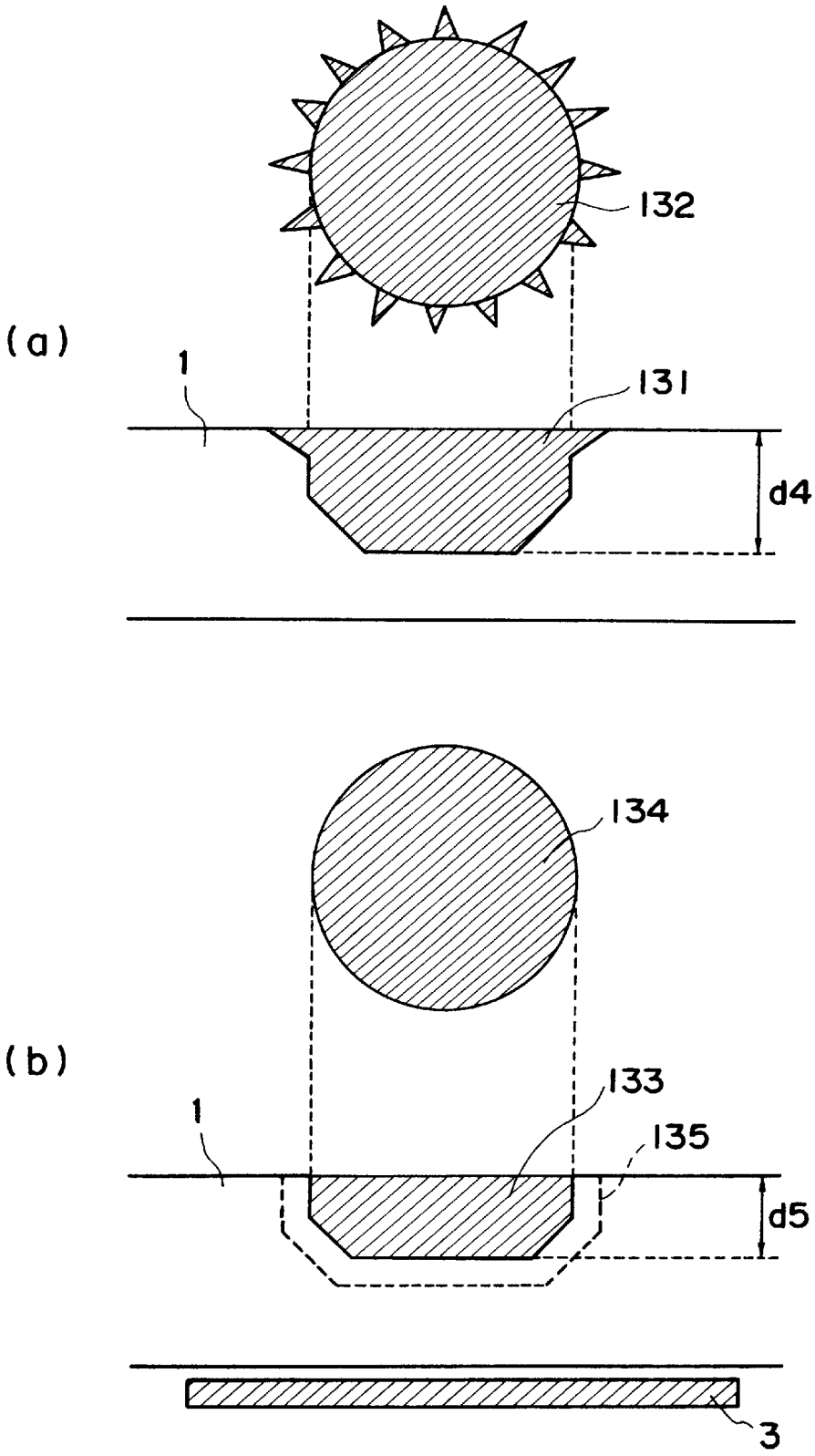
FIGS. 12(*a*)–12(*b*) are illustrations of a pigment containing ink droplet formation state in an ink jet recording method.

FIG. 12, (a) shows a dot formed on the surface of a recording sheet 1 by a single droplet of penetrative pigment ink, which has penetrated into a recording sheet 1 after being ejected, while no heat is applied by a heater, and also shows the vertical section of the droplet.

The ink droplet ejected onto the recording sheet 1 penetrates into the recording sheet 1 as far as a depth of $d_4$, and becomes fixed there in a pattern designated by a referential Figure 131. The pigment in the ink widely disperses on and into the recording sheet 1 with solvent, as the solvent of the ink spreads on, and penetrates into, the recording sheet 1. In other words, the pigment penetrates deeper into the recording sheet 1, and therefore, recording density is reduced. Further, on the surface of the recording sheet 1, spreading occurs in a pattern designated by a referential Figure 132, due to the penetrativeness peculiar to pigment ink. As a result, the shape or each dot becomes inferior, detrimentally affecting the recording quality.

FIG. 12, (b) shows a dot formed on the surface of a recording sheet 1 by a single droplet of penetrative pigment ink, which has penetrated into a recording sheet 1 after being ejected, while heat is applied by a heater, and also shows the vertical section of the droplet. When dispersive pigment ink which does not contain surfactant is used for recording images on a recording sheet which is being heated with a heater, the liquid contents of the ink evaporate due to the heat, as the ink penetrates into the recording sheet 1. As a result, the ratio of pigment in the ink is increased, making it difficult for the pigment to disperse. Consequently, the depth of which pigment penetrates into the recording sheet 1 in the thickness direction of the recording sheet 1 is reduced to a depth of $d_5$, improving the recording quality as it was by the preceding recording methods.

Referring to FIG. 12, (b), the ink droplet ejected onto the surface of the recording sheet 1 adheres to the surface of the recording sheet 1, and then, begins to penetrate into the recording sheet 1. Application of heat with the use of a heater 3 causes the liquid contents in the recording sheet 1 to evaporate, increasing the pigment ratio in the ink, which makes it difficult for pigment to disperse in the solvent. As a result, pigment ink does not penetrate into the recording sheet 1 as far as the range outlined by a dotted line 135. In other words, the depth to which pigment ink penetrates into the recording sheet 1 is reduced to a depth of $d_5$ by a heater, and therefore, recording density increase. Since the pigment in the ink penetrates into the recording sheet 1 with the solvent, virtually no pigment particles remain on the surface of the recording sheet 1 after the ink becomes fixed. Further, this recording method causes virtually all the pigment particles to penetrate into the recording sheet 1, an therefore, not only is it highly desirably in terms of recording density, but also in terms of scratch resistance and instant water resistance.

Further, when the heater 3 is in use, the shape of the dot at the surface of the recording sheet 1 in a pattern designated by a referential Figure 134, being relatively free of spreading at its periphery, compared to the dot formed when no heater is in use. In other words, when heat is applied by the heater 3, a sharper dot can be formed. This is thought to be due to the following reason. That is, after an ink droplet adheres to the surface of the recording sheet 1, the peripheral portion of the ink droplet is affected more by the heating with the use of the heater 3 than the central portion of the ink droplet, and therefore, the liquid contents of the in droplet evaporate from the peripheral portion of the ink droplet by a larger volume and at a faster speed than from the central portion.

(4) Effects of Difference in Interval in Time Between Ejections When Recording is Made by Overlaying Plurality of Ink Droplets Next, the difference in the effects of the present invention caused by the difference in interval in time between ink droplet ejections when a recording is made by overlaying a plurality of ink droplets while the penetration of ink into a recording sheet is controlled by heating the recording sheet with the use of a heater, will be described.

Figure 13:
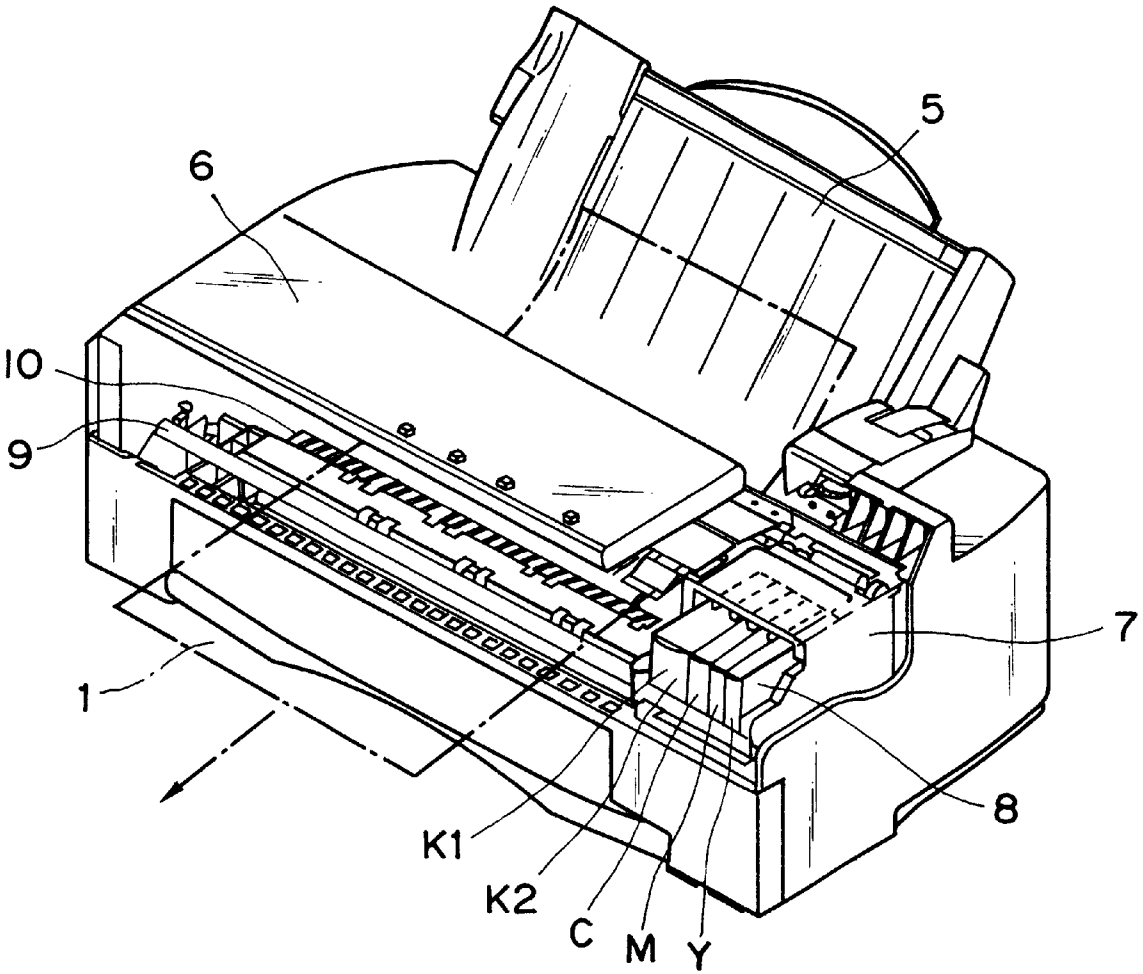
FIG. 13 is a perspective view of an example of a recording device usable with the present invention.

FIG. 13 is a perspective view of an example of a recording apparatus compatible with the present invention. A recording sheet 1 (ordinary sheet) as recording medium is inserted from a sheet feeding section 5 and is conveyed through a printing section 6. In this embodiment, widely available inexpensive ordinary sheets are used as recording sheets. In the printing section 6, a recording head 8 is located, being mounted on a carriage 7. The recording apparatus is structured so that the recording head 8 can be moved back and forth by an unillustrated driving means along a guide rail 9. The recording head 8 comprises black ink ejecting portions K1 and K2, a cyan ink ejecting portion C, a magenta ink ejecting portion M, and a yellow ink ejecting portion Y, to which correspondent inks are supplied from unillustrated ink containers. Each ejecting portion ejects ink of a correspondent color as a driving signal is supplied to the ink ejecting means. The recording apparatus is equipped with a ceramic heater 10, which extends across the entire moving range of the carriage 7, positioned directly below the ink ejecting portions. In this embodiment, the recording apparatus is based on a bubble jet system; in other words, it comprises electrothermal transducer elements, ink ejecting means for applying thermal energy to ink, and ink is ejected by the pressure from bubbles generated in ink by the thermal energy provided by electrothermal transducer elements. The recording head 8 has a resolution of 360 dpi, and its nozzle driving frequency is set at 7.2 kHZ. The apparatus is structured so that it takes approximately 1.5 seconds for the carriage 7 to shuttle once across its scanning range.

(Recording with Short Interval Between Split Ink Ejections)

First, a recording process in which the interval in time between split ink ejections for overlaying ink droplets is relatively short will be described with reference to the results of a test.

Figure 14:
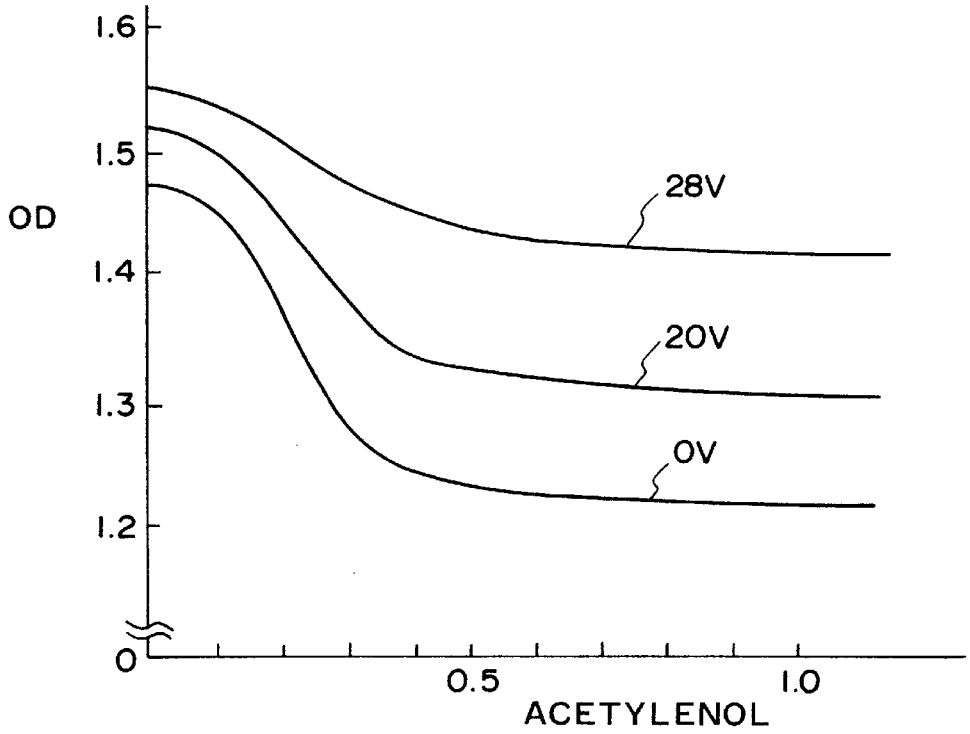
FIG. 14 shows a content of acetylenol in plural recordings with short intervals vs. OD.
Figure 15:
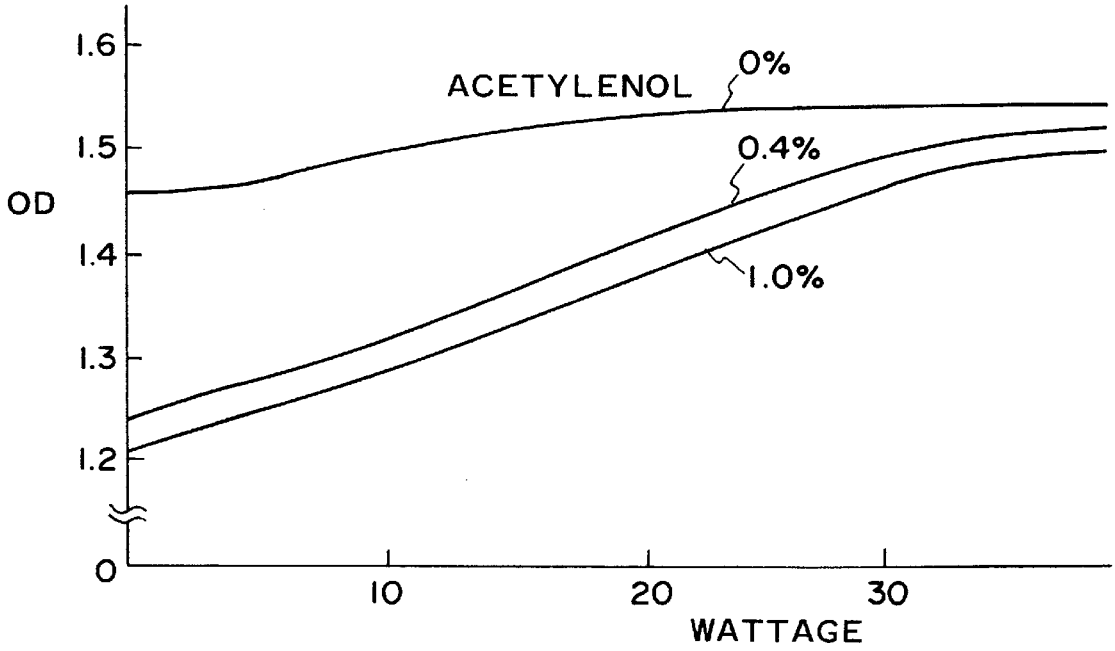
FIG. 15 shows an electric power in plural recordings with short intervals vs. OD.

In this test, the ink droplet overlaying recording process was carried out using black ink ejecting portions K1 and K2, and during the recording, the carriages are simultaneously moved. The interval between the times at which the black ink ejecting portions K1 and K2 eject ink was set at approximately 50 msec, which was relatively short. The recording processes by the color ink ejecting portions C, M and Y were carried out following the scanning movement of the black ink ejecting portions K1 and K2. The relationship between the penetrativeness of ink and the density of a recorded image, which was observed while varying the heating temperature of a heater 10, is shown in FIGS. 14 and 15. FIG. 14 is a graph which shows the results of a test in which the voltage applied to the ceramic heater as a heating means was set at 28 V, 20 V and 0 V, and also, the ratio of the Acetylenol content was adjusted. FIG. 15 is a graph which shows the relationship between the wattage of the heater as the heating means, and the OD value, when the ratio of the Acetylenol content was at 0%, 0.4%, and 1.0%. Referring to FIG. 14, the higher the voltage applied to the heater, the higher the heating temperature of the heater, and the voltage of 0 V means that heat was not applied by the heater.

Referring to FIG. 14, the vertical axis stands for the OD value (reflective optical density), which shows the density of a recorded image, and the horizontal axis represents the ratio of the Acetylenol content. Referring to FIG. 15, the vertical axis stands for the OD value (reflective optical density), which shows the density of a recorded image, and the horizontal axis stands for the wattage of the heater as the heating means.

When an ink has an Acetylenol content ratio of 0%, the OD value becomes high; in other words, a recorded image appears vivid and clear. However, the amount of the ink which remains in the indentations present on the recording sheet surface increases, as described before. Thus, if inks of different color are ejected onto the areas which border each other, the inks flow, or spread, into each other, rendering indistinctive the borderline between the areas of different color. In order to solve this type of problems, a sufficient interval must be provided between the time at which ink is ejected onto a first spot, and the time at which ink is ejected onto a second spot immediately adjacent to the first spot. However, such an arrangement reduces the through-put. On the other hand, if the ratio of the Acetylenol content in an ink is increased, the penetrativeness of the ink increases, end as a result, the amount by which the ink remains in the indentations present on the surface of the recording sheet reduces. However, the OD value drops; a recorded image appears unclear and less vivid. Thus, in this embodiment, the ratio of the Acetylenol content was set at approximately 0.4%. As a result, desirable images could be formed; the OD value was relatively high, and yet, the ink spreading at the borderline was well controlled.

Figure 16:
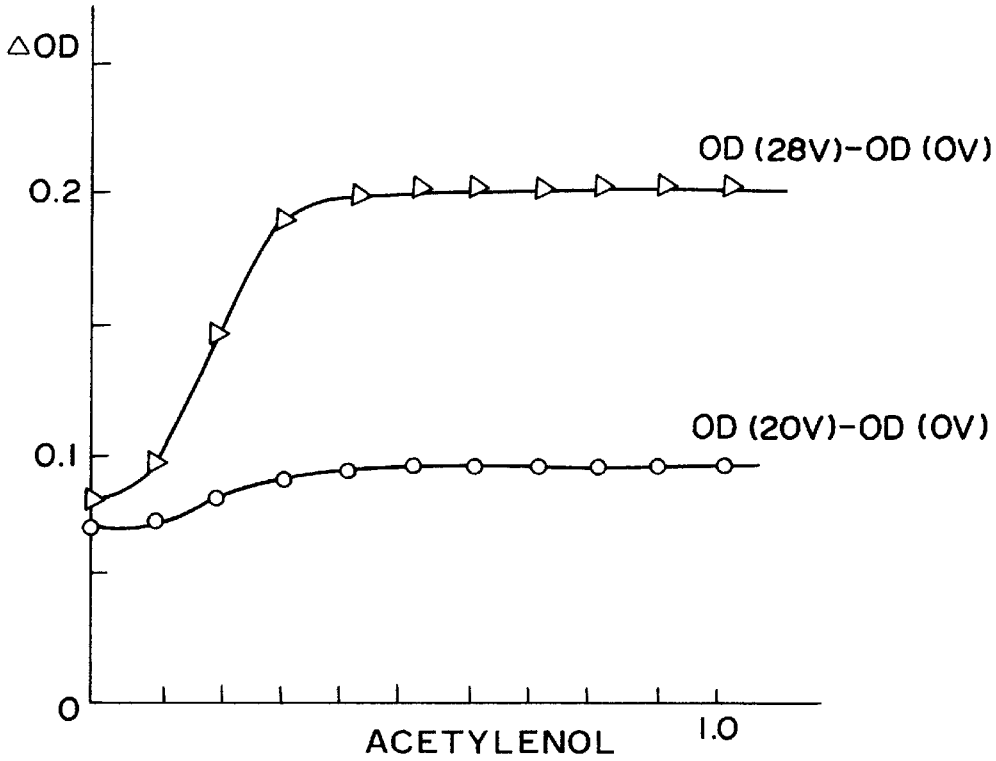
FIG. 16 shows a content of acetylenol vs. a difference of OD values (heating and non-heating) in plural recordings with short intervals.

FIG. 16 is a graph which shows how much difference in OD value is created between when a heater is used and when it is not. FIG. 16 is correlated to FIG. 14, and shows, in the form of a graph, the difference in the recording density between when the voltage applied to the heater was 20 V, and when it was 0 V (no heater was used), and the difference in recording density between when the voltage applied to the heater was 28 V, and when it was 0 V (no heater was used), with reference to the ratio of the Acetylenol content in the ink.

As is evident from the results of the test provided by FIGS. 14, 15 and 16, the higher the heating temperature of a heater set, the higher the OD value becomes. Further, even it the penetrativeness of an ink is increased by increasing the ratio of the Acetylenol in the ink, the density of an image recorded with such an ink can be raised to a level substantially equal to that of an ink with less penetrativeness, by raising the heating temperature of the heater.

(Recording with Long Interval Between Split Ink Ejections)

Next, a recording process in which the interval in time between split ink ejections for overlaying ink droplets is rendered relatively long will be described with reference to the results of a test.

In this test, the recording apparatus illustrated in FIG. 13 was used. A recording was made by causing the carriage 7 to shuttle twice across its scanning range, over the same area of the recording sheet; during the first scanning, or recording run, a recording was made by the black ink ejecting portion K1 or K2, and during the following scanning, or second recording run, ink droplets were overlaid on the recording made by the first scanning, by the black ink ejecting portion K1 or K2.

In this test, the interval in time between the first ejection carried out during the first scanning movement of the carriage 7, and the second ejection carried out during the second scanning movement of the carriage 7, was set at approximately 1.5 seconds, which was relatively long. The recording by the ink ejecting portions C, M and Y were carried out during the second scanning movement of the black ink ejecting portion.

Figure 17:
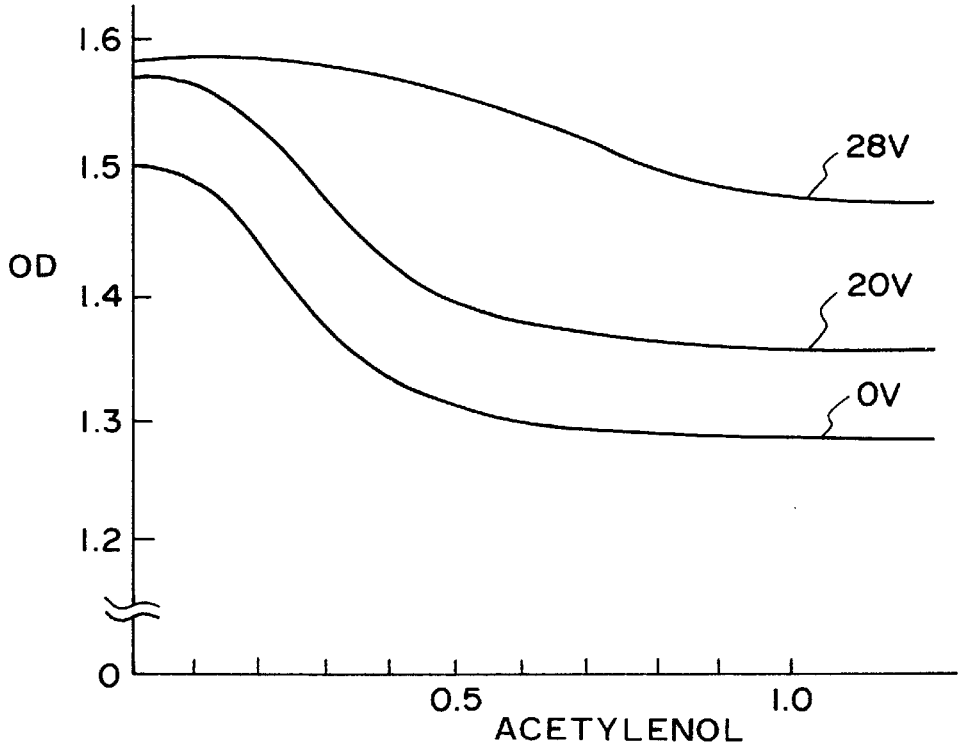
FIG. 17 shows a content of acetylenol in plural recordings with long intervals vs. OD value.
Figure 18:
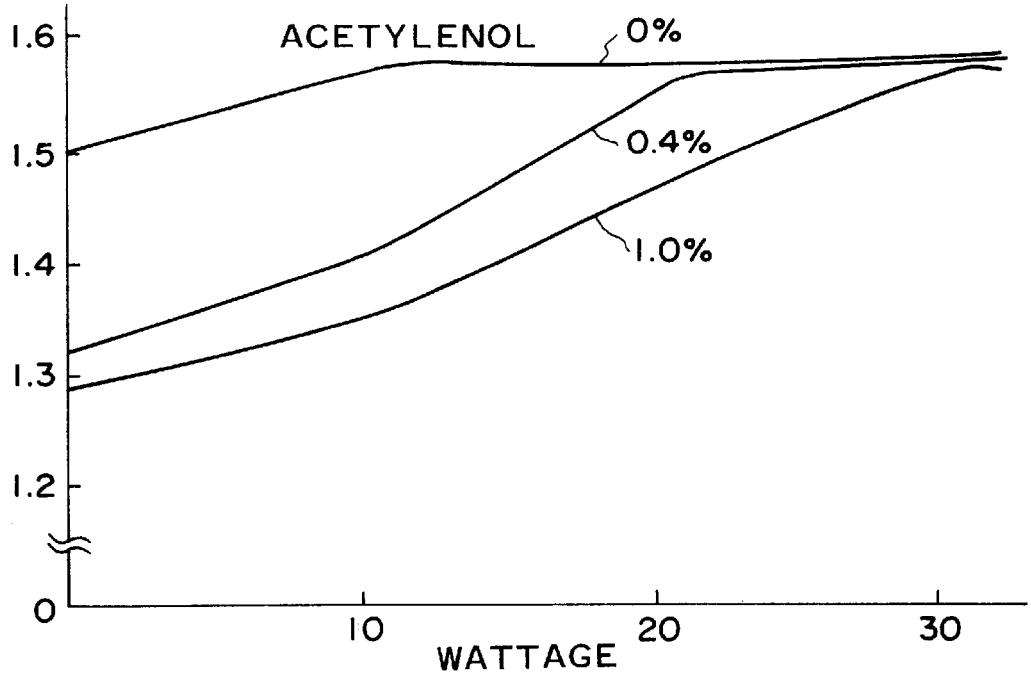
FIG. 18 shows an electric power in plural recordings with long intervals vs. an OD value.

The results of the test are given in FIGS. 17 and 18. FIG. 17 is a graph which shows the results of a test in which the voltage applied to the ceramic heater as a heating means, which is used, in the fixing device of a laser beam printer of Canon, was set at 28 V, 20 V and 0 V, and also, the ratio of the Acetylenol content was adjusted. FIG. 18 is a graph which shows the relationship between the wattage of the heater as the heating means, and the OD value, when the ratio of the Acetylenol content was set at 0%, 0.4% and 1.0%. Also in this test, desirable images could be formed by setting the ratio of the Acetylenol content at approximately 0.4%; the OD value became relatively high, and the ink spreading at the borderline was well controlled.

Figure 19:
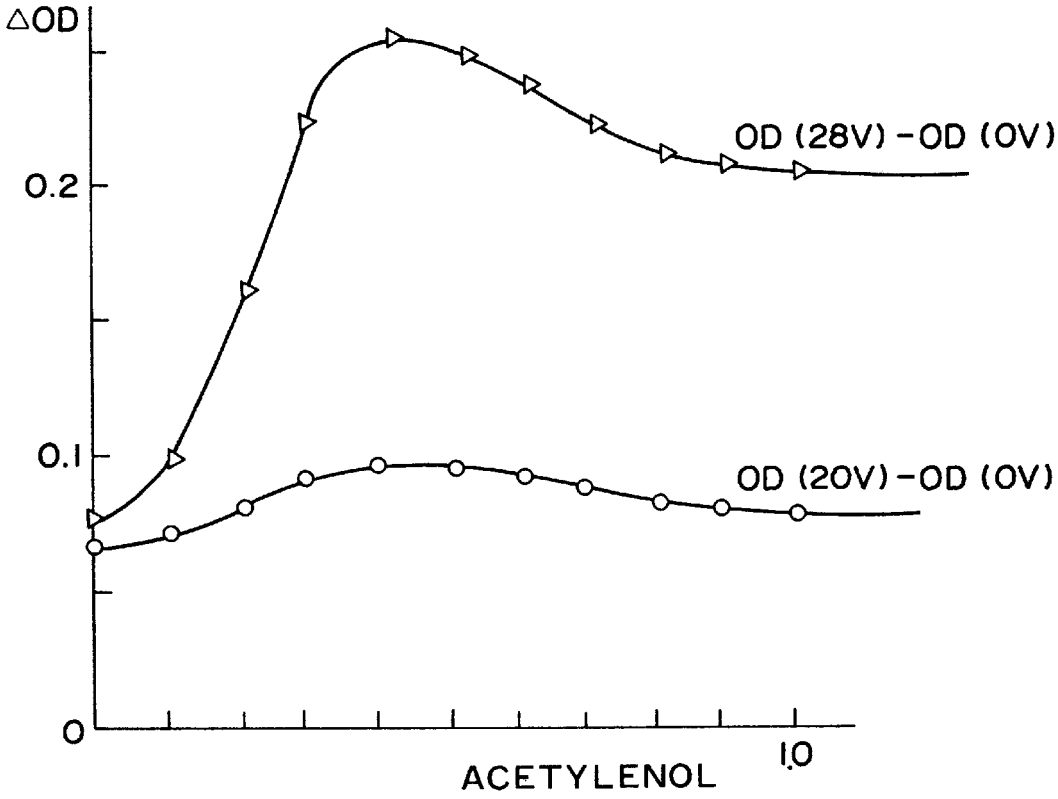
FIG. 19 shows a content of acetylenol in plural recordings with long intervals vs. OD value difference (heating and non-heating).

FIG. 19 is a graph which shows how much difference in OD value is created between which a heater is used and when not. FIG. 19 is correlated to FIG. 17, and shows, in the form of a graph, the difference in the recording density between when the voltage applied to the heater was 20 V, and when it was 0 V (no heater was used), and the difference in recording density between when the voltage applied to the heater was 28 V, and when it was 0 V (no heater was used), with reference to the ratio of the Acetylenol content in ink.

Looking at FIG. 19, it is evident that when the voltage applied to the heater was 28 V, the density difference between an image formed using the heater, and an image formed while not using the heater increased, in other words, an image with high density was formed, when the ratio of the Acetylenol content was in a range of 0.2–0.7%, in particular, in a range of 0.3–0.7%.

As is evident tram the results of the test shown by FIGS. 17, 18 and 19, the higher the heating temperature of a heater is set, the higher the OD value becomes. Further, even in the case of an ink, the penetrativeness of which has been increased by increasing the ratio of the Acetylenol content, the density of an image recorded with such an ink can be raised to a level substantially equal to that of an ink with less penetrativeness.

Comparison of the results of this test shown by FIGS. 17, 18 and 19 to the results of the other test shown by FIGS. 14 and 15, reveals that when the factors such as the Acetylenol ratio of the ink, the heating temperature of the heater, the wattage of the heater, and the like are rendered equal between the two tests, the recording method carried out in the test, the results of which are shown by FIGS. 17 and 18, can accomplish higher recording density.

Further, comparison between the results shown by FIGS. 16 and 19 reveals that when a recording is made by ejecting a plurality of ink droplets in an overlaying manner, the effects of the heating by the heater can be enhanced, in other words, recording density can be increased, by setting a relatively long interval in time between the time at which a preceding ink droplet is ejected, and the time at which a following ink droplet is ejected.

The ink spreading which occurs at the borderline between the areas of different color other than black can be also controlled by using color inks with relatively high penetrativeness, and restricting the penetrativeness of the inks into a recording sheet by a heater.

At this time, the ink spreading which occurs at the borderline between the area recorded with the black ink and the areas recorded with the color inks will be discussed. In the cases depicted by FIGS. 14 and 15, the interval in time between the recording by the black ink and the recording by the color inks was relatively long, and therefore, the borderline ink spreading was well controlled. In the cases depicted by FIGS. 17 and 18, the borderline ink spreading between the areas recorded with the black ink and the areas recorded by the color inks was well controlled because of the heating by the heater. However, in the cases depicted by FIGS. 17 and 18, the recording by the black ink and the recording by the color inks occurred during the same scanning movement of the carriage 7, the presence of a small amount of the borderline ink spreading, which was virtually non-existent in the cases depicted by FIGS. 14 and 15, was confirmed.

As will be evident from the above observation, in order to increase the density of the image formed with the black ink, it is desirable to increase the interval in time between the time at which a recording is made by the black ink ejecting portion K1 and the time at which a recording is made by the black ink ejecting portion K2, and in order to better control the borderline ink spreading between the area recorded with the black ink and the areas recorded with the color inks, it is desirable to increase the interval in time between the time at which a recording is made with the black and the time at which a recording is made with the color inks.

Also as will be evident from the above observation, it may be said that in order to increase recording density by recording an image by overlaying a plurality of ink droplets, the interval between a first recording run of the split recording, and a second recording run of the split recording should be set relatively long. As for the actual length of the interval, it may be set to a length of time equal to the time it takes for the carriage 1 to shuttle once. With such an arrangement, this embodiment is applicable to recording apparatus with the well known structure, that is, recording apparatuses in which only one ink ejecting portion is provided for each ink, not like the apparatus illustrated in Figure, in which a plurality of ink ejecting portions were provided for the black ink, because a recording apparatus can be structured so that the first and second recording runs of the split recording method can be carried out by a single black ink ejecting portion.

Recording apparatus of a full-line type, the recording head of which is rendered long enough to cover the entire width of a recording sheet, are widely known. In the cases of these full-line type recording apparatuses, the recording speed corresponds to the speed at which the recording sheet is conveyed. Therefore, in order to adjust the interval in time between the first and second recording runs of the carriage 7, these full-line type recording apparatuses, in which a plurality of recording heads are disposed perpendicular to the direction in which the recording sheet is conveyed, in parallel to each other, and in alignment in the direction in which the recording sheet is conveyed, may be structured so that the distance between the adjacent two recording heads is set to be correspondent to the interval in time between the first and second recording runs, or so that the speed at which the recording sheet is conveyed is set to be correspondent to the interval in time between the first and second recording runs of the carriage 7. Below, an embodiment in which the present invention is applied to a typical full-line recording apparatus will be described.

Figure 20:
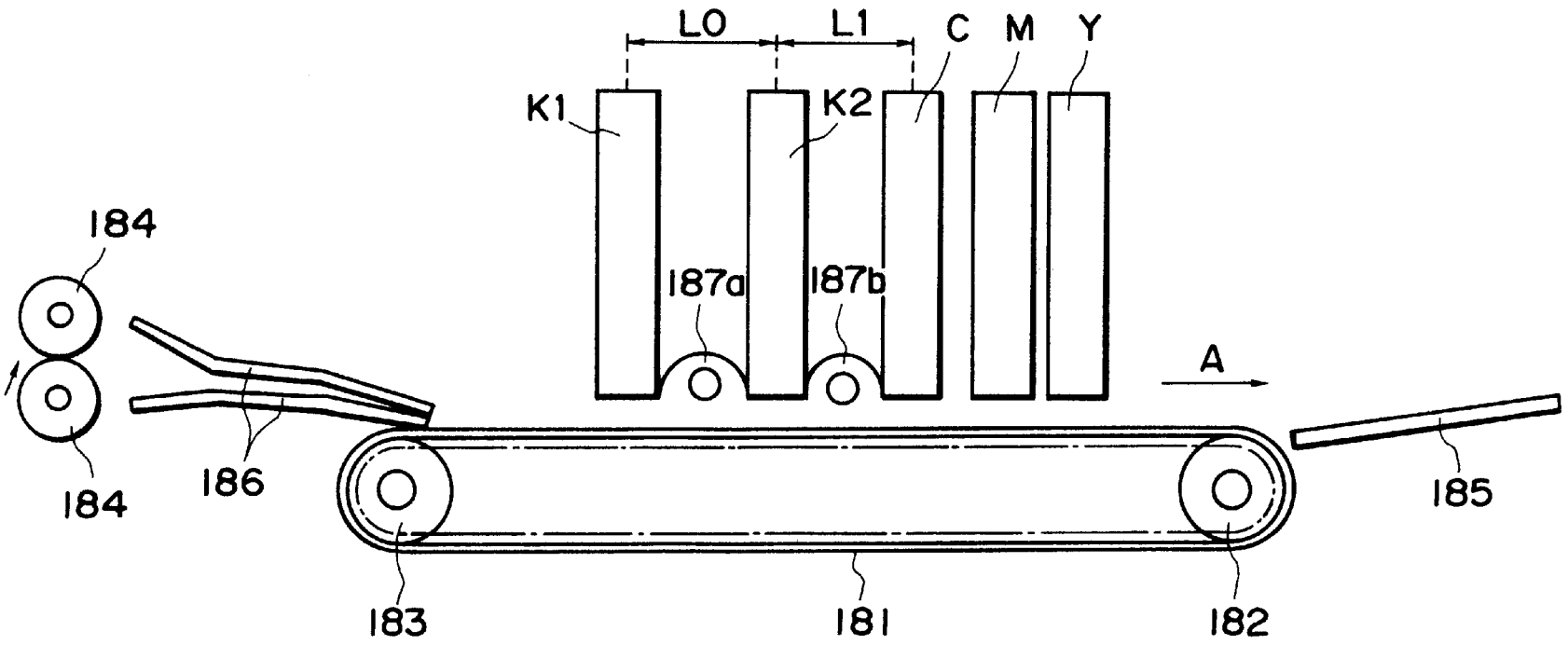
FIG. 20 is a schematic view of an ink jet recording apparatus of a full-line type.

FIG. 20 is a schematic vertical section of a full-line recording apparatus, and depicts the general structure thereof. This recording apparatus employs an ink jet recording system which records images of multiple colors by ejecting inks of different color. It comprises a plurality of full multiple type recording heads, which are disposed in the direction perpendicular to the direction in which a recording sheet is conveyed, being therefore parallel to each other, and at the same time, in alignment in the direction in which the recording sheet is conveyed. More specifically, in the case of the recording apparatus structure illustrated in FIG. 20, recording head K1 and K2 for ejecting the black ink, and recording heads C, M and Y for ejecting correspondent color inks, that is, yellow, magenta, and cyan inks, are disposed so that their ink ejection openings face a conveyor belt 181. These recording heads are full-line type recording heads, the ink ejection openings of which are aligned in the width direction of the heads, to cover the entire recording range. Each recording head contains unillustrated electrothermal transducers, which are disposed adjacent to the ink ejection openings one for one. As power is supplied to an electrothermal transducer, heat is generated, and the ink in an ink flow path (unillustrated) is caused to boil in the film-boiling manner by the heat generated by the electrothermal transducer; in other words, a bubble is formed in the ink flow path. As the bubble grows, an ink droplet is ejected from the ink ejecting opening. As described before, the plurality of the ink ejection openings of each recording head are aligned in a single line perpendicular to the direction in which recording sheets are conveyed, that is, the direction perpendicular to the surface on which FIG. 20 is illustrated. The conveyor belt 181 for conveying recording sheets is an endless belt, which is supported by two rollers 182 and 183, being enabled to rotate in the direction indicated by an arrow mark A. Recording sheets as recording medium are red into the recording apparatus by a pair of registration rollers 184, in synchronism with image formation steps, and recordings are made on recording sheets by ejecting ink from the recording heads. After the recordings are made on recording sheets, recording sheets are discharged into a stocker 185. A referential figure 186 designates a guide for guiding recording sheets onto the conveyor belt 181.

Between the recording heads K1 and K2, and between the recording head K2 and the recording head C, halogen lamp heaters 187*a* and 187*b* are disposed, respectively, as heaters for heating recording sheets. In the case of the structure of the recording apparatus illustrated in FIG. 13, ceramic heaters were employed as the heating means. However, heating means compatible with the present invention is not limited to such heaters that heat recording sheets from behind; a halogen lamp heater such as those illustrated in FIG. 20 can also desirably heat recording sheets. It should be noted that in the case of a recording apparatus which employs a halogen lamp heater, if heaters are disposed so as to heat recording sheets from behind the recording sheets, the structure of the recording apparatus becomes complicated because the recording sheets are conveyed by being placed on the top surface of the conveyor belt 181, and therefore, it is desirable to employ heaters which heat the recording sheets from the front side as illustrated in FIG. 20. In this drawing, the number of the heaters disposed between the recording heads K1 and K2 is one, and the number of the heaters disposed between the recording heads K2 and C is also one. However, the structure may be such that a plurality of heaters are disposed there depending on the amount of heat a single heater generates.

In FIG. 20, a referential code L0 designates the distance between the two recording heads for ejecting black ink. Setting the value of the distance L0 based on the length of time it takes for a recording sheet to travel this distance L0 fixes the length of the interval in time between the times at which the recording should be made by the recording heads K1 and K2 for ejecting black ink. In other words, if the interval in time between the time at which the first recording is made by the recording head K1, and the time at which the overlapping second recording is made by the recording head K2 is set at 1.5 seconds, L0 should be set to a distance that can be traveled by a recording sheet in 1.5 seconds. Further, in the case of the structure illustrated in FIG. 20, a distance L1 between the recording head K2 for ejecting black ink, and the recording head C for ejecting cyan ink, is set to be substantially equal to the distance L0, so that an interval in time is provided before the recording head C begins recording after the recording head K2 finishes recording. With this structure, the recording by the recording head C begins after the ink droplet ejected from the recording head K2 has penetrated into the recording sheet to a certain depth, and therefore, the borderline ink spreading between the area recorded with the black ink and the areas recorded with the color inks is well controlled. As a result, desirable images can be recorded.

Embodiment

Hereinafter, the embodiments of the present invention, that is, specific recording sequences in accordance with the present invention, will be described with reference to the above-described recording apparatus compatible with the present invention.

Figure 21:
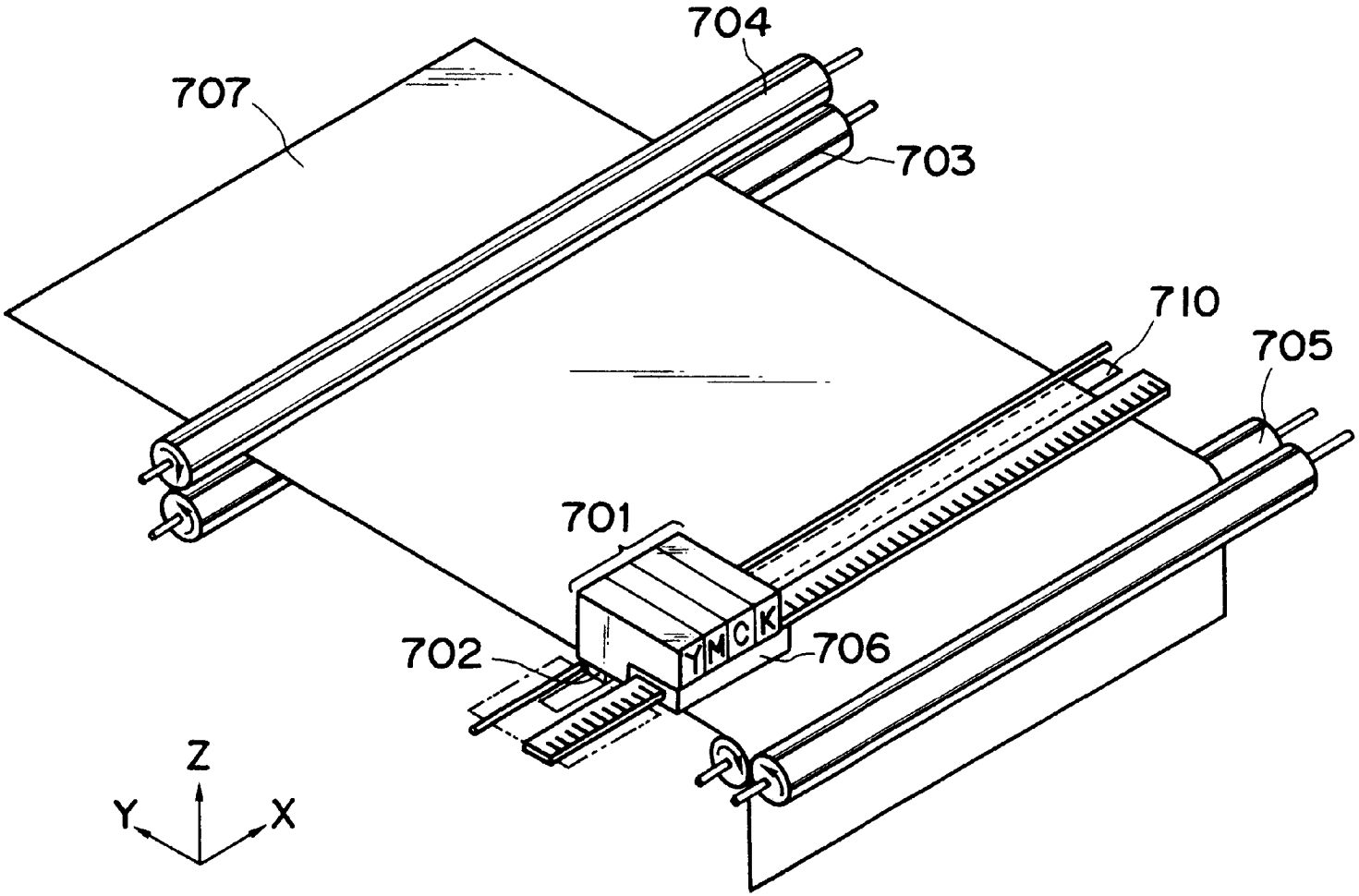
FIG. 21 is a schematic view of an ink jet recording apparatus of a serial type.

FIG. 21 is a perspective view of the printing section of the above described color recording apparatus. This printing section employs a so-called serial system. In other words, during an image forming operation, recording heads are caused to make scanning movements in the direction indicated by an arrow mark X (primary scanning direction), while a printing paper 707 as recording medium is conveyed in the direction indicated by an arrow mark Y (secondary scanning direction). In this drawing, a referential Figure 701 designates a head cartridge, which comprises an ink container and a multiple nozzle head 702. The container is packed with four different inks: black ink (K), cyan ink (C), magenta ink (M) and yellow ink (Y).

Figure 22:
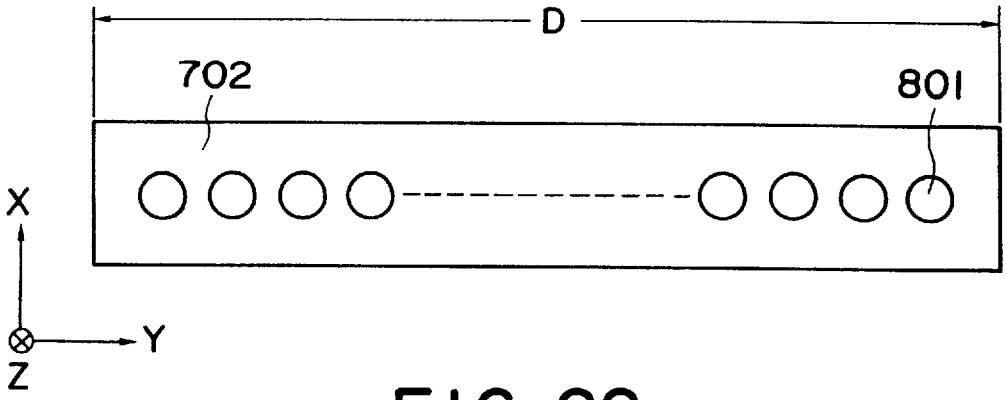
FIG. 22 is a schematic view of a head structure of an ink jet recording apparatus shown in FIG. 19.

FIG. 22 is a schematic drawing of the ink ejecting side of the multiple nozzle head 702, as seen from the direction indicated by an arrow mark Z, and depicts the ink ejection openings of the multiple nozzles of the head 702. In this drawing, a referential Figure 801 designates each of a large number of the nozzles of the head 702. Although these nozzles are aligned in a single line, parallel to the direction Y in this drawing, the line of their alignment may be given a slight inclination relative to the direction Y (or X). When the line of the nozzle alignment is inclined, the ejection timing with which each nozzle is caused to eject ink while the head 702 is moved in the direction X to print an image is adjusted in accordance with the angle of the nozzle alignment.

Again referring to FIG. 21, a referential Figure 703 designates a conveyor roller, which conveys the printing paper 707 in the direction Y as it is rotated, with a predetermined timing, in the direction indicated in the drawing while holding the printing paper 707 with help from an idler roller designated by a referential Figure 704. A roller designated by a referential Figure 705 is also a conveyor roller, which conveys the printing paper 707, and also plays a role in holding the printing paper 707 as do the rollers 703 and 704. A referential Figure 706 designates a carriage, which supports four ink cartridges, and moves them to print images. The recording apparatus is designed so that when the apparatus is not in operation, or when the apparatus is in operation, but is restoring he performance of the multiple nozzle head 702, instead of printing an image, the carriage remains at a home position (h) outlined with a dotted line in the drawing. Before the starting of a printing operation, the carriage 706 is at the home position, and as the printing operation is started, it moves in the direction X in FIG. 21, and as it moves, the nozzles 801 of the multiple nozzle head 702, the number of which is n, print an image, which has a width of D. In the case of a commonly used serial type recording apparatus, an image is formed on the printing paper 707 by alternately repeating the movement of the carriage 706 in the primary scanning direction, and the conveyance of the printing paper 707 in the secondary scanning direction.

In FIG. 21, a component designated by a referential Figure 710 is a heater, which is positioned to directly oppose the multiple nozzle head 702. During a printing operation, the printing paper 707 is conveyed through the gap between the multiple nozzle head 702 and the heater 710 while the heater 710 heats the printing paper 707 from the side opposite to the multiple nozzle head 702. More specifically, the heater 710 is positioned so that it heats the printing paper 707 across the area across which the multiple nozzle head 702 scans in the primary direction.

Figure 23:
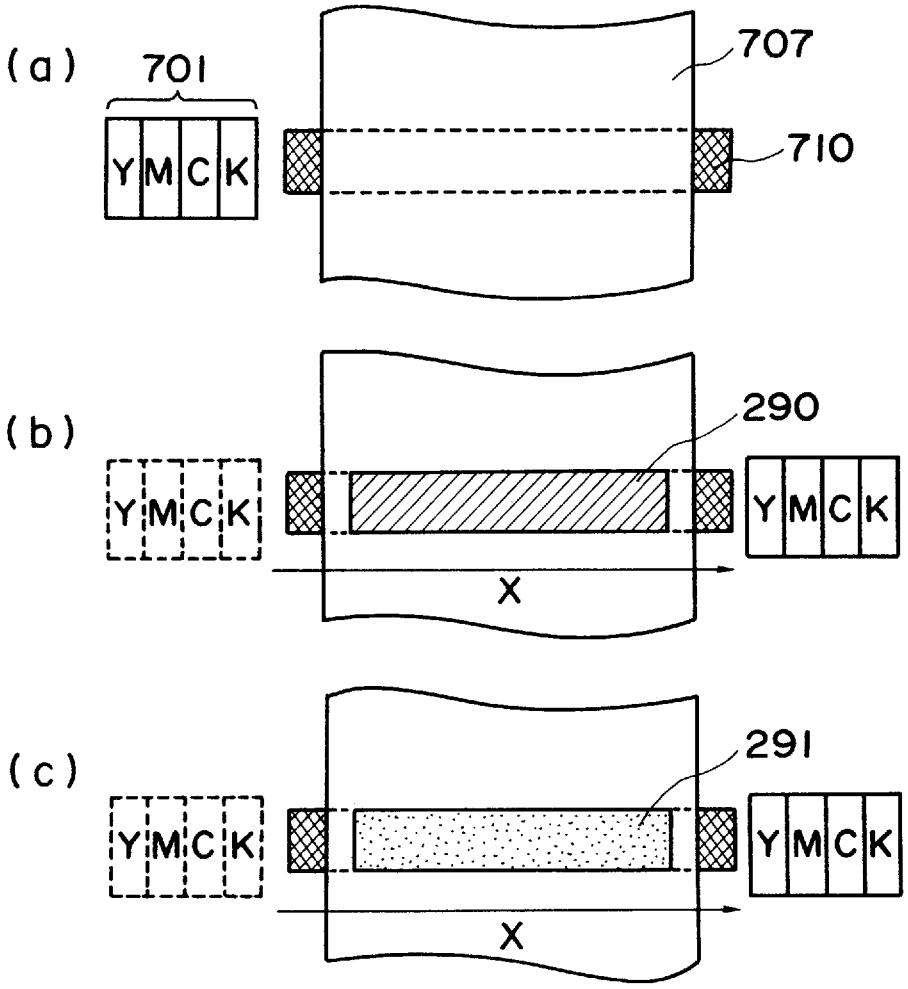
FIGS. 23(*a*)–23(*c*) are illustrations print state of an ink jet recording apparatus shown in FIG. 19.

FIG. 23, (a) is a schematic plan view of the printing section of the recording apparatus, and FIG. 23, (b) illustrates the image portion printed during the first of a pair of scanning runs of the carriage 706, during which the carriage 706 was caused to scan in the primary scanning direction X. During the first scanning tun of the carriage 706, only the head cartridge K for the black ink was activated to eject the black ink on the printing paper 707, across an area 290. FIG. 23, (c) illustrated the same image portion as the one in FIG. 23, (b), after the second run of the carriage 706, during which the head cartridge 701 was caused to scan again in the primary scanning direction X, while the cartridges Y, M, and C for yellow, magenta, and cyan colors, respectively, were activated to eject the color inks on the printing paper 707, across the area 291 (290). The printing paper 707 was not conveyed after the completion of the first scanning run of the carriage 706, until the first of the next set of scanning runs of the carriage 7.

The area 290 in FIG. 23, (b) and the area 291 in FIG. 23, (c) are the same; in this embodiment, the recording with the black ink on the area 290, and the recording with the color inks other than the black ink on the area 291 (290), are carried out during the different printing runs in the primary scanning direction.

While the carriage 705 is returned to the initial position to begin the following scanning run after the completion of the recording with the black ink, the ink fixation progresses in the area on which the image portion has been recorded with the black ink. This process in which the ink fixation occurs is the same as the ink fixation process described before. During this ink fixation process, the penetration of the black ink into the printing paper 707 is well restricted, and therefore, even when a recording is made with the other color inks on the same area, the image portion recorded with the black ink and the image portions recorded with the other color inks do not interfere with each other, an therefore, high image quality can be realized.

Figure 24:
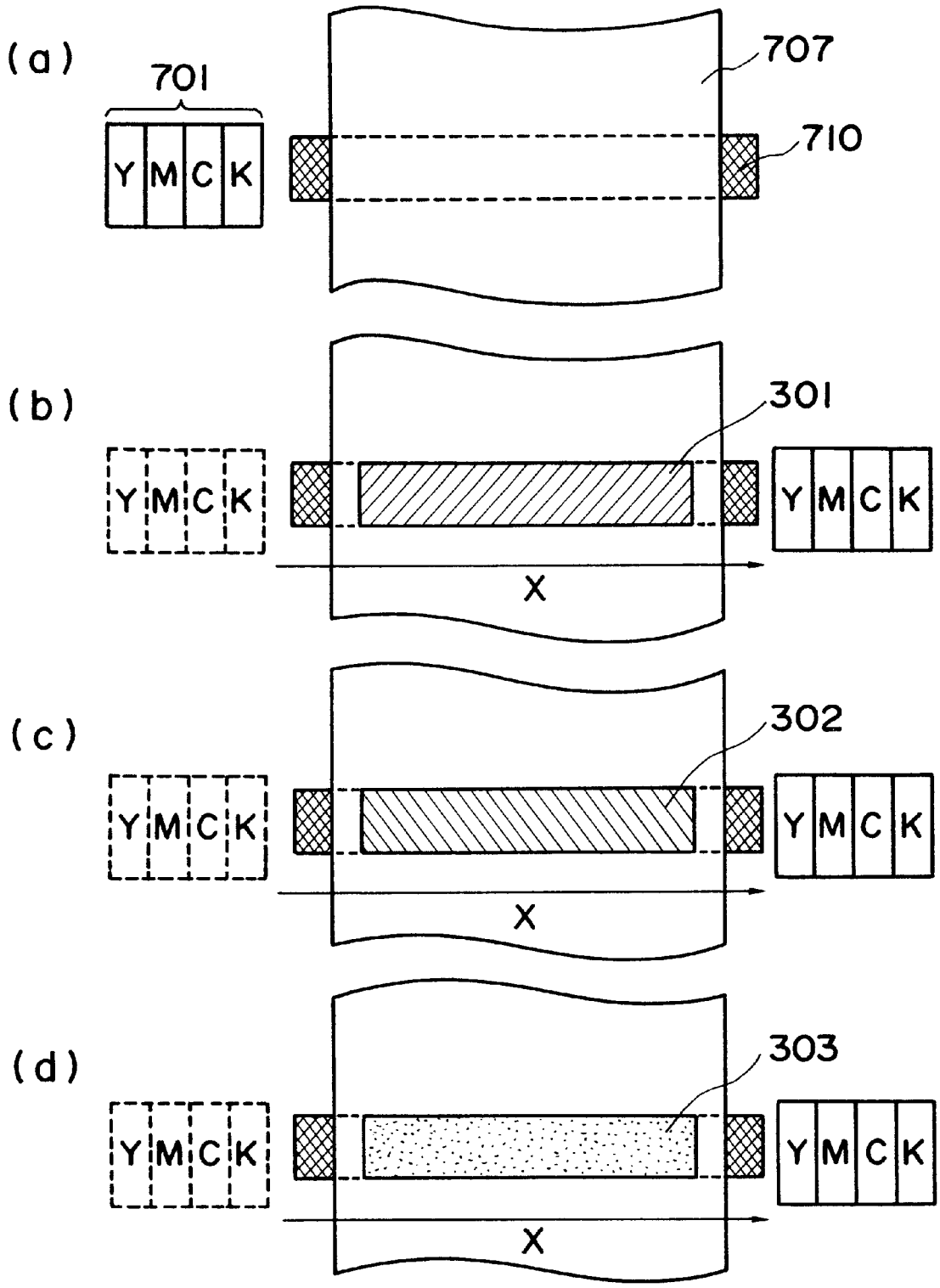
FIGS. 24(*a*)–24(*d*) are illustrations of another print state provided by the ink jet recording apparatus shown in FIG. 19.

FIG. 24, (a) is a schematic plan of the same printing section of the recording apparatus as that in FIG. 21. FIG. 24, (b) shows the image portion printed after the first of a set of three scanning runs of the head cartridge 706, during which the head cartridge 706 was caused to scan in the primary scanning direction X. During the first scanning run of the carriage 706, only the head cartridge portion K for the black ink was activated to eject the black ink on the printing paper 707, across an area 301 which extended in the primary scanning direction. FIG. 24, (c) illustrates the same image portion as the one in FIG. 24, (b), after the second run of the cartridge 706. After the first run of the cartridge 706, the printing paper 707 was not conveyed. During the second run of the carriage 706, only the head cartridge portion K for the black ink was used to record the image portion across the area 302 which extended in the primary scanning direction.

FIG. 24, (d) shows the same area as the areas in FIGS. 24, (b) and (c), after the third scanning run of the carriage 706. After the second run of the carriage 706 in the primary scanning direction illustrated in FIG. 24, (c), the printing paper 707 was not conveyed. During the third run of the carriage 706, the head cartridge portions Y, M and C for ejecting the yellow, magenta, and cyan inks, respectively, are used to record the image portion across the area 303 which extended in the primary scanning direction. This printing arrangement depicted by FIG. 24 produces the effect of increasing the density of the image portion record with the black ink, in addition to the effects produced by the printing arrangement depicted by FIG. 23.

Next, the embodiments of the present invention, the gist of which are depicted by FIG. 23 or 24 will be described in more detail. In the drawings, which will be referred to in the following description of the present invention, the portion of the printing paper 707 penetrated by a single ink droplet is indicated by hatching; the portion penetrated by two ink droplets, by cross hatching; and the portion penetrated by three ink droplets is indicated by a grid pattern formed of vertical and horizontal lines.

Embodiment 1

Figure 25:
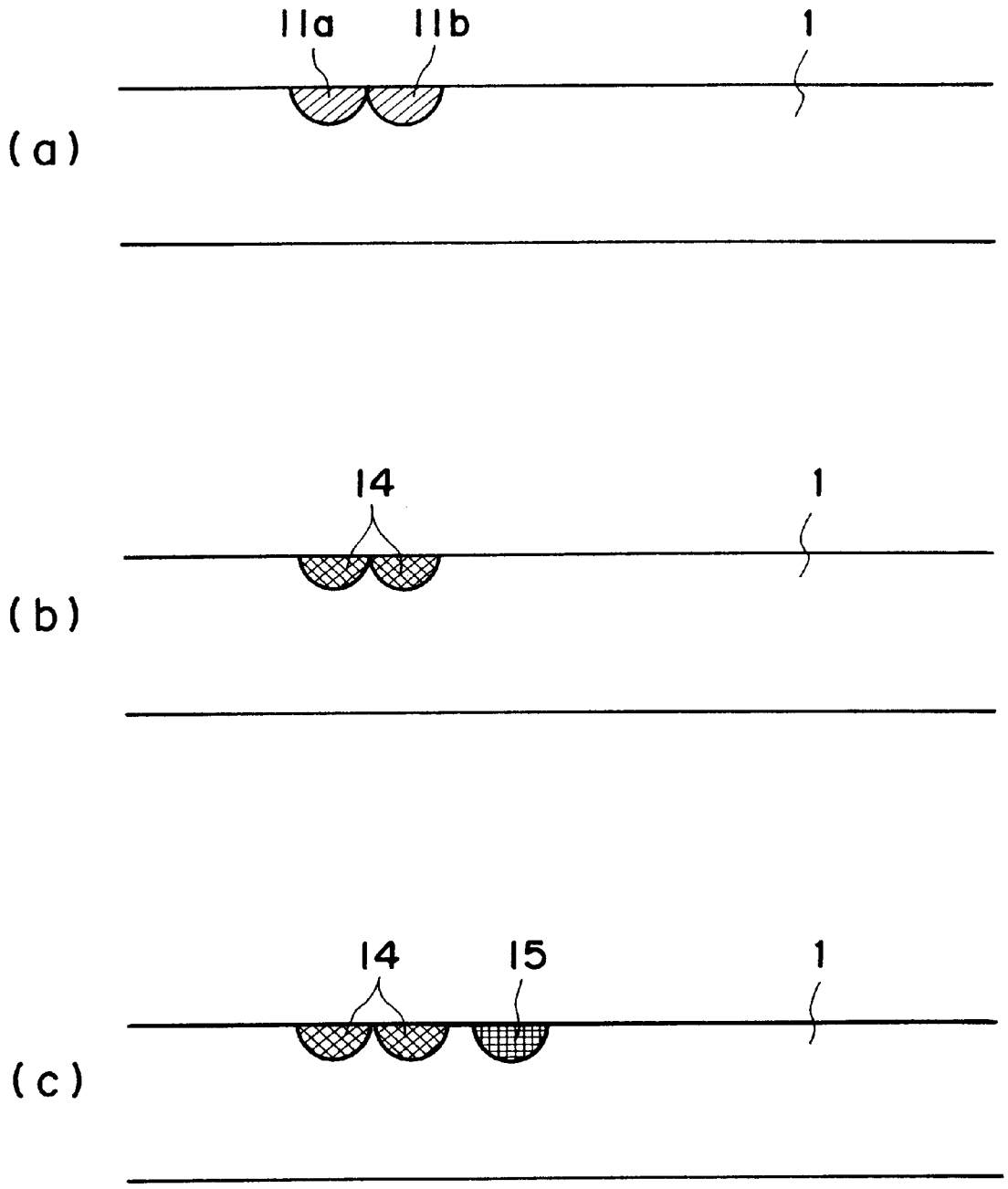
FIGS. 25(*a*)–25(*c*) are illustrations of an ink droplet formation state according to an ink jet recording method of first embodiment of the present invention.
Figure 26:
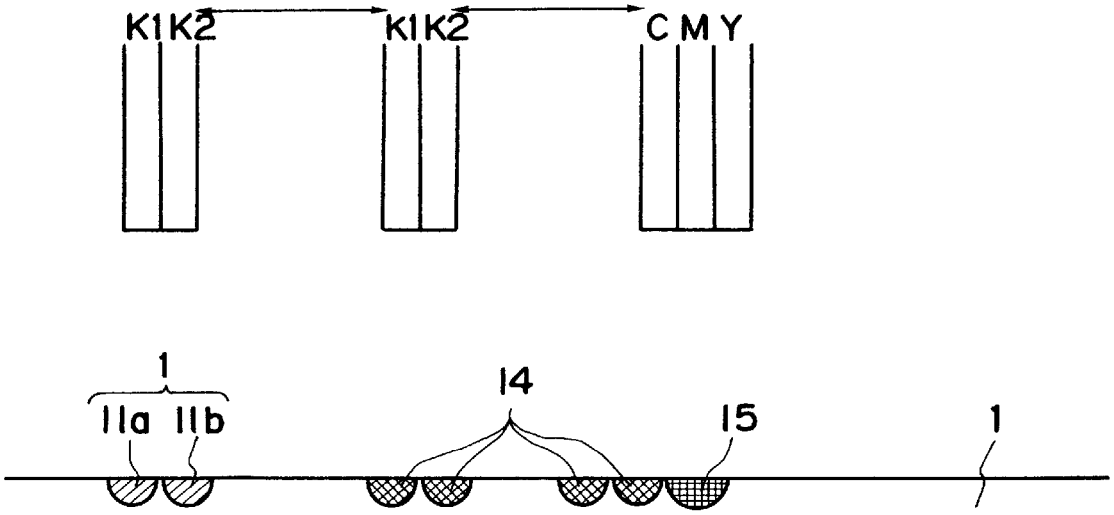
FIG. 26 is an illustration of first embodiment.

Referring to FIG. 25, during the first rightward scanning movement of a carriage 7, the black ink is ejected from the black ink ejecting portions K1 and K2 onto an ordinary paper 1, forming the first run ink droplets 11*a* and 11*b*, illustrated in FIG. 25, (a). After the completion of the first rightward run, the carriage 7 moves in the opposite direction, back to the initial position, without ejecting the ink. Then, the second run of the carriage begins. During this second run, the black ink is ejected again from the black ink ejecting portions K1 and K2 onto the ordinary paper 1, completing the black ink dots 14, illustrated in FIG. 25, (b). After the completion of the second rightward ran, the carriage 7 moves again in the opposite direction, back to the initial position, without ejecting the ink. Then, the carriage 7 makes the third scanning run. During this third run, the inks are ejected from the ink ejecting portions C, M and Y for the color inks (cyan, magenta and yellow color inks), onto the ordinary paper 1, forming a color dot 15, illustrated in FIG. 25, (c). After the completion of the third run, the carriage 7 moves again in the opposite direction, back to the initial position, to and a set of three scanning runs for completing a single line of printing. During these three scanning runs of carriage 7, ceramic heaters 10 are always kept on to continuously heat the ordinary paper 1.

Therefore, with reference to any given spot on the ordinary paper 1, ink is ejected onto this spot first from the back ink ejecting portions K1 and K2, and the ejected ink and this spot are continuously heated for 1.5 seconds, that is, for the length of time it takes for the carriage 7 to shuttle once across the recording range in the primary scanning direction. By this heating, the penetration of the first run ink droplets 11*a* and 11*b* into the ordinary paper 1 is controlled so that the depth to which the ink droplets 11*a* and 11*b* penetrate becomes lessor compared to when heat is not applied. Then, during the following scanning run of the carriage 7, the black ink droplets are ejected from the black ink ejecting portions K1 and K2, onto the same spot, in other words, they are overlaid upon the first run ink droplets 11*a* and 11*b*. Then, these second run ink droplets and this spot are heated for 1.5 seconds, that is, for the length of time it takes for the carriage to shuttle once across the recording range in the primary scanning direction. As a result, a black color dot 14 is formed by the first run ink droplets and the second run ink droplets, as illustrated in FIG. 25, (b). Next, the carriage 7 makes the third scanning run, and during this run, the color inks are ejected from the ink ejecting portions C, M and Y, producing a color dot 15 formed of the third run ink droplets. Thereafter, the carriage 7 is caused to shuttle at least once. Thus, the color ink droplets and the spot are heated for at least 1.5 seconds. It should be noted here that during the third run of the carriage 7 for forming the color dot 15, the color inks are ejected from the ink ejection portions C, M and Y in an optional combination to produce a dot of a desired color; the dot 15 is formed by a single ink droplet or a plurality of ink droplets.

In the case of the above-described printing operation, by the time the color inks are ejected from the ink ejecting portions C, M and Y, the first run ink droplets 11*a* and 11*b* are heated for three seconds, and the second run ink droplets are heated for 1.5 seconds, whereby the ink droplets are controlled in terms of the depth to which they penetrate into the ordinary paper 1. As a result, the ink concentrates in the portion close to the surface of the ordinary paper 1, in other words, coloring components do not disperse much. In addition, the light which enters the ordinary paper 1 is reflected in the position closer to the surface. Therefore, the recorded image appears vivid. Further, since the ink used in this embodiment are penetrative, they do not remain in the indentations at the surface of the ordinary paper 1. Therefore, the black ink does not bleed from the black dot into the adjacent color dot 15. Further, because the liquid components of the inks are evaporated by heating, the viscosities of the inks are increased, which makes it difficult for the inks to bleed at the borderline between the image portion of one color and the image portion of another color Further, the dissolvability of the coloring agent into the solvent is reduced by the evaporation of the solvents in the inks, which produces the effect of making it easier for the coloring agent to adhere to the ordinary paper 1.

As described above, an image recorded using the printing sequence in this embodiment shows not only a characteristic peculiar to penetrative ink, that is, the ink does not remain in the indentations at the surface of an ordinary paper, but also a characteristic peculiar to non-penetrative ink, that is, the ink concentrates in the portion close to the surface. In other words, this embodiment enjoys the merits of both types of ink; clear and vivid images can be produced while minimizing the bleeding.

The ink droplet ejected during the preceding scanning run of the carriage 7 may be still penetrating, or may have finished penetrating, into the ordinary paper 1, 1.5 seconds after the ejection, that is, at the time when ink is ejected during the following scanning run of the carriage 7.

Embodiment 2

Figure 27:
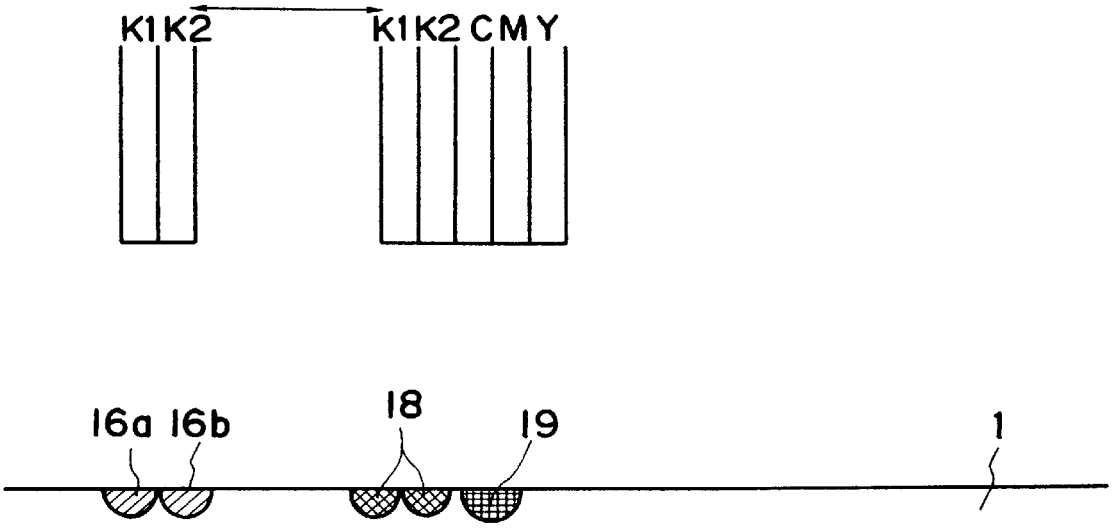
FIG. 27 is an illustration of a second embodiment.

FIG. 27 is a schematic drawing which depicts the second embodiment, that is, the printing sequence, of the present invention. In this printing sequence, the second ejection of the black ink, and the ejection of the color inks are carried out at the same time during the second of a pair of scanning runs of the carriage 7.

With reference to any given spot of the ordinary paper 1, first, the black ink is ejected to the spot by the black ink ejecting portions K1 and K2, and the spot, along with the ink, is heated for 1.5 seconds, that is, for the length of time it takes for the carriage 7 to shuttle once. The penetration of the black ink droplets 16*a* and 16*b* is controlled by this heating; the depth to which the ink droplets 16*a* and 16*b* penetrate is reduced. Then, the carriage 7 is caused to shuttle again, an during this run of the carriage, the black ink is ejected from the black ink ejecting portions K1 and K2 onto the same spot for the second time, and the color inks are ejected from the color ink ejecting portions C, M and Y, completing a black dot 18 and a color dot 19 immediately adjacent to each other. Thereafter, the inks which have formed the black dot 18 or the color dot 19, and the spot, are heated for 1.5 seconds, that is, the time it takes for the carriage 7 to shuttle once.

This printing sequence is different from the preceding printing sequence only in that it is during the second scanning rim of the carriage when the black dot 18 is completed by the second ejection of the black ink, and the color dot 19 is formed. Otherwise, the printing steps or this printing sequence are the same as those of the first embodiment it should be noted here that even though the second recording with the black ink, and the recording with the color inks, occur during the same scanning run, that is, the second scanning run, of the carriage 7, a substantial portion of the black ink penetrates into the ordinary paper 1 before the recording with the color inks begins, and therefore, bleeding is not likely to occur. Thus, this printing sequence also produces effects, similar to those of the first embodiment, of making it possible to recording clear and vivid images while minimizing the bleeding.

Embodiment 3

Figure 28:
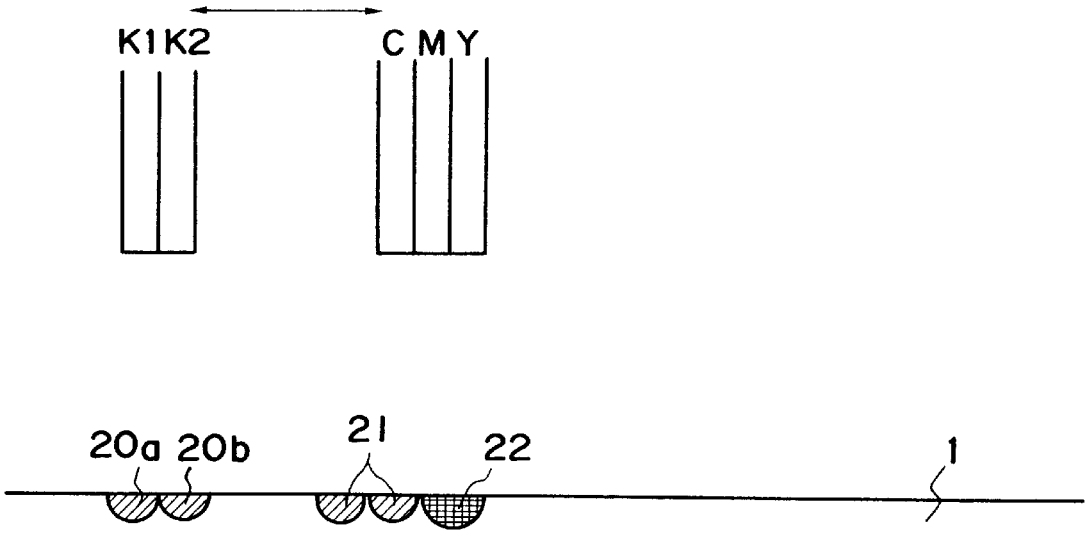
FIG. 28 is an illustration of a third embodiment.

FIG. 28 is a schematic drawing which depicts the third embodiment of the present invention, or the third printing sequence in accordance with the present invention. This printing sequence is such a printing sequence that the black ink droplet is not ejected onto the same spot, or overlaid.

More specifically, with reference to any given spot on the ordinary paper 1, first, the black ink is ejected onto the spot by the black ink ejecting portions K1 and K2, and the spot, along with the ink, is heated for 1.5 seconds, that is, for the length of time it takes for the carriage 7 to shuttle once. The penetration of the black ink droplets 20*a* and 20*b* is controlled by this heating; the depth to which the ink droplets 20*a* and 20*b* penetrate is reduced. Then, the carriage 7 is caused to shuttle again, and during this run of the carriage, the color inks are ejected from the color ink ejecting portions C, M and Y, forming a color dot 22 adjacent to a black dot 21 formed of black ink droplets 20*a* and 20*b*. Thereafter, the inks which have formed the black dot 21 or the color dot 22, and the spot, are heated for 1.5 seconds, that is, the time it takes for the carriage 7 to shuttle once.

This printing sequence is different from the first printing sequence only in that it is during the first scanning run of the carriage when the black dot 21 is formed by two black ink droplets 20*a* and 20*b*. Otherwise, the printing steps or this printing sequence are the same as those of the first embodiment. This printing sequence also produces effects, similar to those of the first embodiment, of making it possible to recording clear and vivid images while minimizing the bleeding.

Embodiment 4

Figure 29:
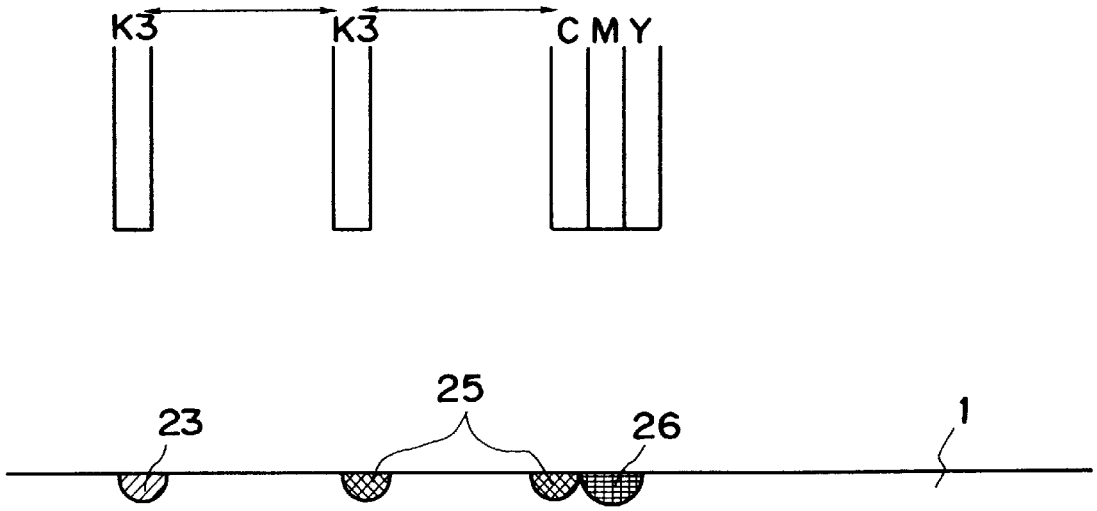
FIG. 29 is an illustration of a fourth embodiment.

FIG. 29 is a schematic drawing which depicts the fourth embodiment of the present invention, in which a recording head with only a single black ink ejecting portion K3 (unillustrated) is employed.

With reference to any given spot on the ordinary paper 1, first, the black ink is ejected onto the spot by the black ink ejecting portions K3, forming black dot 23, and the spot, along with the ink, are heated for 1.5 seconds, that is, for the length of time it takes for the carriage 7 to shuttle once. Then, the carriage 7 is caused to shuttle again, and during this run of the carriage, the black ink is ejected onto the same spot for the second time, finishing the dot 23 into the black dot 25. Thereafter, the inks which have formed the black dot 25, and the spot, are heated for 1.5 seconds, that is, the time it takes for the carriage 7 to shuttle once. Then, during the third scanning run of the carriage 7, the color inks are ejected from the ink ejecting portions C, M and Y, forming a color dot 26 right next to the black dot 25. Thereafter, the inks which have formed the black dot 25 or the color dot 26, and the spot, are heated for 1.5 seconds, that is, the length of time it takes for the carriage 7 to shuttle once.

Embodiment 5

Figure 30:
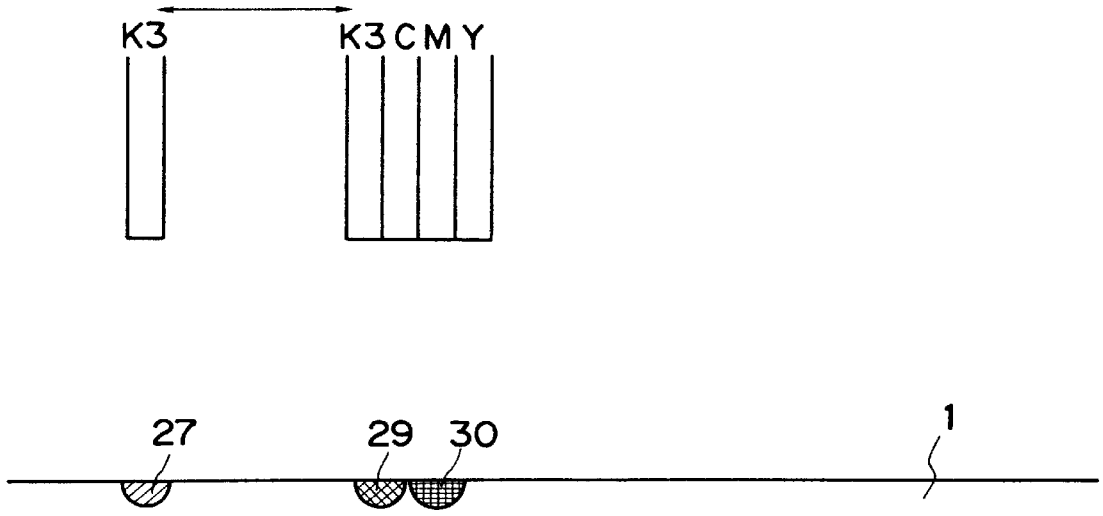
FIG. 30 is an illustration of a fifth embodiment.

FIG. 30 is a schematic drawing which depicts the fifth embodiment of the present invention. This printing sequence is such that the same recording head (unillustrated) as the one employed in the fourth embodiment is employed, and both the black ink and the color inks are ejected during the second of the pair of scanning runs of the carriage.

With reference to any given spot on the ordinary paper 1, first, the black ink is ejected onto the spot by the black ink ejecting portions K3, forming black dot 27, and the spot, along with the ink, is heated for 1.5 seconds, that is, for the length of time it takes for the carriage 7 to shuttle once. Then, the carriage 7 is caused to shuttle again, and during this run of the carriage, not only is the black ink ejected onto the same spot for the second time, finishing the dot 27 into the black dot 29, but also the color inks are ejected from the ink ejecting portions C, M and Y, forming a color dot 30. Thereafter, the inks which have formed the black dot 29 or the color dot 30, and the spot, are heated at least for 1.5 seconds, that is, the length of time it takes for the carriage 7 to shuttle once.

Embodiment 6

Figure 31:
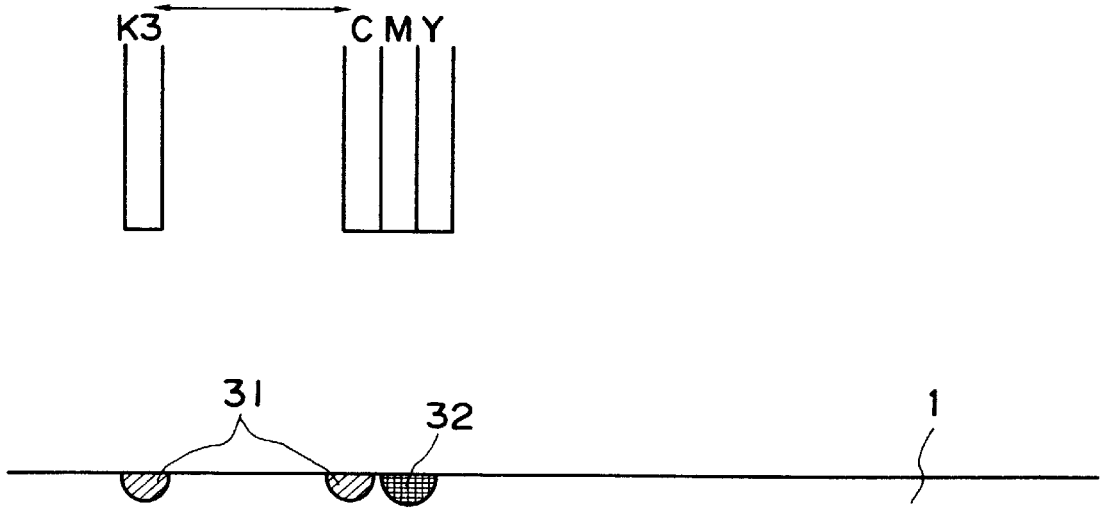
FIG. 31 is an illustration of a sixth embodiment.

FIG. 31 is a schematic drawing which depicts the sixth embodiment of the present invention. This printing sequence is such that the same recording head (unillustrated) as the one employed in the fourth embodiment is employed, and the black ink is not ejected twice onto the same spot, or overlaid.

More specifically, with reference to any given spot on the ordinary paper 1, first, the black ink is ejected onto the spot by the black ink ejecting portion K3. Then, the spot, along with the ink, is heated for 1.5 seconds, that is, for the length of time it takes for the carriage 7 to shuttle once. Then, the carriage 7 is caused to shuttle again, and during this run of the carriage, the color inks are ejected from the color ink ejecting portions C, M and Y, forming a color dot 32 right next to a black dot 31. Thereafter, the inks which have formed the black dot 31 or the color dot 32, and the spot, are heated or at least 1.5 seconds, that is, the time it takes or the carriage 7 to shuttle once.

Embodiment 7

Figure 32:
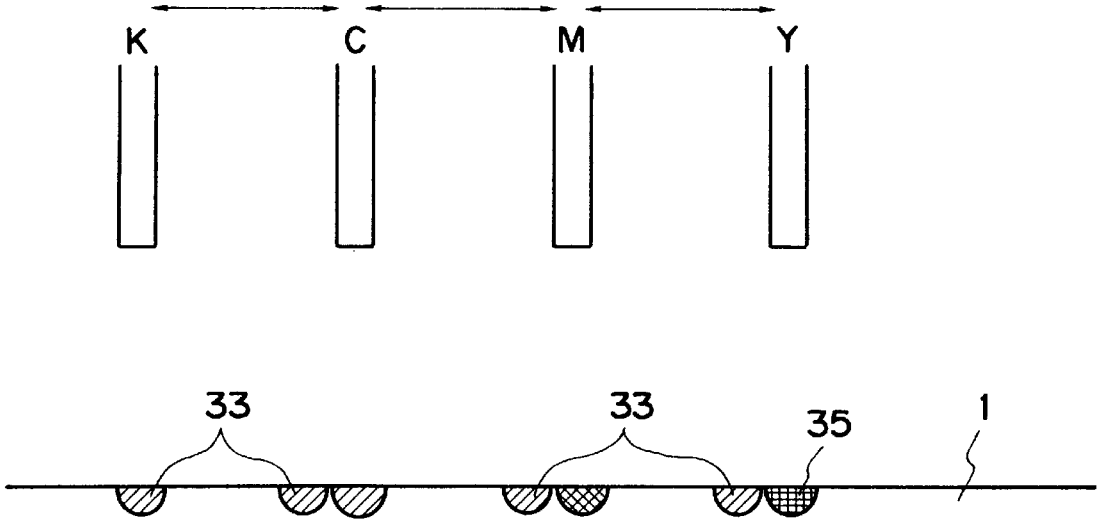
FIG. 32 is an illustration of a seventh embodiment.

FIG. 32 is a schematic drawing which depicts the seventh embodiment of the present invention. This printing sequence is such a printing sequence that the same recording head (unillustrated) as the one employed in the fourth embodiment is employed. With reference to any given spot on the ordinary paper 1, first, the black ink is ejected onto the spot by the black ink ejecting portions K, forming black dot 33. Then, the spot, along with the ink, is heated for 1.5 seconds, that is, for the length of time it takes for the carriage 7 to shuttle once. Then, the carriage 7 is caused to shuttle again, and during this run of the carriage, a color dot (for example, a cyan color dot) is formed. Then, the inks which have formed the black dot 33 or the color dot, and the spot, are heated for 1.5 seconds, that is, the length of time it takes for the carriage 7 to shuttle once. Then, the carriage 7 is caused to shuttle again, and during this run of the carriage 7, the color ink (for example, magenta ink) is ejected onto the same spot from one of the ink ejecting portions (for example, M). Thereafter, the inks which have formed the black dot or the color dot, and the spot, are heated for 1.5 seconds, that is, the time it takes for the carriage 7 to shuttle once. Next, the carriage 7 is shuttled again, and during this run of the carriage, another color ink (for example, yellow ink) is ejected onto the same spot from one of the ink ejecting portions (for example, Y), finishing the color dot into a final color dot 35. Thereafter, the inks which have formed the black dot 33 or the color dot 35, and the spot, are heated for at least 1.5 seconds, that is, the length of time it takes for the carriage 7 to shuttle once. In other words, in this embodiment, the color dot 35 is formed by ejecting each of the color inks during the scanning run of the carriage 7, which is dedicated to each ink.

Embodiment 8

Figure 33:
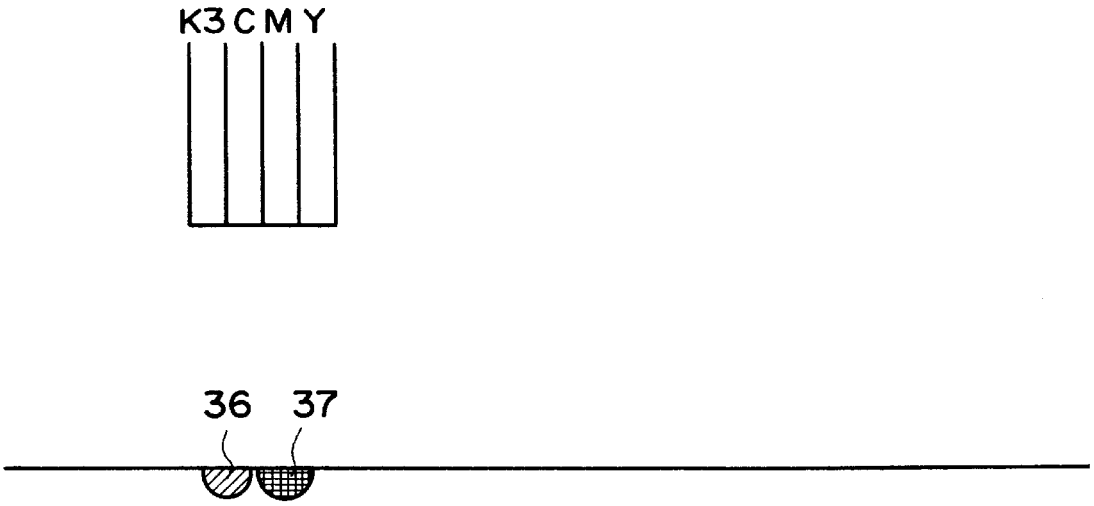
FIG. 33 is an illustration of an eighth embodiment.

FIG. 33 is a schematic drawing which depicts the eighth embodiment of the present invention, which is quite a contrast to the seventh embodiment. With reference to any given spot on the ordinary recording paper 1, the black ink, and the color inks, are ejected from the ink ejection portions K, C, M and Y at the same time during the only scanning run of the carriage 7, forming a black dot 36 and a color dot 37. Thereafter, the inks which have formed the black dot 36 or the color dot 37, and the spot, are heated for at least 1.5 seconds, that is, the time it takes for the carriage 7 to shuttle once.

Embodiment 9

Figure 34:
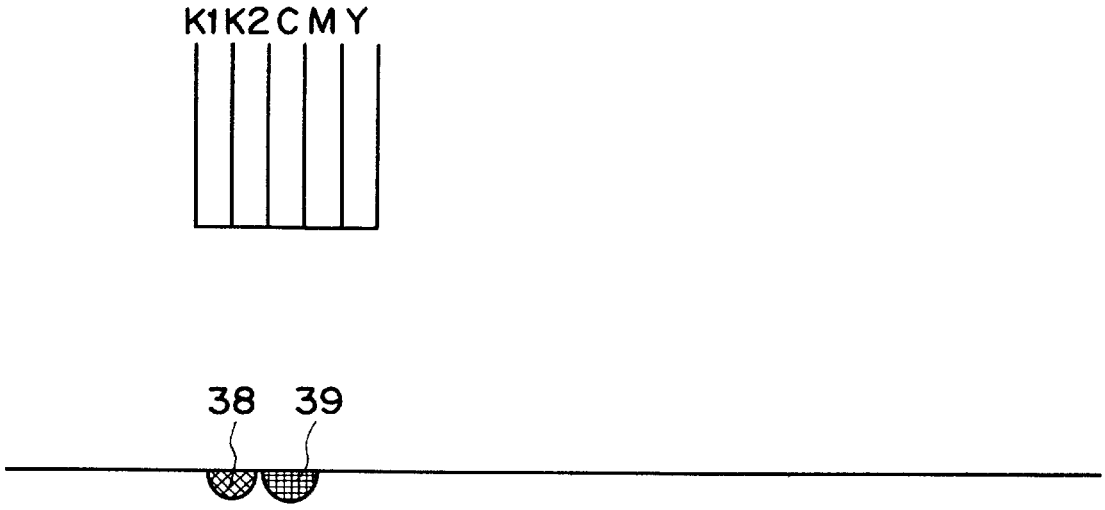
FIG. 34 is an illustration of a ninth embodiment.

FIG. 34 is a schematic drawing which depicts the ninth embodiment of the present invention. In this embodiment, a recording apparatus with two black ink ejecting portions (FIG. 13) is used. With reference to any given spot on the ordinary paper 1, the black ink, and the color inks, are ejected from the ink ejection portions K1, K2, C, M and Y at the same time during the only scanning run of the carriage 7, forming a black dot 38 and a color dot 39. Thereafter, the inks which have formed the black dot 36 or the color dot 37, and the spot, are heated for at least 1.5 seconds, that is, the time it takes for the carriage 7 to shuttle once.

In the above description of the embodiments of the present invention, the arrangement for controlling the penetration depth of the black ink by heating the black ink on the recording paper, and the recording paper, after the ejection of the black ink, was discussed in detail. This arrangement also applies to the color inks. In other words, the color inks on the recording paper, and the recording paper, are heated after the color ink ejection. As a result, the penetration depth of the color inks is controlled, producing the effects of improving the clarity and vividness of an recorded image, while preventing the bleeding such as the one that occurs at the borderline between the areas of different colors.

Figure 35:
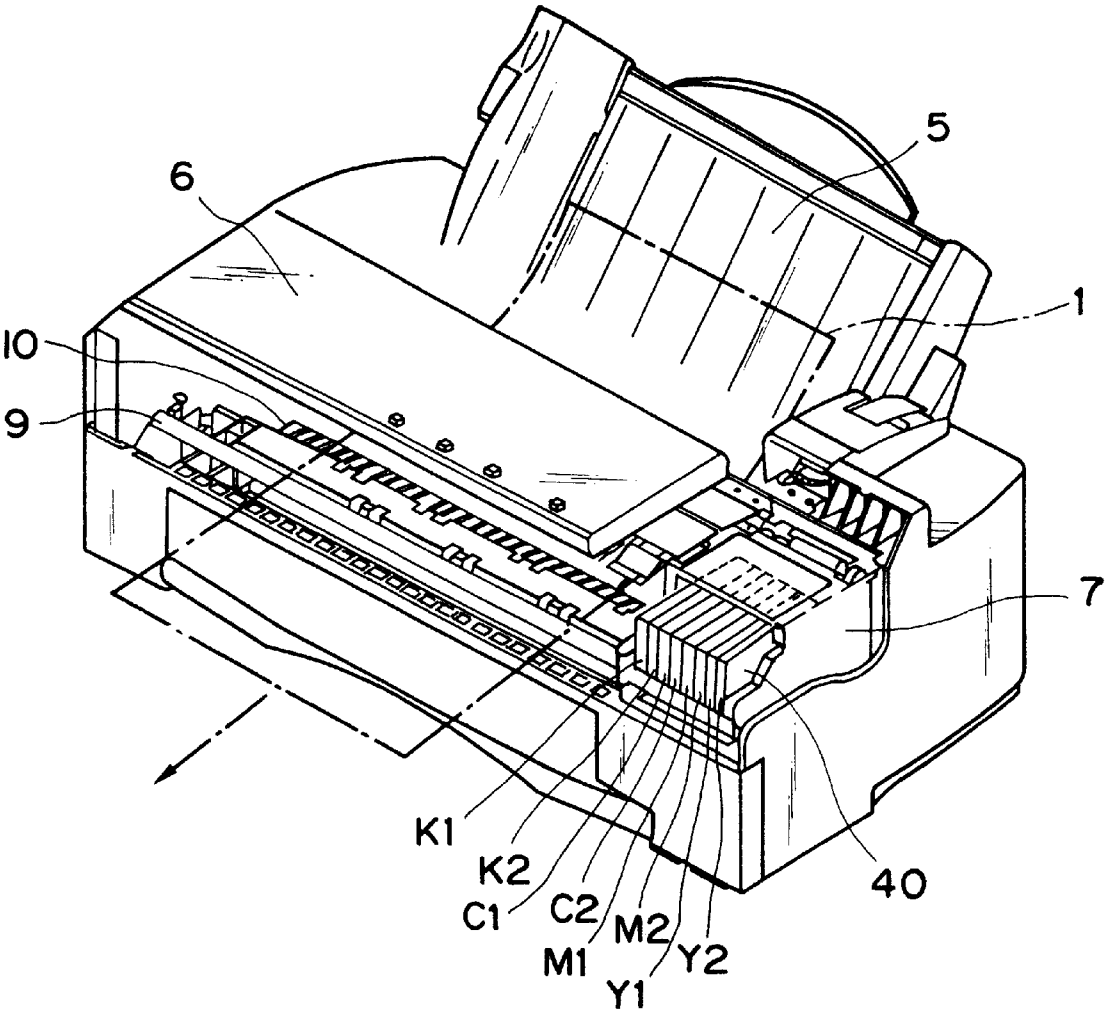
FIG. 35 is a perspective view of another example of the present invention.

In the preceding embodiments, the color inks are highly penetrative inks, and are ejected only once during a set of scanning runs of the carriage 7. However, if semi-penetrative color inks, which have an Acetylenol percentage of approximately 0.4% are used, the effects of the present invention become more remarkable. Further, the color inks may be ejected onto the same spot twice or more, or the color ink droplets may be overlaid on the same spot. In such a case, it is recommended that the spots onto which the color inks are ejected during the second scanning run of the carriage 7 are slightly shifted from the spots onto which the inks are ejected during the preceding scanning run. Further, an ink jet recording apparatus, illustrated in FIG. 35, the recording head 40 of which comprises two or more ink ejecting portions for each ink (in this embodiment, two for each ink), may be used. With the use of this type of recording apparatus, the color ink droplets can be overlaid without increasing the number of scanning runs of the carriage 7. Further, the carriage 7 may be cause to make a desirable number of scanning runs after the completion of any of the above described printing sequences, so that the color inks are ejected from the ink ejecting portions C, M and Y, during these runs of the carriage 7, and then, the carriage 7 may be returned to the initial position after these additional scanning runs.

Regarding each at the preceding embodiments, in the case that ink is ejected only once during each movement of the carriage in the primary scanning direction, the amount of ink ejected from each nozzle is approximately 50 pl. In the case of ejecting the ink twice, 20–30 pl of ink is ejected from each nozzle during each scanning run of the carriage 7, to form a dot with approximately 50 pl of ink. In the case that a recording apparatus is equipped with two black ink ejecting portions K1 and K2, and a black dot is formed by ejecting the black ink onto the same spot four times, the amount of the ink used to form a single dot is approximately 100 pl.

in the case that ink is ejected onto the same area twice or more to form a single dot, the ink may be ejected onto the same spot twice or more, or onto two or more spots slightly part from each other and arranged in a zigzag or interlacing pattern. In the latter case, in order to form a single dot when resolution is set to 360×360 dpi, the ink is ejected at a rate equivalent to a resolution of 720×360 dpi. The size or volume of the ink droplet ejected each time may be different from that of the ink droplet ejected other times (for example, a smaller ink droplet is ejected first, and a larger ink droplet is ejected onto the spot on which the smaller ink droplet has landed, or vice versa). However, in the case of ejecting two or more ink droplets of different size, or ejecting the ink onto two or more spots different in location, to form a single dot, it is desirable that the two or more ink droplets be caused to overlap with each other, at least partially, as they land.

In each of the preceding embodiments, the ink ejection portions were disposed perpendicular to the direction in which the ordinary paper 1 was conveyed, that is, the primary scanning direction, in alignment with each other in a single row in the above direction, and also in parallel to each other. However, the ink ejecting portions may be differently disposed; they may be disposed in parallel to the direction in which the ordinary paper 1 is conveyed, that is, the secondary scanning direction, and also in alignment with each other in a plurality of rows, for example, in two rows, three rows, and the like. For example, an arrangement may be made so that a black ink ejecting portion is disposed in the first row, or the row correspondent to the first pass, and color ink ejection portions are disposed in the second row, or the row correspondent to the second pass, wherein the black ink ejecting portion, and the color ink ejecting portions are independently movable from each other. In such a case, a black ink ejecting portion different from the one in the first row may be disposed in the second row, or the row correspondent to the second pass.

Further, the color ink ejection portions C, M and Y may be separated from each other, being disposed in the second, third and fourth rows, respectively. In such a case, ceramic heaters may be arranged so as to correspond to all rows, or only one of the rows.

Also in the preceding embodiments of the present invention, the present invention was described with reference to serial type recording apparatuses, in which a recording head mounted on a carriage was moved back and forth in the direction in which recording medium was conveyed. However, the present invention is also compatible with full-line type recording apparatuses, which employ a so-called full-line type recording head in which a large number of liquid ejection nozzles are aligned in the width direction of recording medium, covering the entire width of the recording medium.

Embodiment 10

Figure 36:
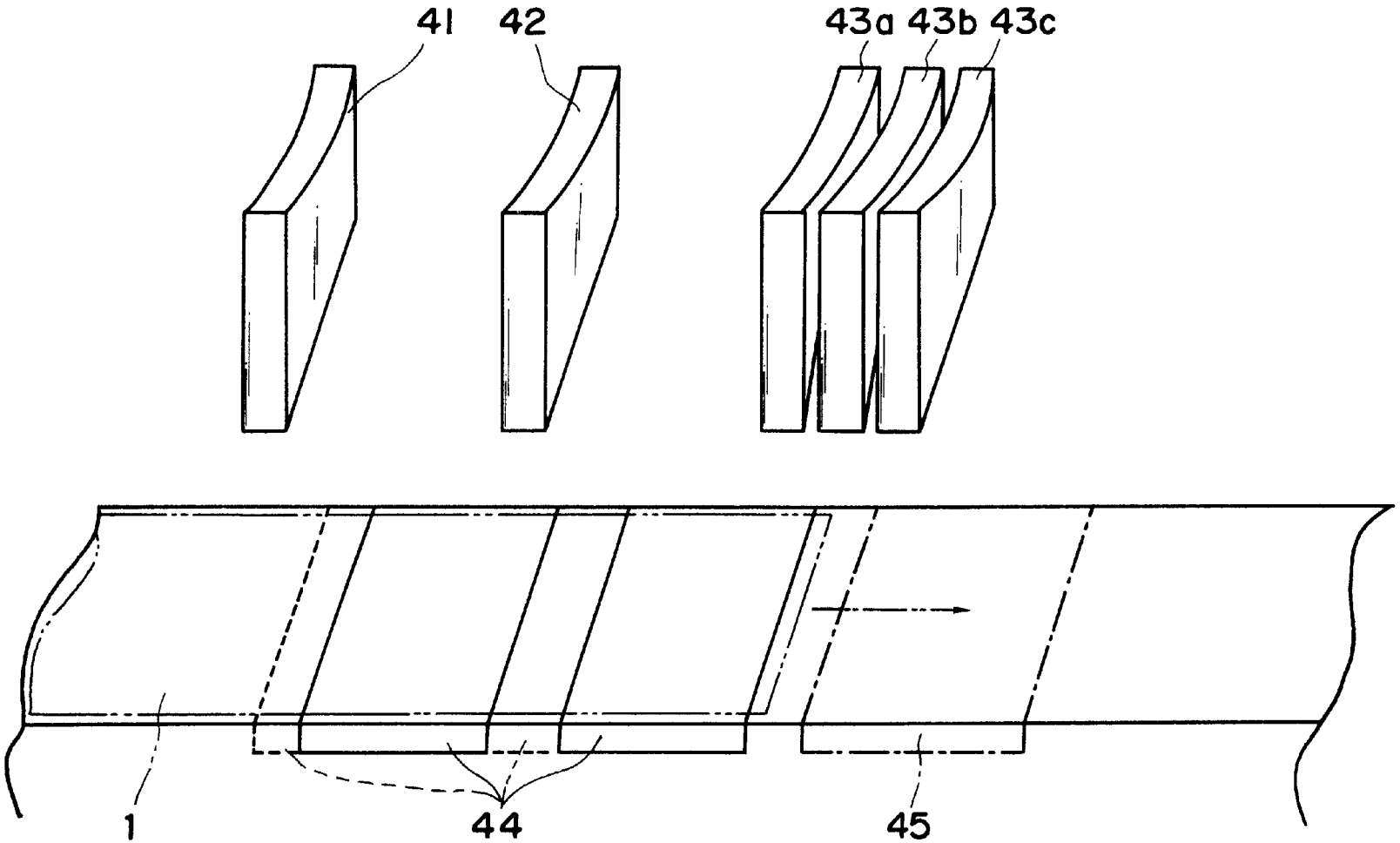
FIG. 36 is an illustration of a tenth embodiment.

FIG. 36 is a schematic drawing which depicts the tenth embodiment of the present invention. In this embodiment, a first black ink ejecting head 41, a second black ink ejecting head 42, and a cluster of color ink ejecting heads 43*a*, 43*b* and 43*c*, are disposed with a predetermined space between the heads 41 and 42, and between the heads 42 and 43*a*. All the ink ejecting heads 41, 42, 43*a*, 43*b* and 43*c* are long enough to cover the ordinary paper 1 as the recording medium, across the entire width, and are provided with a large number of liquid nozzles, which are aligned in the width direction of the ordinary paper 1, covering the ordinary paper 1, across the entire width. The ordinary paper 1 is conveyed in the direction (indicated by an arrow mark) perpendicular to the lengthwise direction of the ink ejecting heads. Below the above-described spaces, ceramic heaters 44 as heating means are located. The time it takes for the ordinary paper 1 to be conveyed across one of these spaces (for example, 1.5 seconds) matches the interval between a point in time at which ink is ejected onto any given spot on the ordinary paper 1 the first time, and a point in time at which ink is ejected onto the same spot the second time. With this arrangement, practically the same image recording process as the one described in the fourth embodiment depicted in FIG. 29 can be carried out. The ceramic heaters 44 may be positioned directly below the ink ejecting head 41 and 42 (locations indicated by dotted lines). It a ceramic heater 45 is provided to heat the inks and the ordinary paper 1 also after the ejection of the color inks, the effect of this embodiment are enhanced.

Embodiment 11

Figure 37:
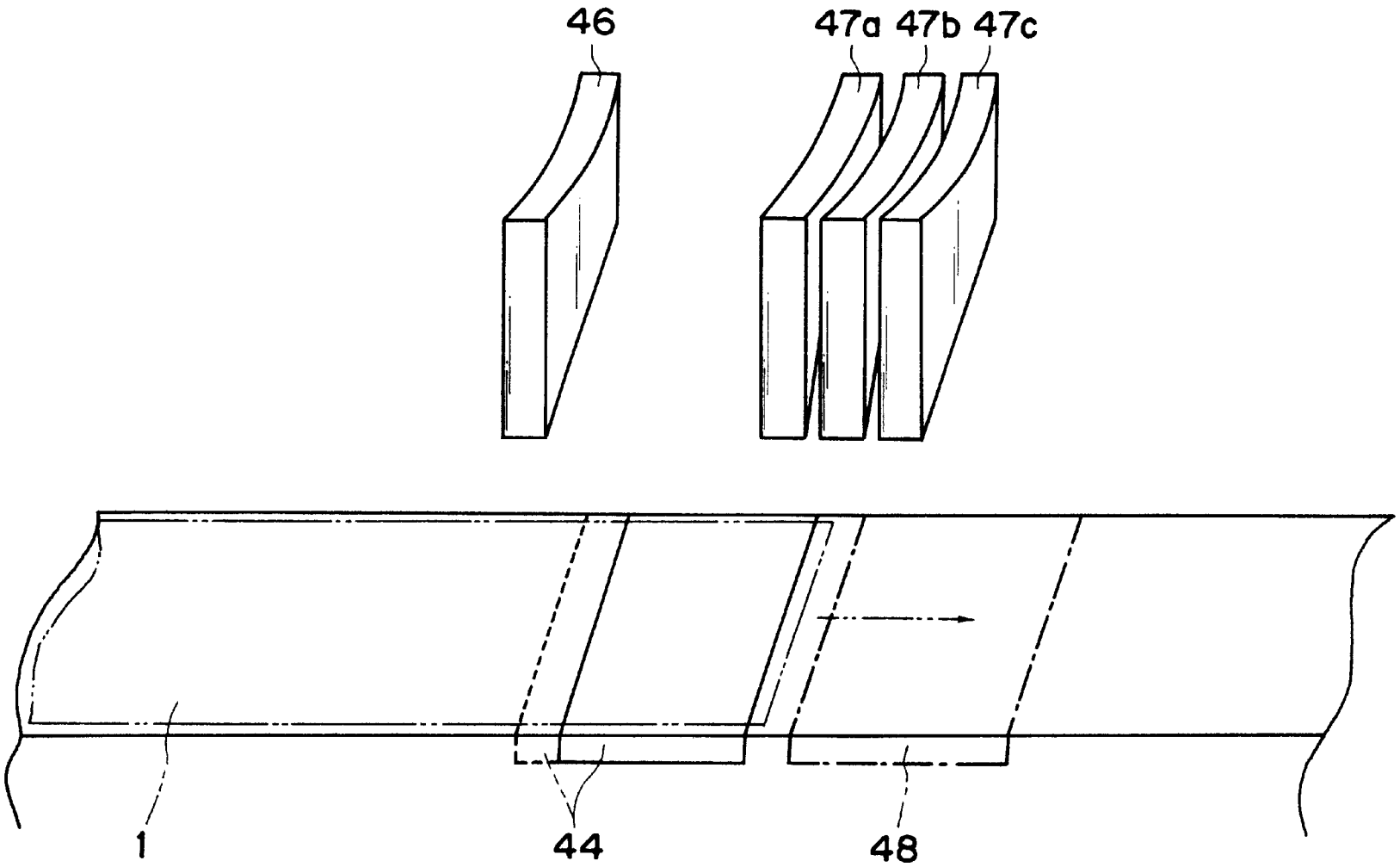
FIG. 37 is an illustration of an eleventh embodiment.

In the eleventh embodiment of the present invention depicted by FIG. 37, the printing section is similar to the printing section in the tenth embodiment, except that it lacks one of the black ink ejecting heads. In other words, the black ink ejecting head 46, and the cluster of the color ink ejecting heads 47*a*, 47*b* and 47*c*, are disposed with a space between the heads 46 and 47*a*. With this arrangement, practically the same printing process as that in the sixth embodiment can be carried out, at any given spot on the ordinary paper 1 as the recording medium. The ceramic heaters may be directly below the black ink ejecting head 46, or diagonally below the cluster of the color ink ejecting heads 47*a*, 47*b* and 47*c*, on the downstream side relative to the paper conveyance direction, as is a ceramic heater 44 or 48 in the drawing.

In other words, in this embodiment, the full-line heads are disposed with a space between the black ink ejecting head, and the most upstream color ink ejecting head, relative to the paper conveyance direction, and the distance between the two heads is set in accordance with the ink ejection interval in time and the speed at which the ordinary paper is conveyed. Further, a heating means is positioned below the space between the two heads. With such an arrangement, it is possible to provide a recording apparatus which can carry out practically the same printing process as those in the preceding embodiments in which a serial type recording head was employed.

Figure 38:
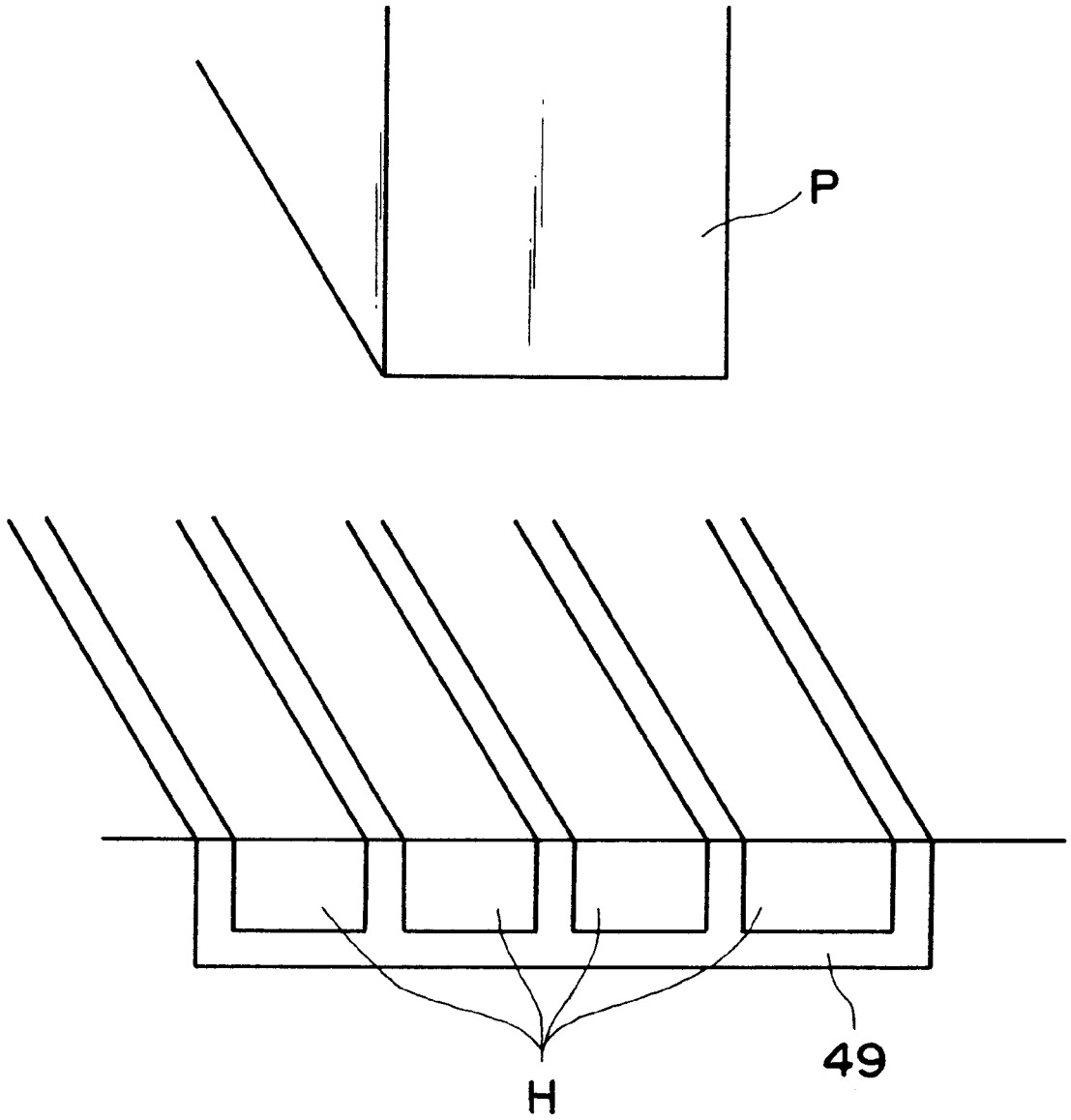
FIG. 38 is a sectional view of a ceramic heater which is a heating means.

Referring to FIG. 38, the ceramic heaters H in the preceding embodiments are desired to be covered with thermally insulative material 49. The ceramic heaters R may be replaced with heating means of a different type, for example, the halogen lamp heaters 187*a* and 187*b* illustrated in FIG. 20. The present invention is compatible with both the structures with ceramic heaters and the structures with halogen lamp heaters, and also both the serial type apparatuses and the full-line type apparatuses.

Embodiment 12

In the first embodiment and some others, in order to increase the density of an image portion with black color, and to better fix the black ink to prevent the interference between the ink from one dot and the ink from another dot formed immediately adjacent to the first dot, the image portion was recorded by causing the carriage 7 to scan the same area twice, that is, by ejecting the black ink onto the same spot twice as illustrated in FIG. 25, (b). This embodiment is substantially the same as the first embodiment and some others, except that in order to produce the same effects as those in the first embodiment and some others, the black dots are formed in such a manner that a set of the black dots formed during the first of the pair of the scanning runs of the carriage 7 in the primary scanning direction, and another set of the black dots formed during the second run of the carriage 7, interlace with each other.

Figure 39:
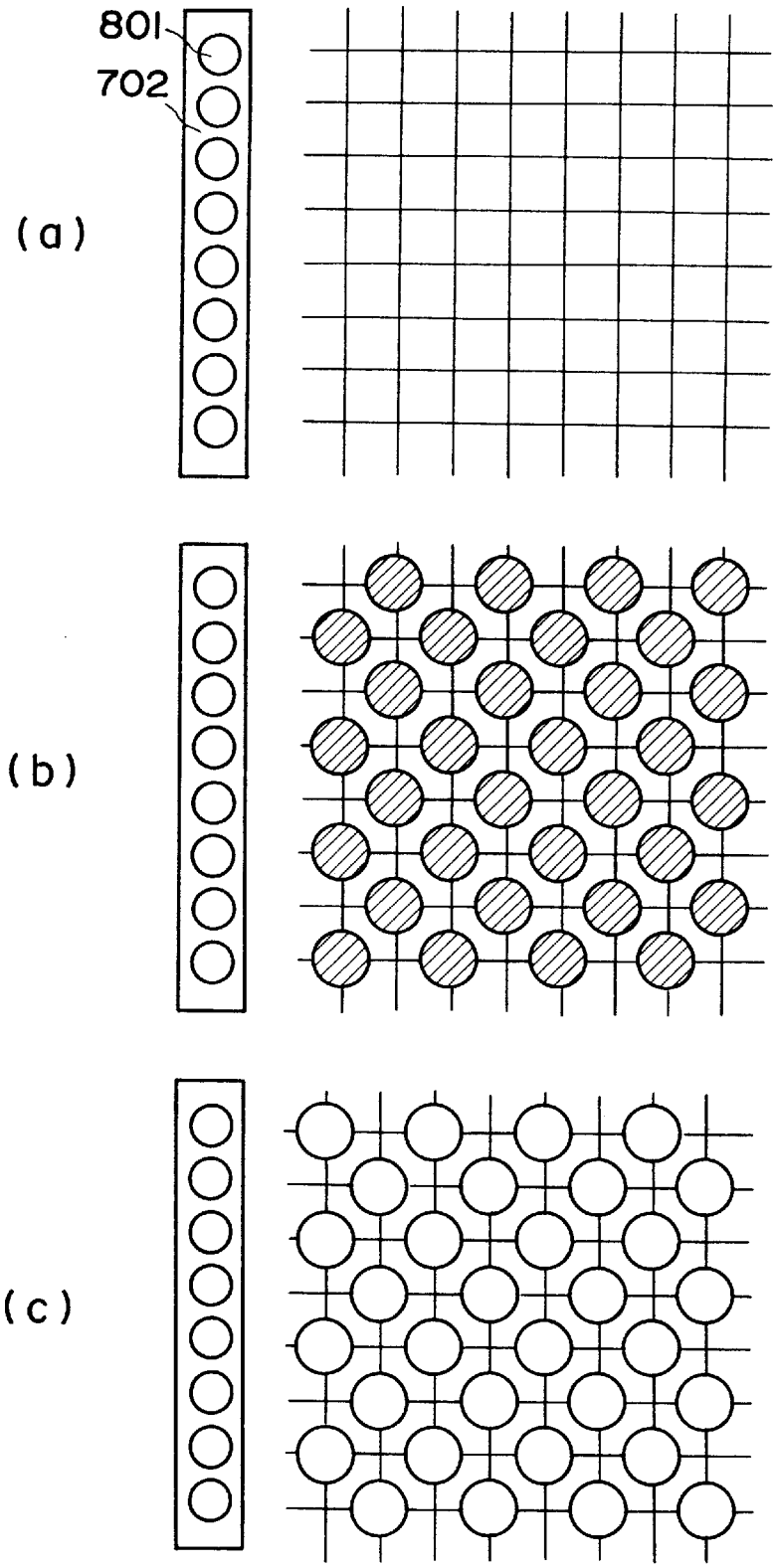
FIGS. 39(*a*)–39(*c*) are illustrations of a twelfth embodiment.

FIG. 39 is a schematic drawing which depicts this embodiment, in which the set of dots formed during the second run of the carriage 7 interlaces with the set of the dots formed during the first run of the carriage 7, that is, during the second run of the carriage 7, the dots are formed in a manner to fill the gaps among the dots formed during the first run of the carriage 7. In this drawing, a referential Figure 702 designates a head, and a referential Figure 801 designates the ejection opening of each of the nozzles aligned in the lengthwise direction of the head 702. In FIG. 39, a structure with only eight openings is illustrated to simplify the description of this embodiment.

FIG. 39, (a) is a schematic drawing which shows the spots on which dots are formed; dots are formed by ink droplets, one for one, at the intersections of the vertical and horizontal lines. FIGS. 39, (b) and (c) show a set of the intersections and another set of the intersections in an interlacing relationship relative to the first set. In both FIGS. 39, (b) and (c), the intersections are alternately picked in a checker pattern, but the positions of the skipped intersections in FIG. 39, (b) are different from those in FIG. 39, (c). The dot distribution patterns in FIGS. 39, (b) and (c) are compensatory to each other in terms of filling the voids. Thus, the black image portion is completed by forming the two sets of the black dots, the distribution patterns of which are compensatory to each other, across the same area of the ordinary paper 1.

In the drawing, in order to make it easier to see the difference in position between the set of the dots formed during the first run of the carriage, and the set of the dots formed during the second run of the carriage 7, the dot positions in FIG. 39, (b) are indicated by hatched circles, and the dot positions in the FIG. 39, (c) are indicated by circles without hatching.

If this embodiment of the present invention, that is, the printing system which forms a given portion of an image by forming two sets of dots in an interlacing relation through two scanning runs of the carriage 7 in the primary scanning direction, is incorporated into the first embodiment, that is, the printing sequence depicted in FIGS. 25, (a) and (b), the number of dots to be formed during each run of the carriage 7 can be reduced. Therefore, the amount of ink to be ejected onto the recording medium can be reduced, which enhances the effects of the first embodiment; the ink is better fixed, and the interference between the inks from the areas immediately adjacent to each other can be reduced. Thus, image quality is further improved.

The circles in FIG. 39 schematically show the dot positions, and do not represent the sizes of the actual dots formed on the recording medium. Further, the pattern in which the intersections are skipped does not need to be limited to the one described in this embodiment.

Embodiment 13

Next, the thirteenth embodiment compatible with a multiple scanning type recording system will be described. When an ink jet recording system which employs a multiple nozzle head comprising a plurality of aligned nozzles is used, it is possible that the amount of the ink ejected from one nozzle may be different from the amount of the ink ejected from another nozzle, and/or the direction in which the ink is ejected from one nozzle may be different from the direction in which the ink is ejected from another nozzle. These differences occur due to the minuscule difference in size and shape among the nozzles, which is created at any of various stages in manufacturing a large number of multiple nozzle heads. If there are such problems, the recording apparatus sometimes produces images inconsistent in density. As for a recording system capable of preventing the apparatus from producing such images, there is a recording system called the multiple scan system, which completes a given portion of an image by a plurality of recording runs in the primary scanning direction.

Figure 40:
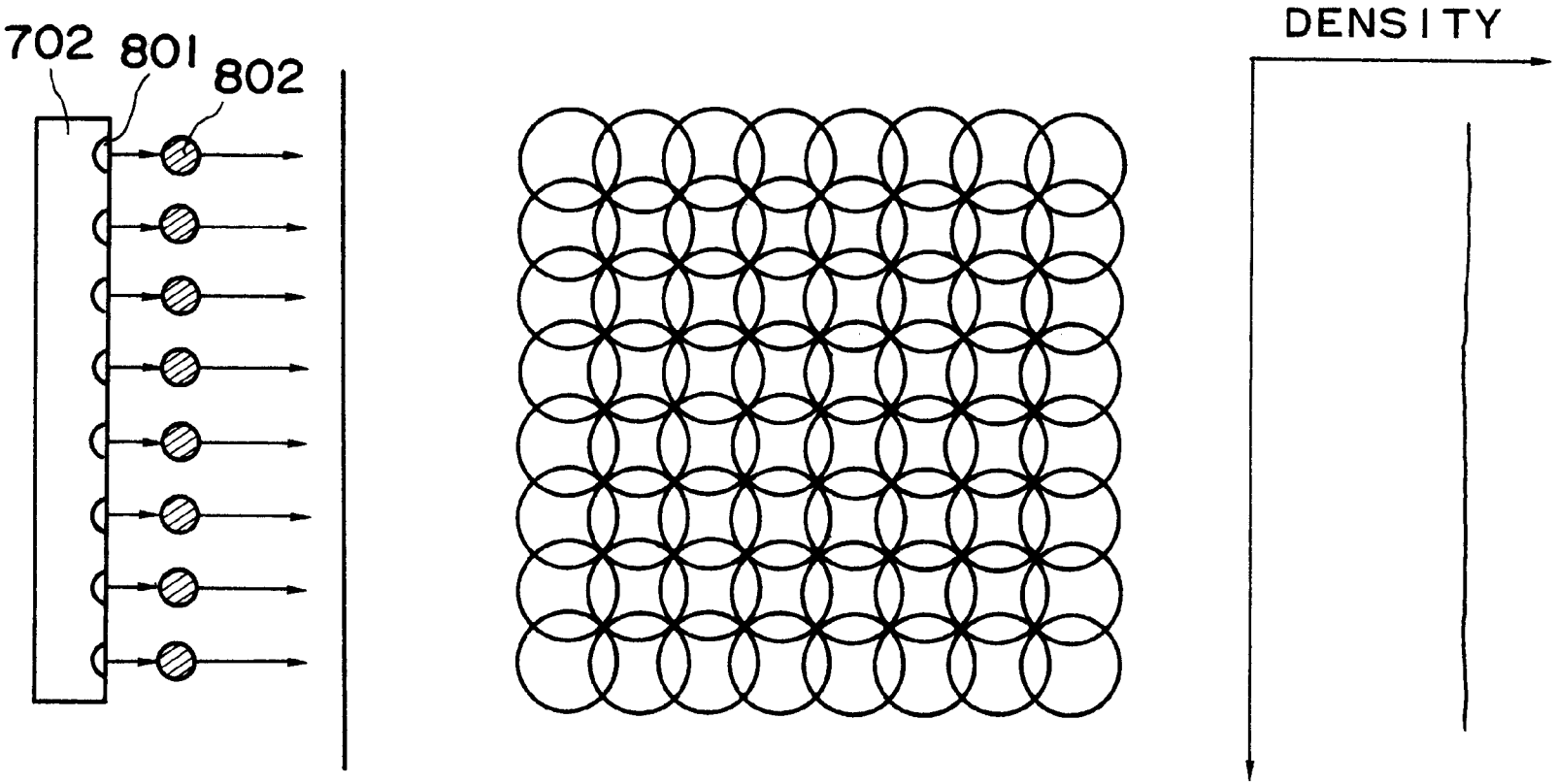
FIGS. 40(*a*)–40(*c*) are illustrations of a thirteenth embodiment.

This multiple scan printing system will be described with reference to FIG. 40, which schematically depicts in example of the multiple scan printing system. Referring to FIG. 40, (a), a referential Figure 702 designates a multiple nozzle head, which is the same as the one depicted in FIG. 35. For the sake of simplification of the description, it is assumed that the head 702 has eight nozzles. Further, in this drawing, in order to make it easier to understand the state of the ink droplet 802 (which, hereinafter, may be referred to a "droplet") ejected from each nozzle 801, the multiple nozzle head 702 and the ink droplets 802 are schematically drawn as seen from the lateral direction of the head 702. The recording apparatus which employs this multiple nozzle head is a serial type recording apparatus such as the one illustrated in FIG. 21, and the detailed description of the apparatus will be omitted here. Referring to FIG. 40, ideally, all the ink droplets 802 ejected from the head 702 should be equal in amount and direction, and if the ink droplets 802 were ideally ejected in amount and direction, they would have landed on the recording medium, at normal positions, and would have formed dots of equal size, as shown in FIG. 40, (b). Further, the image density of this image portion would have been uniform across the entire image portion, as shown in FIG. 40, (c).

Figure 41:
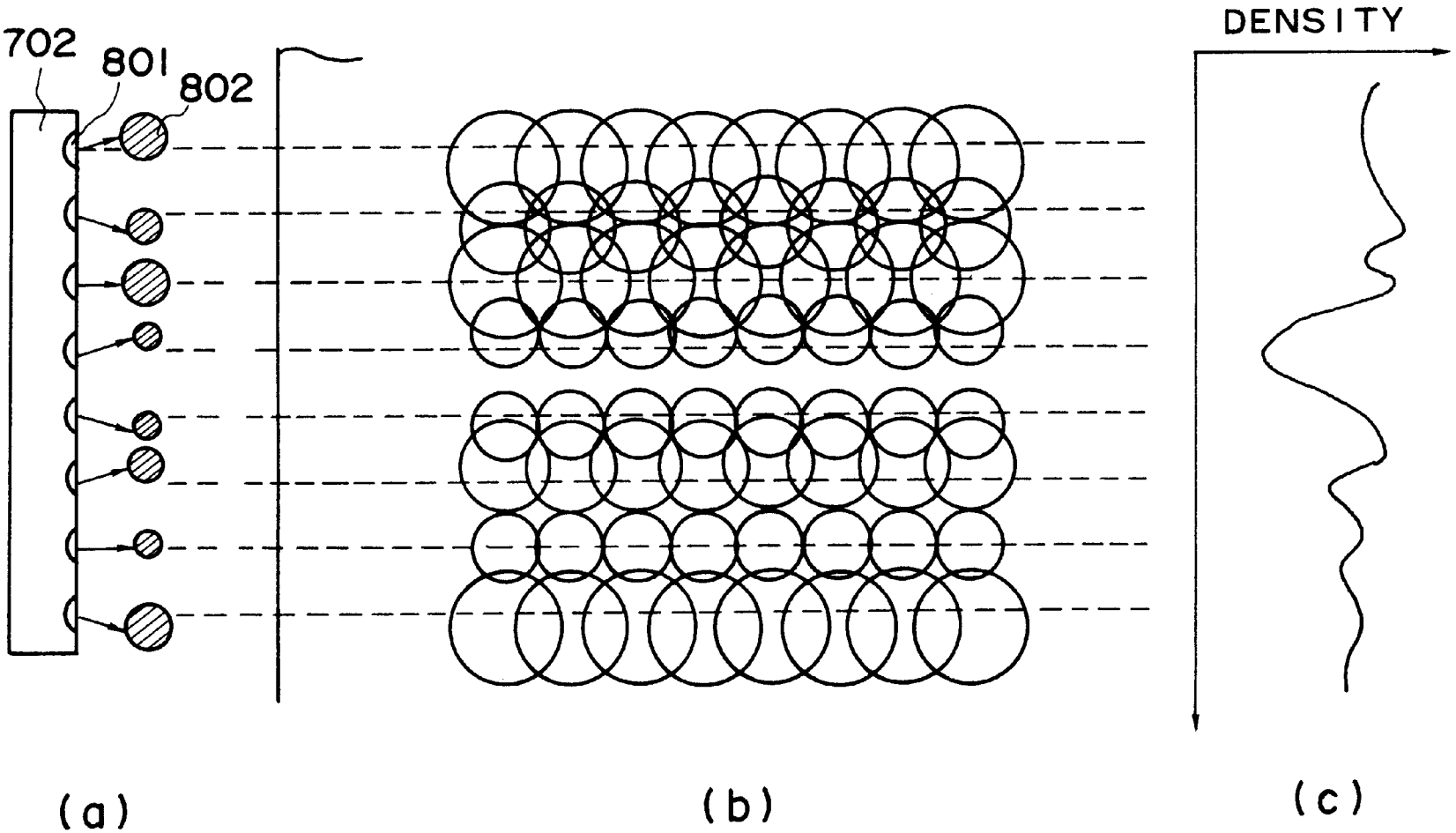
FIGS. 41A–C are illustrations of an example of printing defect.

However, in reality, each nozzle is different in size and shape from the others as described before. Therefore, the ink droplet ejected from each nozzle is different in size and direction from the ink droplets ejected from the others, as shown in FIG. 40, (a). Thus, if an image is formed using such a head, the ejected ink droplets form a pattern as they land on the recording sheet, as shown in FIG. 40, (b). In other words, while spots, that is, the spots with an area factor of less than 100% appear at a certain intervals in the primary scanning direction of the head, or dots overlap each other far more than they should. Further, while stripes such as the one seen at the center of this drawing sometimes appear. The dots which land in the pattern illustrated in FIG. 40, (b) produce a density distribution shown in FIG. 41, (c). If an image composed of dots different in size and abnormal in distribution pattern as illustrated in FIG. 41, (b), is seen by a person with normal vision, the inconsistency in density can be detected.

Figure 42:
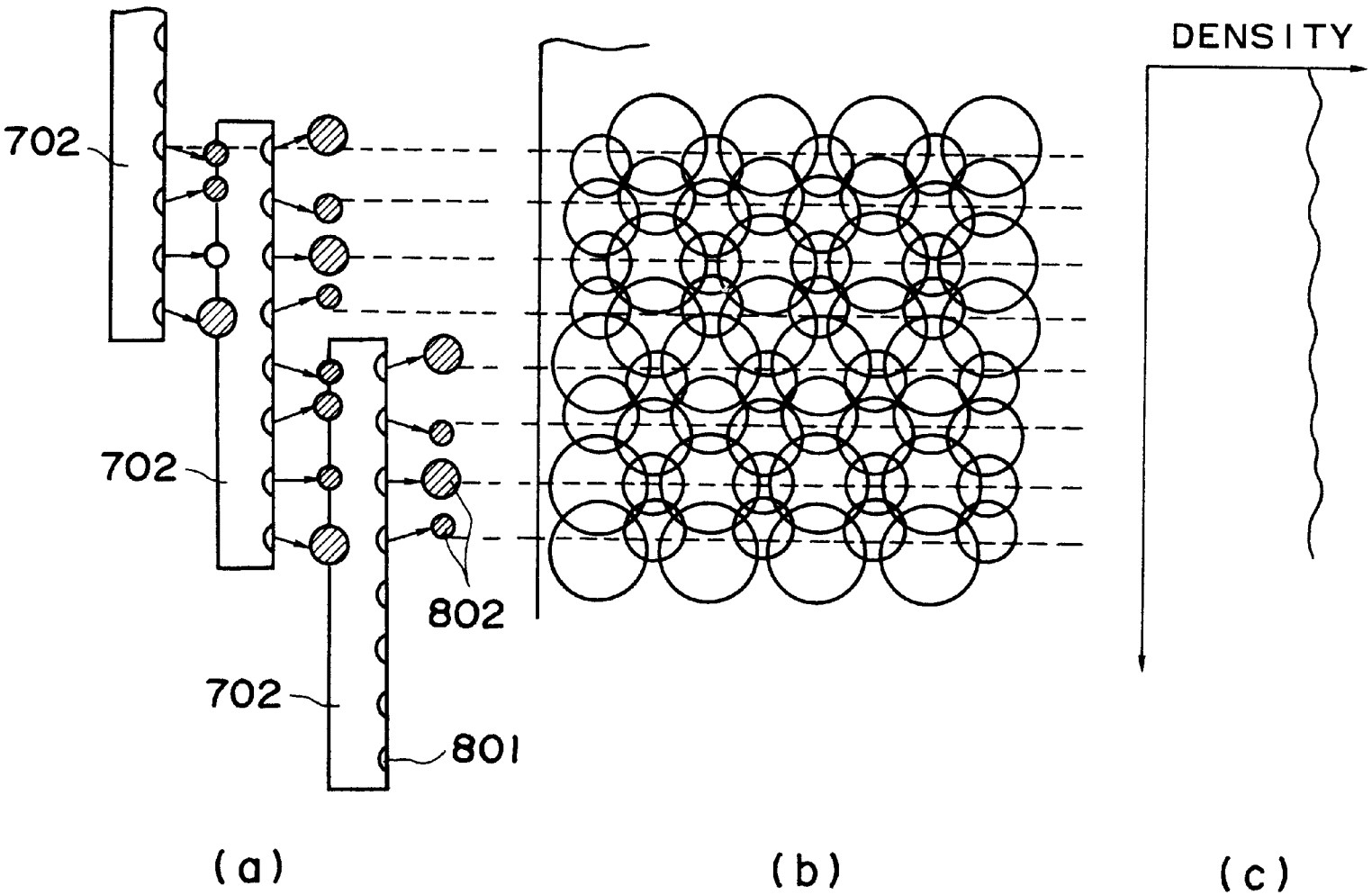
FIGS. 42A–C are illustrations of a preferable divided printing method.
Figure 43:
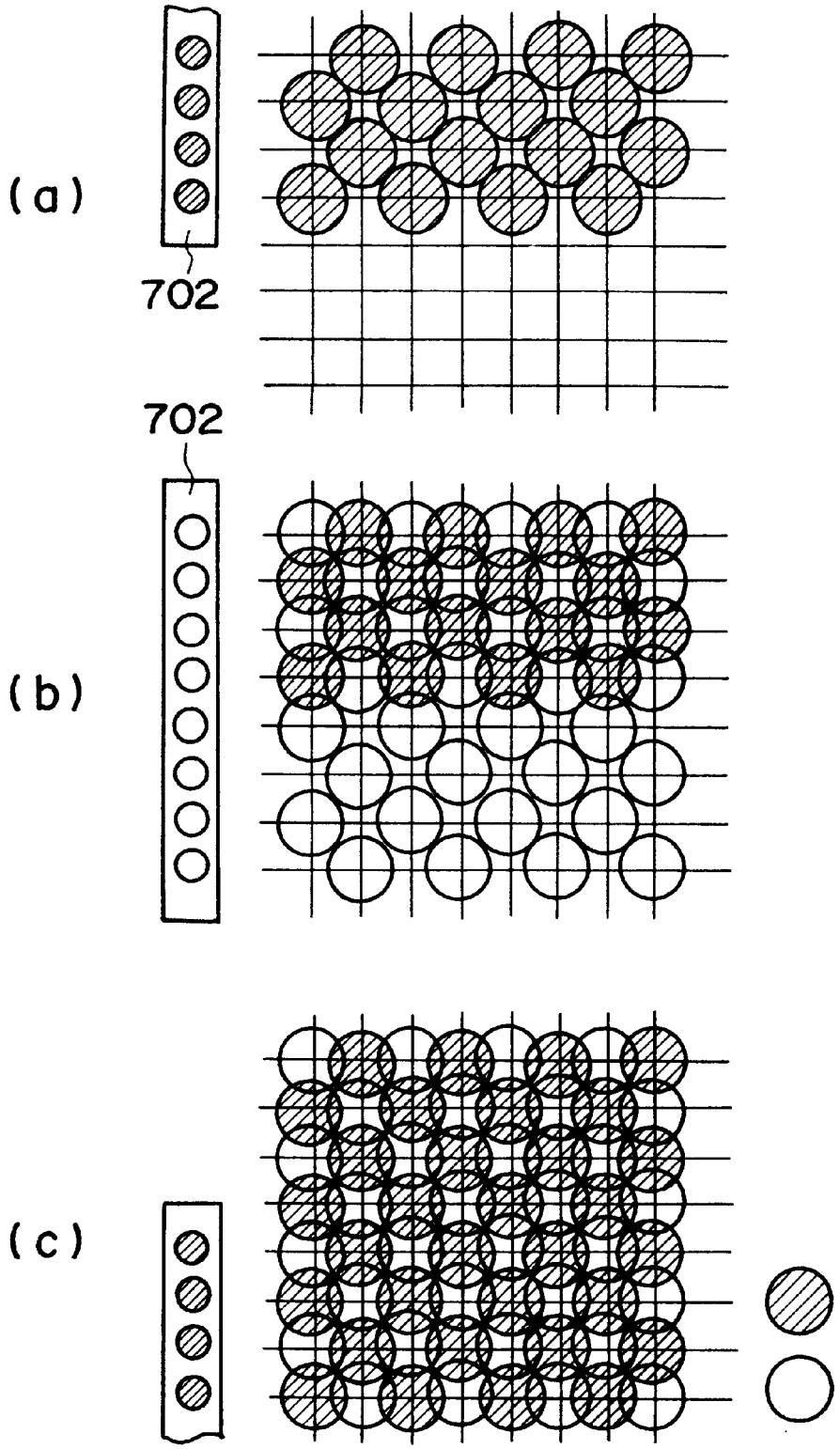
FIGS. 43A–C are illustrations of another example of a divided printing method.

Referring to FIGS. 42 and 43, a multi-scanning type which is proposed as a countermeasurement against the density non-uniformity, will be described.

With such a method, a multi-nozzle head 702 scans the print region shown in FIGS. 42 and 43 three times, and the region of 4 pixel unit (one half) is completed by 2 scans. In this case, the 8 nozzle of multi head is divided into upper 4 nozzles and lower 4 nozzles. The dots printed by one nozzle through one scan are skipped into one half in accordance with a predetermined image data arrangement. In the second scan, the remaining one half is supplemented to complete the print in the four pixel unit area. Such a printing method is called here divided printing method. With such a divided printing method, even if the same print head as in FIG. 41 is used, the influence, peculiar to a nozzle, to the printed image is reduced to one half, and therefore, the printed image is as shown in FIGS. 42, (b) 43(*b*), so that black stripe or white stripe is not so conspicuous as in FIG. 41, (b). Therefore, the density non-uniformity is eased as compared with FIG. 41 case, as shown in FIG. 42, (c).

Embodiment 14

In this embodiment, the use is made with an ink jet recording head which can change the size of the ink droplet.

It is known that gradation recording is effected by ejecting ink droplets having different sizes. As a method, in a type wherein the ink is supplied with thermal energy to generate a bubble to eject the ink, a plurality of heaters are provided in a nozzle, and the driving of the heaters are controlled to eject different size droplets. Using this, a small dot is formed by driving one heater, and a large dot is formed by driving plural heaters.

Figure 44:
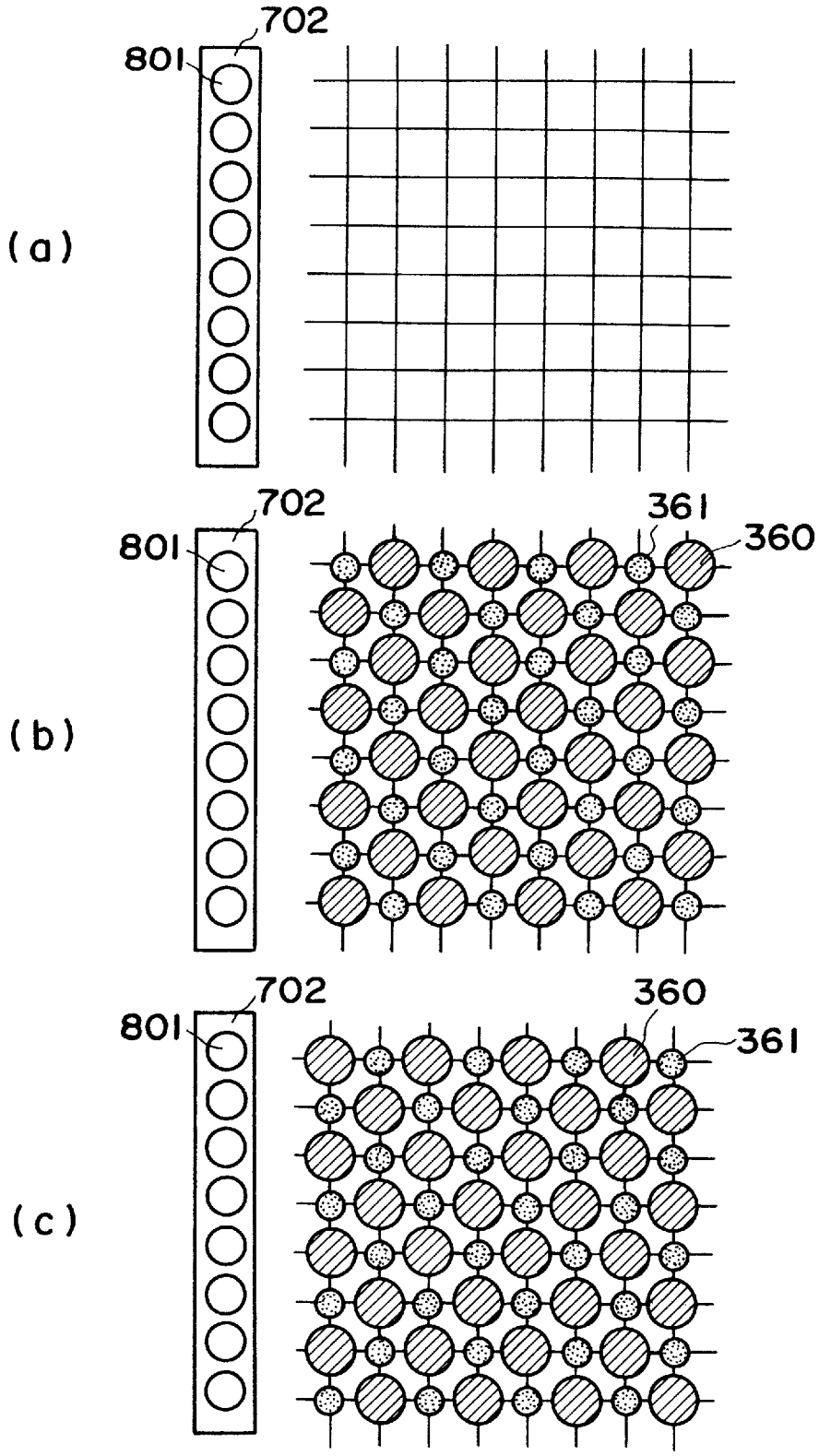
FIGS. 44A–C are illustrations of a fourteenth embodiment.

FIG. 44 shows an example wherein such a recording head is used, and an image is formed by two main-scan recordings. Designated by 702 schematically shows a head, and 801 shows a nozzle of the head. For the sake of simplicity, the head has only 8 nozzles.

FIG. 44, (a) shows the head and the recording position thereof by the head, the dots are formed at the intersections in FIG. 44, (a) by the ink droplets ejected from the head.

FIGS. 44, s (b) and 44(*c*) show another example of dot patterns recorded by different main-scans. In FIG. 44, (b), large dots 360 are recorded on the positions where the dots are skipped into a checker pattern, and small dots 361 are recorded on the positions where the recording is not effected by the dots 360. The dots 360 and dots 361 are complementary with each other. In FIG. 44, (c), the dots 360 are large dots, and dot 361 are small dots, and the dots are skipped in the reverse pattern with respect to the case of FIG. 44, (b). Therefore, looking at the large dots 360, the complementary recording is effected by two scans (FIGS. 44, s (b), 44(*c*)), and for the small dots 361, the complementary recording is effected by two scans.

When the present invention which suppresses the penetration of the ink into the recording paper, is incorporated in this recording system, the amount of the ink ejected by one main-scan is suppressed, and ink is ejected alternately to the small dots and to the large dots, and therefore, the area factor of the dots recorded by one main-scan can be reduced, so that fixing property is further improved without the problem of the reduced density.

Figure 45:
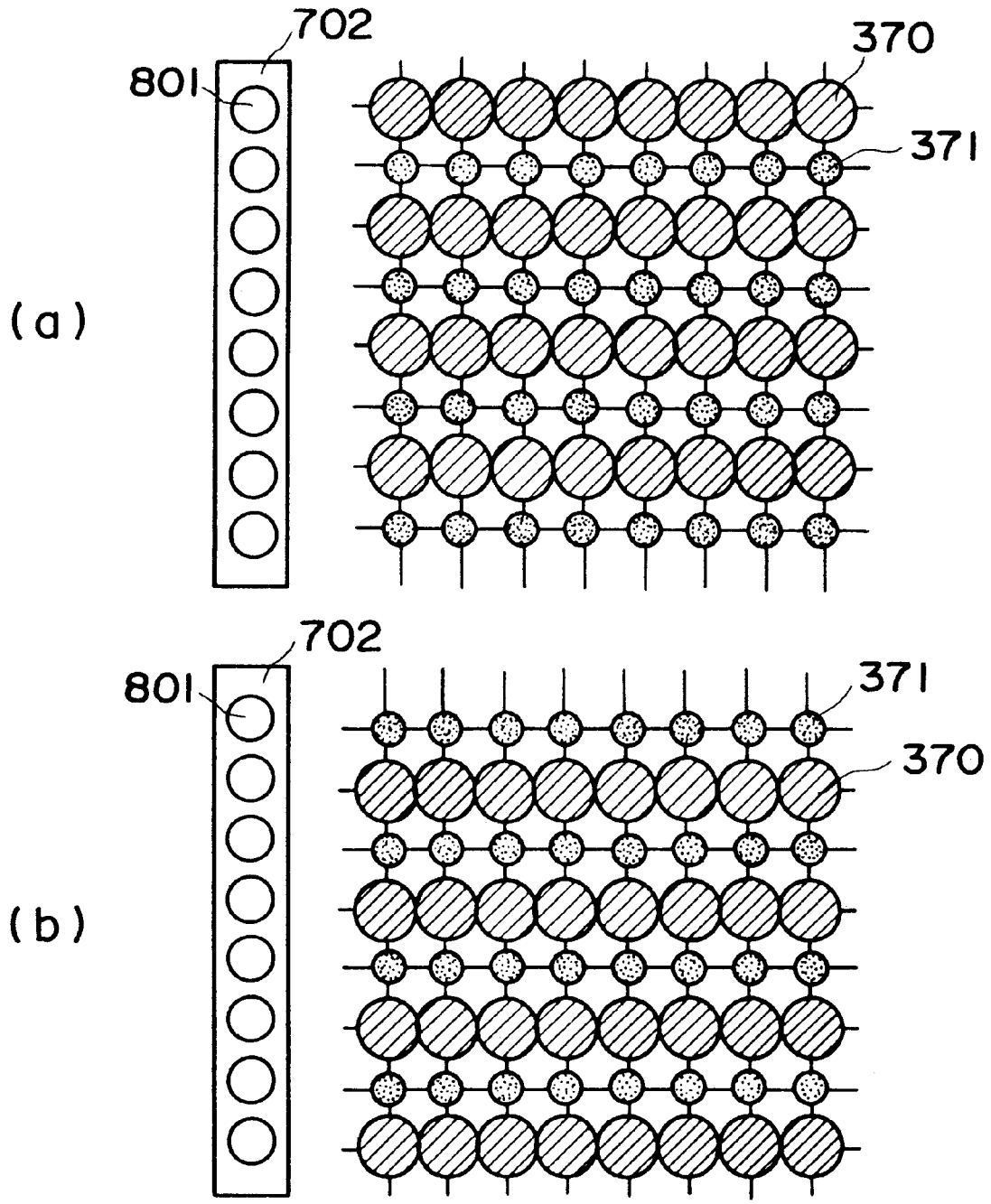
FIGS. 45A and 45B are illustrations of a modified example of a fourteenth embodiment.

The recording sequence is not limited to the one showing FIG. 44, but the recording patter is as shown in FIG. 45, for example. FIG. 45 shows an example wherein the Image is formed through two main-scan recordings using a recording head capable of ejecting different size ink droplets.

FIGS. 45, s (a) and 45(*b*) show example of dot pattern for different main-scans. In FIG. 45, the large dot pattern and small dot pattern are different from that shown in FIG. 44. In FIG. 45, the dot pattern of the large dots 370 and the dot pattern of the small data 371, are alternate in the direction of the arrangement of the nozzles 601.

Also in the recording sequence shown in FIG. 45, by the application of the suppression of the penetration of the ink into the recording paper using the heater or the present invention, the amount of the ink ejected to the recording paper surface by one main-scanning is suppressed, and the recorded image having the high fixing property and high image density can be formed.

In the foregoing description, ink droplets having different dot sizes are ejected by driving a plurality of heaters of the of the nozzles, but the present invention is applicable to the structure wherein a single ejecting means is provided in each nozzle, and the signal for driving the ejecting means is control d to change the dot size.

Fifteenth Embodiment

Figure 49:
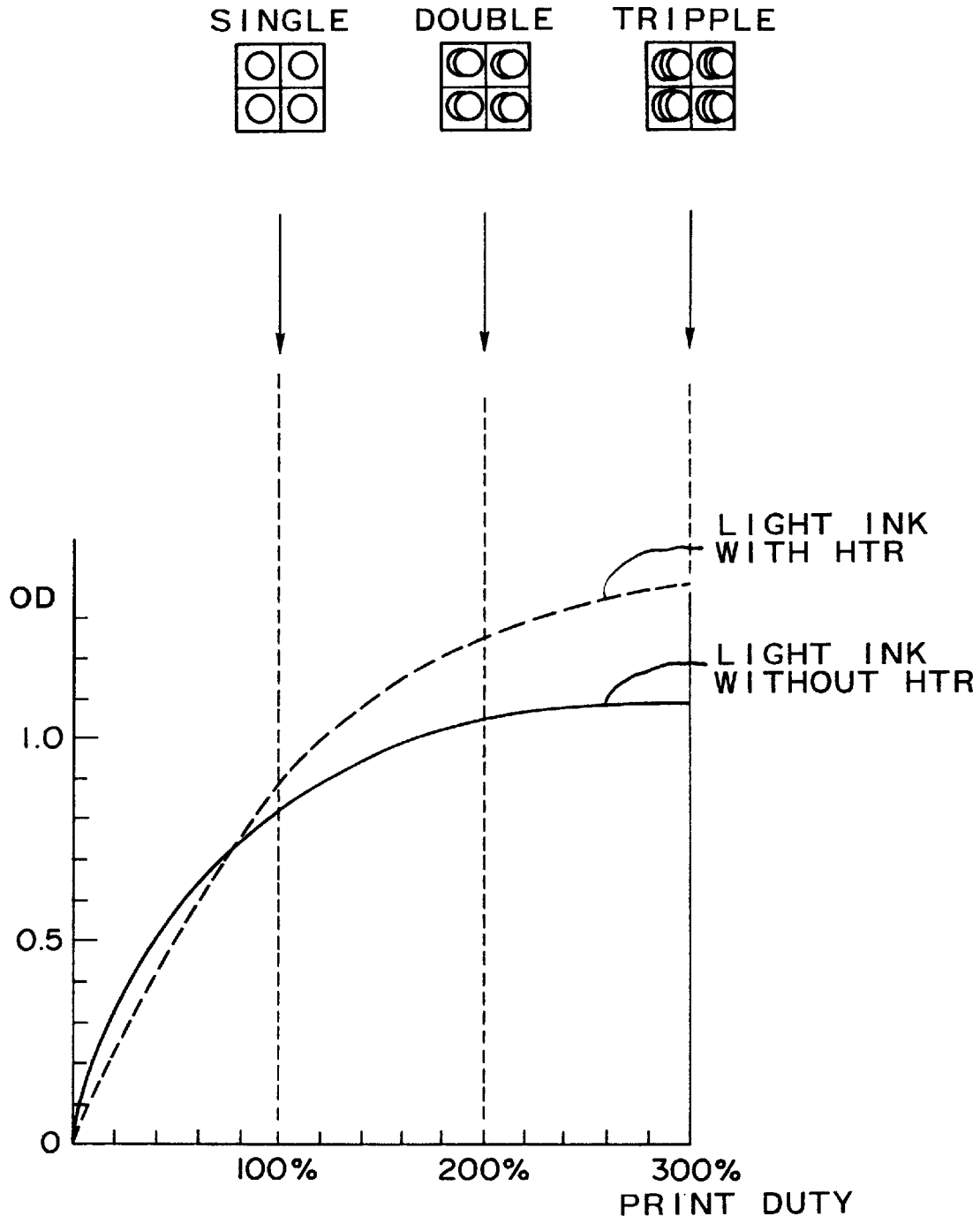
FIG. 49 is an illustration of fifteenth embodiment.

In this example, the ink to be used is prepared by reducing the content of the blue color agent such as the dye or the like down to ⅓–⅙ of normal ink (light ink having dye density of 0.3–1.2%). In this embodiment, the penetration of the penetrative ink is suppressed by the heat of the heater. Therefore, when the use is made with light ink having ⅓ concentration or density, the degree of spread in the lateral direction is small, and therefore, the dot diameter is small when the printing is effected with single dot at a low duty (not more than 100%) without overlaying. As a result, as show in FIG. 49, the OD (optical density) in the high light portion decreases, and therefore, the granular feeling is reduced. On the other hand, with the high duty printing (more than 100% and less than 300%), the light ink is overlaid, so that OD value is increased as shown in FIG. 49 with the aid of the overlaying interval. Even when the plain paper is used, the printing is capable with very the high OD value at the solid portion and with the very high gradation.

In this embodiment, the light ink can be overlaid three times at the maximum by three scans. This is because the ink can be sufficiently tolerable since the water content in the ink is evaporated by the heat supplied by the heater. Since the ink is semi-penetrative, the fixing property is good, and the OD in the solid portion is high. The content of the acetylenol (nonionic surfactant) in the light ink is preferably 0.2–0.7% further preferably 0.3–0.5%. In the foregoing embodiment, the overlaying of the light inks have been described, but the recording may be effected with combination of the dark ink and the light ink.

The apparatus structure of this embodiment may be the same as the one used in the previous embodiment, and particularly, a serial printer is suitable wherein divided recording method or interfacing recording method for pixel is completed by a plurality of scans is used. It is preferable that heater is right below the printing region of the recording head.

As described in the foregoing, according to the present invention, the ink does not remain as a projection on the surface of the recording material, the spread or the bleeding at the boundary between the ink dots can be suppressed. Furthermore, by the use of heating, the penetration depth of the ink is suppressed, the light incident on the recording material is reflected at a position adjacent to the surface (shallow position), and therefore, the image is clear. Additionally, the coloring matter component is not dispersed so much, and the feathering in the form of whiskers can be prevented. When a record of a dot is formed by a plurality of ink ejections, the penetration time is shortened, and the printing quality is improved.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording method using a recording device including a recording head provided with an ejection outlet for ejecting black ink and color ink other than the black ink and heating means for heating at least a part of a recording material comprising:

a recording step of recording by ejecting both the black ink and the color ink to a predetermined region on a recording material, using the recording head;

a heating step of heating the region by the heating means;

wherein each of the black ink and the color ink has an ink absorption coefficient Ka ($ml.m^{-2}.msec^{-1/2}$) relative to a predetermined paper, defined by the Bristow method, of 1.0–5.0, and satisfies $0<ts\leqq 200$ msec, where ts is a time period from the arrival of the ink at the recording material to a starting point of time of rapid expansion, and wherein the rapid expansion starts after the end of a wetting period.

2. A method according to claim 1, wherein the recording head includes an electrothermal transducer for applying thermal energy to the ink to eject the ink through the ejection outlet.

3. A method according to claim 2, wherein the thermal energy generates a bubble to eject the ink.

4. A method according to claim 1, wherein the black ink is a self-dispersing pigment ink not including a dispersion material.

5. A method according to claim 1, wherein said recording step includes a plurality of recording operations.

6. A method according to claim 1, wherein the color ink is light ink containing 0.3–1.2% by weight coloring material and the light ink is overlaid on a same pixel by a plurality of recording operations in said recording step.

7. A method according to claim 1, wherein in said recording step two ink droplets are deposited on the same pixel with a time difference of approximately one second.

8. A method according to claim 1, wherein the rapid expansion start point is a point where an adhesion to a fiber itself of the recording material by ink quickly begins after the ink droplet is deposited on the recording material.

9. A method according to claim 1, wherein at least said heating step is carried out before elapse of ts after deposition of the black ink on the recording material, by which a penetration depth is suppressed.

10. An ink jet recording method using a recording device including a recording head provided with an ejection outlet for ejecting black ink and color ink other than the black ink and heating means for heating at least a part of a recording material comprising:

a first recording step of recording by ejecting at least one of the black and the color ink to a predetermined region on a recording material;

a heating step of heating the region by the heating means; and a second recording step of recording by ejecting at least one of the black and the color ink to the region after said heating step;

wherein each of the black ink and the color ink has an ink absorption coefficient Ka ($ml.m^{-2}.msec^{-1/2}$) relative to a predetermined paper, defined by the Bristow method, of 1.0–5.0, and satisfies $0<ts\leqq 200$ msec, where ts is a time period from the arrival of the ink at the recording material to a starting point of time of rapid expansion, and wherein the rapid expansion starts after the end of a wetting period.

11. A method according to claim 10, wherein said heating step is effective to reduce the penetration depth of the ink ejected by said first recording step, compared to the penetration depth when no heating step is performed.

12. A method according to claim 10, wherein said second recording step ejects the ink onto a position which at least partly overlaps a recording dot provided by said first recording step.

13. A method according to claim 10, wherein said first recording step and said second recording step eject the ink complimentarily to effect the recording.

14. A method according to claim 13, wherein said first recording step and second recording step eject the ink in a complementary staggered manner.

15. A method according to claim 13, wherein said first recording step and said second recording step effect the recording with a skipped pattern.

16. A method according to claim 10, wherein said second recording step ejects the ink while the ink ejected by said first recording step is penetrating in the recording material.

17. A method according to claim 10 or 16, wherein the recording device includes a carriage for carrying the recording head and a scanner for scanning the carriage in a main-scan direction, and effect a serial type recording in which the recording is effected during scanning movement of the carriage, and wherein the heating means is provided to heat a back side of the recording material in the region being recorded.

18. A method according to claim 17, wherein said first recording step and said second recording step are carried out in different main scans.

19. A method according to claim 17, wherein the heating means constitutes a part of a platen for supporting the recording material.

20. A method according to claim 19, wherein the heating means is a ceramic heater.

21. A method according to claim 10 or 16, wherein the recording device includes a feeder for feeding the recording material in a feeding direction, and wherein the recording head is a full-line type head capable of recording in an entire area in a direction different from the feeding direction.

22. A method according to claim 21, wherein a plurality of such recording heads are arranged in the feeding direction.

23. A method according to claim 22, wherein the heating means is disposed between the recording heads at a position deviated from the recording heads in the feeding direction, and is capable of heating the recording material over the entire range in a width direction which is perpendicular to the feeding direction.

24. A method according to claim 23, wherein the heating means includes a halogen lamp heater.

25. A method according to claim 10, wherein the recording head includes an electrothermal transducer for applying thermal energy to the ink to eject the ink through the ejection outlet.

26. A method according to claim 25, wherein the thermal energy generates a bubble to eject the ink.

27. A method according to claim 1 or 10, wherein each of the black ink and the color ink comprises ethylene oxide 2,4,7,9-tetramethyl-5-decyne-4,7-diol, a content of which is smaller than a critical micelle concentration (c.m.c.) of ethylene oxide-2,4,7,9-tetramethyl-5-decyne-4,7-diol.

* * * * *

UNITED STATES PATENT AND TRADEMARK OFFICE

CERTIFICATE OF CORRECTION

PATENT NO. : 6,612,691 B1 
DATED : September 2, 2003
INVENTOR(S) : Noribumi Koitabashi et al.

It is certified that error appears in the above-identified patent and that said Letters Patent is hereby corrected as shown below:

Column 1,
Line 11, “method is” should read -- methods are --.
Line 12, “are” should read -- is --.
Line 53, “((feathering)” should read -- (feathering) -- and “unsharp” should read -- an unsharp --.
Line 54, “on-penetrative” should read -- non-penetrative --.
Line 62, “whom” should read -- when --.
Line 65, “fore of” should read -- fore --.

Column 2,
Line 9, “be looked” should read -- look --.
Line 23, “decreased,” should read -- decreases, --.
Line 27, “breeding” should read -- bleeding --.
Line 28, “56” should read -- boundary portion 56 --.
Line 30, “the-” should read -- the --.
Line 32, “breeding” should read -- bleeding -- and “requires” should read -- requires a --.
Line 42, “dew an the” should read -- condense on --.

Column 3,
Line 61, “1A-C” should read -- 1(a)-1(c) --.

Column 4,
Line 1, “FIGS. 5A-D” should read -- FIGS. 5(a)-5(d) are --.
Line 3, “FIGS. 6A-C” should read -- FIGS. 6(a)-6(c) --.
Line 5, “FIGS. 7A and 7B” should read -- FIGS. 7(a) and 7(b) are --.
Line 47, “print state” should read -- of print states --.

Figure 46:
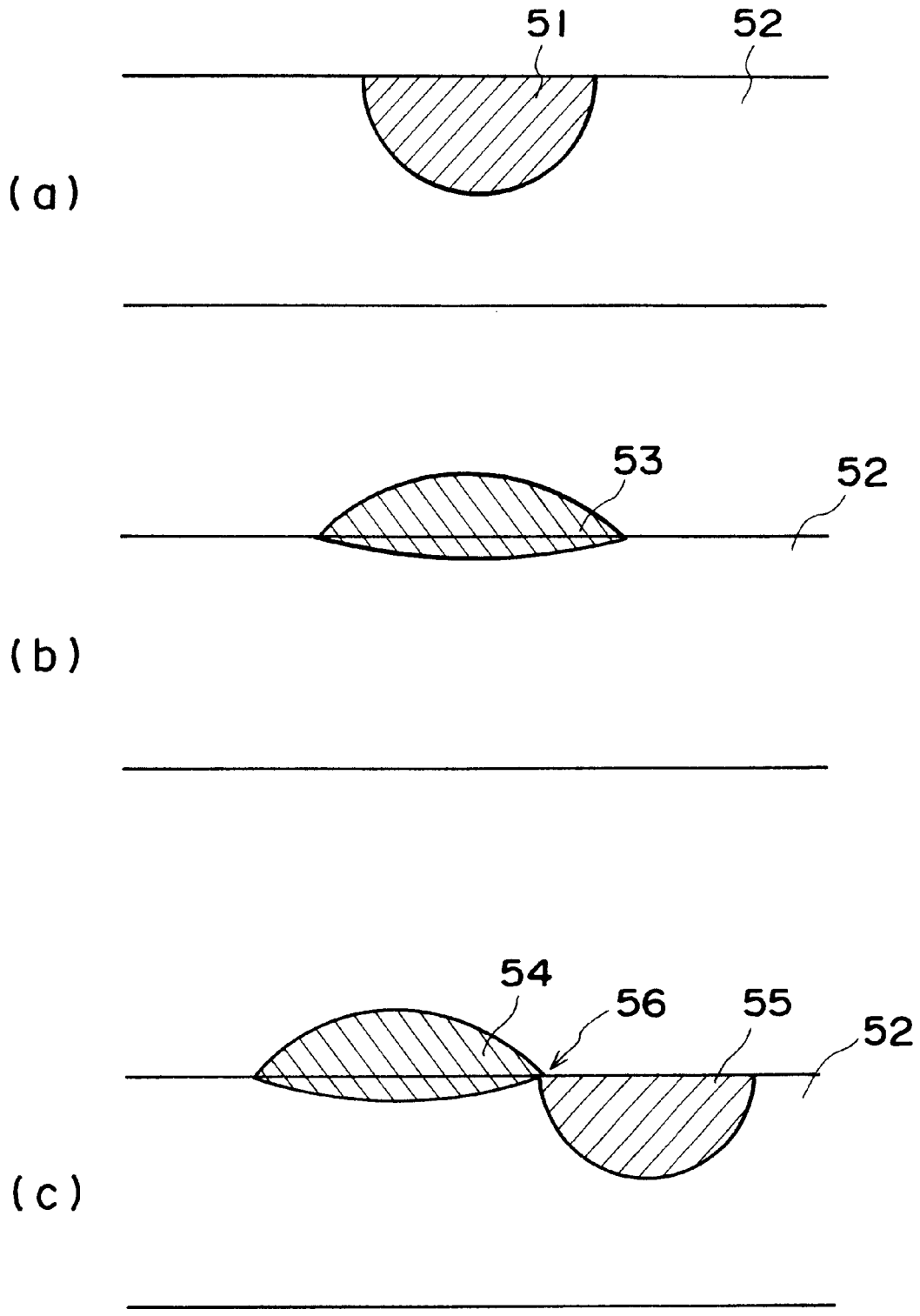
FIGS. 46A–C are illustrations of an ink droplet formation state in an ink jet recording method.

Column 5,
Line 9, “FIGS. 41A-C” should read -- FIGS. 41(a)-41(c) --.
Line 11, “FIGS. 42A-C” should read -- FIGS. 42(a)-42(c) --.
Line 13, “FIGS. 43A-C” should read -- FIGS. 43(a)-43(c) --.
Line 15, “FIGS. 44A-C” should read -- FIGS. 44(a)-44(c) --.
Line 17, “FIGS. 45A and 45B” should read -- FIGS. 45(a) and 45(b) --.
Line 19, “FIGS. 46A-C” should read -- FIGS. 46(a)-46(c) --.
Line 25, “fifteenth” should read -- a fifteenth --.
Line 26, “FIGS. 50 A-D” should read -- FIGS. 50(a)-50(d) --.
Line 41, “an” should read -- on --.
Line 54, “The is” should read -- The ink --.

UNITED STATES PATENT AND TRADEMARK OFFICE

CERTIFICATE OF CORRECTION

PATENT NO. : 6,612,691 B1
DATED : September 2, 2003
INVENTOR(S) : Noribumi Koitabashi et al.

It is certified that error appears in the above-identified patent and that said Letters Patent is hereby corrected as shown below:

Column 6,
Line 39, “last” should read -- fast --.
Line 42, “adhere” should read -- adheres --.

Column 7,
Table, Line 12, “(Kawakan Chemical)” should read -- (Kawaken Chemical) --.
Line 37, “cages” should read -- cases --.
Line 40, “this” should read -- these --.
Line 62, “amounts in” should read -- amount. In --.
Line 64, “ties” should read -- time --.
Line 66, “fill” should read -- fills --.

Column 8,
Line 5, “factor at” should read -- factor of --.
Line 40, “sizing” should read -- a sizing --.
Line 57, “an” should read -- on --.

Column 9,
Line 4, “is among” should read -- among --.
Line 21, “amount at” should read -- amount of --.
Line 45, “recording” should read -- the recording --.
Line 55, “color” should read -- colors --.

Column 10,
Line 13, “increased.” should read -- increases. --.
Line 16, “by whether” should read -- whether --.
Line 44, “0.2%-0%” should read -- 0.2%-0.7% --.

Column 11,
Line 16, ““Semi-penetrative” should read -- “semi-penetrative --.

Column 12,
Line 18, “illustrated” should read -- illustrate --.
Line 53, “redetermined” should read -- predetermined --.
Line 62, “elected” should read -- ejected --.

Column 13,
Line 19, “In” should read -- is --.
Line 49, “elections” should read -- ejections --.

UNITED STATES PATENT AND TRADEMARK OFFICE

CERTIFICATE OF CORRECTION

PATENT NO. : 6,612,691 B1
DATED : September 2, 2003
INVENTOR(S) : Noribumi Koitabashi et al.

It is certified that error appears in the above-identified patent and that said Letters Patent is hereby corrected as shown below:

Column 14,
Line 18, “penetrates” should read -- penetrate --.

Column 15,
Line 48, “erected” should read -- ejected --.

Column 16,
Line 60, “al so” should read -- also --.

Column 17,
Line 43, “increase.” should read -- increases. --.
Line 48, “an therefore,” should read -- and therefore, --.
Line 49, “desirably” should read -- desirable --.
Line 62, “in” should read -- ink --.

Column 19,
Line 14, “problems” should read -- problem --.
Line 20, “end as” should read -- and as --.
Line 42, “it the” should read -- if the --.

Column 20,
Line 17, “which” should read -- when --.
Line 32, “tram” should read -- from --.

Column 21,
Line 20, “black” should read -- black ink --.
Line 29, “carriage 1” should read -- carriage 7 --.
Line 34, “Figure” should read -- Figure 13 --.

Column 22,
Line 3, “head” should read -- heads --.
Line 26, “red” should read -- fed --.

Column 23,
Line 64, “he” should read -- the --.

Column 24,
Line 26, “tun” should read -- run --.
Line 45, “carriage 705” should read -- carriage 706 --.
Line 56, “an” should read -- and --.

UNITED STATES PATENT AND TRADEMARK OFFICE

CERTIFICATE OF CORRECTION

PATENT NO. : 6,612,691 B1
DATED : September 2, 2003
INVENTOR(S) : Noribumi Koitabashi et al.

It is certified that error appears in the above-identified patent and that said Letters Patent is hereby corrected as shown below:

Column 25,
Line 15, “area 303” should read -- area 302 --.
Line 18, “record” should read -- recorded --.
Line 43, “ran,” should read -- run, --.
Line 66, “lessor” should read -- lesser --.

Column 27,
Line 9, “an during” should read -- and during --.
Line 20, “rim” should read -- run --.
Line 24, “ment it” should read -- ment. It --.
Lines 31 and 62, “recording” should read -- record --.

Column 28,
Line 61, “heated or” should read -- heated for -- and “takes or” should read -- takes for --.

Column 29,
Line 67, “of an” should read -- of a --.

Column 30,
Line 29, “each at” should read -- each of --.
Line 40, “in the” should read -- In the --.

Column 31,
Line 52, “It a” should read -- If a --.
Line 54, “effect” should read -- effects --.

Column 32,
Line 20, “heaters R” should read -- heaters H --.

Column 33,
Line 53, “depicts in” should read -- depicts an --.

Column 34,
Line 17, “at a certain” should read -- at certain --.

UNITED STATES PATENT AND TRADEMARK OFFICE

CERTIFICATE OF CORRECTION

PATENT NO. : 6,612,691 B1 
DATED : September 2, 2003
INVENTOR(S) : Noribumi Koitabashi et al.

It is certified that error appears in the above-identified patent and that said Letters Patent is hereby corrected as shown below:

Column 35,
Lines 1 and 11, “FIGS. 44, s (b)” should read -- FIGS. 44(b) --.
Line 8, “dot 361” should read -- dots 361 --.
Line 23, “patter” should read -- pattern --.
Line 27, “FIGS. 45, s (a)” should read -- FIGS. 45(a) --.
Line 31, “data” should read -- dots --.
Line 42, “of the” should be deleted.
Line 64, “very the” should read -- the very --.

Signed and Sealed this

Fourth Day of May, 2004

JON W. DUDAS
*Acting Director of the United States Patent and Trademark Office*